US012336578B2

(12) United States Patent
Chaky

(10) Patent No.: US 12,336,578 B2
(45) Date of Patent: Jun. 24, 2025

(54) ENDLESS NECK TIE AND MOBIUS BOW TIE

(71) Applicant: Rebecca Carol Chaky, Atchison, KS (US)

(72) Inventor: Rebecca Carol Chaky, Atchison, KS (US)

( * ) Notice: Subject to any disclaimer, the term of this patent is extended or adjusted under 35 U.S.C. 154(b) by 0 days.

(21) Appl. No.: 18/323,180

(22) Filed: May 24, 2023

(65) Prior Publication Data

US 2023/0292862 A1 Sep. 21, 2023

Related U.S. Application Data

(62) Division of application No. 16/318,706, filed as application No. PCT/US2016/042779 on Jul. 18, 2016, now Pat. No. 11,744,303.

(51) Int. Cl.
*A41D 25/00* (2006.01)
*A41D 25/06* (2006.01)

(52) U.S. Cl.
CPC ..... *A41D 25/06* (2013.01); *A41D 25/008* (2013.01)

(58) Field of Classification Search
CPC ..... A44B 11/04; A44B 6/00; A44B 11/18; A44B 11/02; A41F 15/002; A41F 9/025; A41F 9/02; Y10T 24/1986; Y10T 24/2192; Y10T 24/4079; Y10T 24/4081; Y10T 24/4084; Y10T 24/4086; Y10T 24/2194; Y10T 24/1652; Y10T 24/19; Y10T 24/1903; Y10T 24/4091; Y10T 24/4093; Y10T 24/4736; Y10T 24/4745; Y10T 24/4755; Y10T 24/4764; Y10T 24/4088;

(Continued)

(56) References Cited

U.S. PATENT DOCUMENTS 47,288 A * 4/1865 Fassmann ..... A44B 11/02 24/200
489,656 A * 1/1893 Moores ..... A44B 11/22 24/318

(Continued)

FOREIGN PATENT DOCUMENTS

CH 312717 A 2/1956
FR 358393 A * 2/1906

(Continued)

OTHER PUBLICATIONS

Ehowbeauty, "How to Tie an Infinity Scarf Like a Bow : Fashion Magic", video, Youtube.com, Nov. 7, 2013, https://www.youtube.com/watch?v=WQ--wutP7jM.

(Continued)

*Primary Examiner* — Amy Vanatta
(74) *Attorney, Agent, or Firm* — Jacob M. Ward; Ward Law Office LLC

(57) ABSTRACT

An endless neck tie. In one embodiment an endless loop of fabric of varying width includes a relatively narrow segment providing a neckband, and a first blade and a second blade of variable width extending in opposite directions along the loop and away from the neckband. At least a first transition region, between the blades or between the neck band and the blades, is of such narrow width relative to the blade width that the transition region accepts at least a first knot which defines a constricted region of the endless neck tie between the neck band and the blades.

7 Claims, 36 Drawing Sheets

(58) Field of Classification Search
CPC .... A41D 25/008; A41D 25/00; A41D 25/003; A41D 25/005; A41D 25/04; A41D 25/06; A41D 2200/10; A41D 23/00
See application file for complete search history.

(56) References Cited

U.S. PATENT DOCUMENTS

| | | | | |
|---|---|---|---|---|
| 771,163 | A | 9/1904 | Leggett | |
| 881,461 | A | 3/1908 | Beatrice et al. | |
| 1,422,758 | A | 7/1922 | Morris | |
| 1,447,090 | A | 2/1923 | Langsdorf | |
| 1,457,559 | A | 6/1923 | Stonge | |
| 1,486,822 | A * | 3/1924 | Wolfson | A41D 25/06 2/155 |
| 1,540,037 | A | 6/1925 | Smith | |
| 1,618,147 | A | 2/1927 | Carpenter | |
| 1,692,991 | A | 11/1928 | Howard | |
| 1,735,172 | A | 11/1929 | Langsdorf | |
| 1,737,072 | A | 11/1929 | Blach | |
| 1,860,170 | A | 5/1932 | Bronson | |
| 1,910,797 | A | 5/1933 | Joyce | |
| 2,045,279 | A | 6/1936 | Mayer | |
| 2,045,280 | A | 6/1936 | Mayer | |
| 2,061,630 | A | 11/1936 | Keys | |
| 2,095,340 | A | 10/1937 | Meyer | |
| 2,099,199 | A * | 11/1937 | Devendor | A44B 11/04 2/268 |
| 2,140,164 | A | 12/1938 | Moffatt | |
| 2,174,993 | A | 10/1939 | Valentine | |
| 2,212,862 | A | 8/1940 | Hirsh | |
| 2,224,036 | A | 12/1940 | Van Voorhis | |
| 2,229,003 | A * | 1/1941 | Fly | A44B 11/065 242/388.2 |
| 2,278,153 | A * | 3/1942 | Shaulson | A44B 11/04 24/200 |
| 2,304,935 | A | 12/1942 | Langsdorf | |
| 2,413,318 | A | 12/1946 | Golfieri | |
| 2,442,235 | A | 5/1948 | Engler | |
| 2,565,629 | A | 8/1951 | Reinberger | |
| 2,578,269 | A | 12/1951 | Sinton | |
| 2,739,315 | A | 3/1956 | Heliotis | |
| 2,981,994 | A | 5/1961 | White | |
| 3,034,134 | A | 5/1962 | Peterson | |
| 3,181,175 | A | 5/1965 | Less | |
| 3,218,686 | A | 11/1965 | Rubenstein | |
| 3,222,687 | A | 12/1965 | Rosenzweig | |
| 3,222,688 | A | 12/1965 | Rosenzweig | |
| 3,267,490 | A | 8/1966 | Wallace | |
| 3,290,696 | A | 12/1966 | Rosenzweig | |
| 3,672,004 | A | 6/1972 | Smith | |
| 4,620,649 | A | 11/1986 | Graham | |
| 4,777,665 | A | 10/1988 | Akamatsu | |
| 4,856,115 | A | 8/1989 | Knapp | |
| 5,048,127 | A | 9/1991 | Yang | |
| 5,088,120 | A | 2/1992 | Yen | |
| 5,144,696 | A | 9/1992 | Kahl | |
| 5,361,413 | A | 11/1994 | Schaefer | |
| 5,600,851 | A | 2/1997 | McLeod | |
| 5,600,852 | A | 2/1997 | Densch | |
| 5,662,133 | A * | 9/1997 | Guido, Jr. | E04H 15/64 24/3.13 |
| 5,787,556 | A * | 8/1998 | Terzian | A47F 5/0884 24/3.12 |
| 5,867,835 | A | 2/1999 | Dabbieri | |
| D433,964 | S | 11/2000 | Fildan | |
| 6,145,131 | A | 11/2000 | Huff | |
| 6,179,687 | B1 | 1/2001 | Lee et al. | |
| 6,691,319 | B1 | 2/2004 | Simon | |
| 7,322,049 | B1 | 1/2008 | Kennedy, Jr. | |
| 8,393,016 | B2 | 3/2013 | Wilkins-Gaudio | |
| 8,668,551 | B1 * | 3/2014 | Folino | A41F 1/006 450/86 |
| 11,819,082 | B2 * | 11/2023 | Lacy | A42B 7/00 |
| 2004/0006853 | A1 | 1/2004 | Yang | |
| 2007/0289106 | A1 * | 12/2007 | Gyure | A44B 11/006 24/200 |
| 2010/0032537 | A1 * | 2/2010 | Andrews | A63B 21/4037 24/442 |
| 2016/0262471 | A1 | 9/2016 | Robertson | |

FOREIGN PATENT DOCUMENTS

| | | | |
|---|---|---|---|
| FR | 449906 | A | 3/1913 |
| FR | 659491 | A | 6/1929 |
| FR | 986235 | A | 7/1951 |
| GB | 191517734 | A | 7/1916 |
| GB | 119357 | A | 10/1918 |
| GB | 370163 | A * | 4/1932 |
| GB | 903051 | A | 8/1962 |
| GB | 2072729 | A | 10/1981 |
| JP | 2003155613 | A | 5/2003 |

OTHER PUBLICATIONS

Naohms, "How to: Wear an Infinity Scarf+ Mooncats Review | naohms", video, Youtube.com, Jan. 2, 2015, https://www.youtube.com/watch?v=ygR4MEYSXbw.

Hatchfive, "08 Pattern Belt", Tales from the Supply Depot—Collecting British Empire Militaria, Feb. 22, 2016, https://talesfromthesupplydepot.blog/2016/02/22/08-pattern-belt/.

Written Opinion of the International Searching Authority dated Jan. 12, 2017.

* cited by examiner

ENDLESS NECK TIE AND MOBIUS BOW TIE

CROSS-REFERENCE TO RELATED APPLICATIONS

This application is a divisional application of U.S. application Ser. No. 16/318,706, filed on Jan. 18, 2019, which is a National Stage Entry of PCT/US16/42779, filed on Jul. 18, 2016. The entire disclosures of the above applications are incorporated herein by reference.

FIELD OF THE INVENTION

The present invention relates to apparel and, more specifically, to neck ties as well as methods of making and tying neck ties. Embodiments of the invention provide improved designs and methods of forming neck ties.

INTRODUCTION

Neckties and bowties provide flair and style for business, formal, and service dress wear. Improvements on the necktie and bowtie have focused on the construction of ties such as the bias tie disclosed in U.S. Pat. No. 1,447,090 of Langsdorf, issued 1923, the bow tie disclosed in U.S. Pat. No. 1,735,172 of Langsdorf, issued 1929, the necktie disclosed in U.S. Pat. No. 2,174,993 of Naftali, issued 1939, and the four-in-hand tie disclosed in U.S. Pat. No. 2,304,935 of Langsdorf, issued 1942; materials with which neckties are fabricated, such as to create the plastic bow tie disclosed in U.S. Pat. No. 2,578,269 of Sinton, issued 1951, and the leather bow tie disclosed in U.S. Pat. No. 1,692,991 of Howard, issued 1928; the symmetric bowtie disclosed in U.S. Pat. No. 1,737,072 of Blach, issued 1929; adjustable neckbands such as disclosed in U.S. Pat. Nos. 2,045,279 and 2,045,280 of Mayer, both issued 1936; decorative additions such as disclosed in U.S. Pat. No. 7,322,049 of Kennedy, issued 2006; and a multitude of preformed ties that allow the wearer to avoid learning how to tie a tie, including those disclosed in: U.S. Pat. No. 1,457,559 of Stonge, issued 1923, U.S. Pat. No. 1,540,037 of Smith, issued 1925, U.S. Pat. No. 2,061,630 of Keys, issued 1936, U.S. Pat. No. 3,034,134 of Peterson, issued 1962, U.S. Pat. No. 4,777,665 of Akamatsu, issued 1986, U.S. Pat. No. 4,856,115 of Knapp, issued 1989, U.S. Pat. No. 5,048,127 of Yang, issued 1990, U.S. Pat. No. 5,088,120 of Yen, issued 1991, 5,361,413 of Schaefer, issued 1991, U.S. Pat. No. 5,600,851 of McLeod, issued 1995, U.S. Pat. No. 5,600,852 of Densch, issued 1997, and U.S. Pat. No. 6,691,319 of Simon, issued 2004. Other than Langsdorf's innovations, these improvements have tended to focus on decorations and labor or time saving designs for neckties and bowties, perhaps at the expense of elegance. The scarf with a twist disclosed in U.S. Pat. No. 5,867,835 to Dabbieri (1999) which employs a "continuous circle of tubular fabric" (col. 2, line 21) with a 180-degree (col. 4, line 25) or 360-degree twist (col. 4, line 9) and specifies at col. 2, line 28, "A narrow neckband portion is then formed by accordion pleating and folding," even emphasizes at col. 1, line 8, a scarf "that does not require any tying and/or closure manipulations whatsoever".

Continued interest in new fashions and intriguing apparel creates a demand for innovation to provide flair and style in neck ties for business, formal, and service dress wear. Innovation in product design and appearance drives market trends, as evidenced in the fashion industry. There is always interest in new and intriguing apparel. Specifically, to generate higher demand for fashionable neck wear, it is beneficial to introduce new styles for neck ties in business, formal, and service dress.

SUMMARY OF THE INVENTION

In one series of embodiments an endless neck tie includes a strip of fabric of varying width formed as an endless loop having first and second sections. The width is measurable in one or more directions transverse to directions of endless travel along the strip of fabric. The first section has first and second end portions, and corresponds to a neckband when the endless loop is configured as a wearable neck tie. The first section has a narrow width at a position between opposing end portions thereof. The second section has first and second end portions. The first end portion of the second section extends toward the first end portion of the first section, and the second end portion of the second section extends toward the second end portion of the first section. The second section includes a blade portion having a wide width relative to the narrow width of the first section with which at least a first blade and a second blade of the wearable neck tie can be configured for presentation. The endless neck tie includes a first transition region and a second transition region along the first and second sections, the first transition region being about the first end portion of the first section and about the first end portion of the second section, and the second transition region being about the second end portion of the first section and about the second end portion of the second section. The first end portion of the first section and the first end portion of the second section have first variable positions definable along the first transition region by how the endless loop is configured about a neck as a neck tie. The second end portion of the first section and the second end portion of the second section have second variable positions definable along the second transition region by how the endless loop is configured about the neck as a neck tie. In one series of embodiments, when the endless loop is shaped as a circle, the position of the blade portion having the wide width along the strip of fabric is diametrically opposed to a position along the first section having the narrow width. The second section of the endless loop may include a first portion and a second portion each having a width wider than the narrow width of the first section so that, when the endless loop is configured as a wearable neck tie, the first blade is formed with the first portion of the second section and the second blade is formed with the second portion of the second section, and the first blade and the second blade each include a portion wider than a portion of the relatively narrow first section which forms the neck band. The strip of fabric formed as an endless loop may include a twist of 180 degrees which transforms the endless loop of fabric into a Mobius strip or may include a twist which is an integer multiple of 180 degrees.

According to another series of embodiments, an endless bow tie includes a strip of fabric of varying width formed as an endless loop for configuration as a wearable bow tie. The width is measurable in one or more directions transverse to directions of endless travel along the strip of fabric. The endless loop includes first and second variably definable sections. The first section has first and second end portions and corresponds to a neckband when the endless loop is configured as a wearable bow tie. The first section has a narrow width, Wn, at a position between opposing end portions thereof. The second section has first and second end portions, with the first end portion of the second section extending toward the first end portion of the first section, and the second end portion of the second section extending toward the second end portion of the first section. The second section includes a blade portion having a wide width, Ww, relative to the narrow width of the first section with which at least a first blade and a second blade of the wearable bow tie can be configured for presentation. The blade portion also includes a bridge region connecting the first blade and the second blade, the bridge having a width, Wb, narrower than the wide width of the blade portion. The bridge region demarcates the first blade from the second blade.

A bow tie shaped ornament is also provided. In one embodiment the ornament includes a generally elongate strip of material formed as an endless loop which is configured to define a neck band, at least first and second blades extending away from the neckband, and an outer knot positioned to demarcate a transition between the neck band and the blades.

A method is also provided for configuring an endless neck tie about a neck.

According to one embodiment, a generally elongate length of fabric is provided in the form of an endless strip. A first segment and a second segment are defined along the endless strip by placing the endless strip around the neck and extending each segment along a different side of the neck and in front of the neck. The first segment and the second segment of the endless strip are brought adjacent one another or one over the other or otherwise in contact with one another in front of the neck. At least a first knot is formed proximal the front of the neck with a first sub-segment of the first segment and a first sub-segment of the second segment. A second sub-segment of each segment of the endless strip is positioned about the neck with each second sub-segment connected to the other second sub-segment near the nape of the neck. The two second sub-segments form a continuous neckband due to the continuous nature of the endless strip. A third sub-segment of each segment, corresponding to one or more blades, is extended away from the first knot, with each third sub-segment connected to the other third sub-segment. Portions of each segment are arranged to configure an endless neck tie such as an endless plumb neck tie or an endless bow tie.

According to another series of embodiments a method is provided for forming an endless tube by providing a first elongate strip of fabric and a second elongate strip of fabric, each strip having (i) a pair of opposing major edges extending along a first direction between first and second opposing strip ends, and (ii) a presentation side and a reverse side facing away from one another. The first and second strips of fabric are joined together by positioning the presentation side of each strip to face the presentation side of the other strip, with each major edge in one strip against a major edge in the other strip, to form the fabric into a tube shape. A pair of adjoining ends may be left unstitched to provide an open first tube end opposite a second tube end. According to one embodiment, the second tube end is extended through the open first tube end to turn the fabric tube to position the presentation sides of the first and second strips of fabric facing away from one another. The first and second opposing tube ends are joined to configure an endless tube.

A method is also provided for forming a bow tie with blades and without tabs, by providing a strip of material, and forming the strip into an endless loop. When the endless loop is tied into a bow tie, the bow tie has at least two blades and no tabs. In other embodiments, a bow tie comprises a strip of material in the form of an endless loop tied into a bow tie having at least two blades without any tabs.

A strap length adjustment system is also provided. In one embodiment, a first slide and a second slide each have a first channel and a second channel, each slide having first, second and third adjoining ribs, with the second rib positioned between the first rib and the third rib so that the first and second ribs define the first channel and the second and third ribs define the second channel. An end of a strap or an endless portion of a strap extends through the first channel of the first slide, then through the second channel of the first slide, then through the first channel of the second slide, then through the second channel of the second slide, then through the second channel of the first slide, then through the first channel of the first slide, then through the second channel of the second slide, and then through the first channel of the second slide.

A strap adjustment hardware slide according to an embodiment of the invention includes a first open channel and a second open channel, a first rib, a second rib, and a third rib. The first and second ribs define the first channel and the second and third ribs define the second channel. The first rib includes a first gaff spaced from the second rib to provide an opening into the first channel and the third rib includes a second gaff spaced from the second rib to provide an opening into the second channel. The second rib is connected with the first rib via a first slide neck, and the second rib is connected with the third rib via a second slide neck. A method for adjusting a strap length includes providing a first slide and a second slide, each slide having first, second and third adjoining ribs, the second rib positioned between the first rib and the third rib so that the first and second ribs define a first channel and the second and third ribs define a second channel. Either an end of a strap or an endless portion of a strap is passed into the first channel of the first slide, then through the second channel of the first slide, then through the first channel of the second slide, then through the second channel of the second slide, then through the second channel of the first slide, then through the first channel of the first slide, then through the second channel of the second slide, and then through the first channel of the second slide.

According to another series of embodiments, a neck tie comprises a strip of material of varying width having first and second opposing ends connectable to one another to form an endless loop. The endless loop includes a neckband portion and a blade region portion. The neckband portion includes the connectable first and second opposing ends, having along part of its length a relatively narrow width suitable for placement about a neck. The blade region has a wide width relative to the narrow width of the neckband portion with which first and second blades are configurable. The blade region includes a juncture region along which the first and second blades are demarcated when the first and second blades are configured. The neckband portion includes an adjustment mechanism which variably overlaps part of the neckband portion with itself to adjust the length of the endless loop.

In yet another series of embodiments, a neck tie includes a strip of material of varying width having first and second opposing ends connected to one another to form an endless loop. The endless loop includes a neckband portion and a blade region. The neckband portion includes the connected first and second opposing ends, having along part of its length a relatively narrow width suitable for placement about a neck. The blade region has a wide width relative to the narrow width of the neckband portion with which first and second blades are configurable. The blade region includes a juncture region along which the first and second blades are demarcated when the first and second blades are configured. The strip includes a first flexible member extending toward the blade region and an adjustment mechanism comprising a second flexible member along part of the neckband portion, parts of which can be selectively included in the endless loop to adjust the length of the endless loop.

BRIEF DESCRIPTION OF THE DRAWINGS

These and other features of the present invention will become better understood when the following detailed description is read with reference to the accompanying drawings in which like characters represent like parts throughout, wherein:

FIG. 11A through 11C, 11F, and 11G are front perspective views, and FIGS. 11D and 11E are schematic knot diagrams viewed from above;

FIGS. 12A through 121, 12K, and 12L are front perspective views, and FIG. 12J is a schematic knot diagram viewed from above;

FIGS. 13A through 131, 13K, and 13L are front perspective views, and FIG. 13J is a schematic knot diagram viewed from above;

FIGS. 14A through 14C, 14F, and 14G are front perspective views, and FIGS. 14D and 14E are schematic knot diagrams viewed from above;

FIGS. 15A through 151 and 15K are front perspective views, and FIG. 15J is a schematic knot diagram viewed from above;

FIGS. 16A through 161 and FIG. 16K are front perspective views, and FIG. 16J is a schematic knot diagram viewed from above;

FIGS. 17A through 171 and FIG. 17K are front perspective views, and FIG. 17J is a schematic knot diagram viewed from above;

FIGS. 20A and 20B are, respectively, a top view in cross-section and an unrolled view of a prior art one-sided bow tie;

FIG. 20C is a top schematic view in cross-section of an endless bow tie or Mobius bow tie according to an embodiment of the invention;

FIG. 20D is an unrolled view of an endless untwisted loop or Mobius loop of varying width customized for a bow tie of FIG. 20C;

FIGS. 20E and 20F are, respectively, a top view in cross-section and an unrolled view of a prior art ended bow tie;

FIG. 20G is a top schematic view in cross-section of an endless untwisted double bow tie or Mobius double bow tie according to an embodiment of the invention;

FIG. 20H is an unrolled view of an endless untwisted loop or Mobius loop of varying width customized for the double bow tie of FIG. 20G;

FIGS. 30A and 30B illustrate prior art hardware which may be used in a novel neckband adjustment arrangement shown in FIG. 29, and FIGS. 30C and 30D illustrate slide hardware according to embodiments of the invention, which may also be used in the novel neckband adjustment arrangement shown in FIG. 29; FIG. 31A is a perspective front view of the neckband or strap; and FIGS. 3 IB and 31C are views in cross-section of a neckband or strap taken along a horizontal plane, showing a method of providing length adjustment using slide hardware shown in FIGS. 30A through 30D.

Figure 1A:
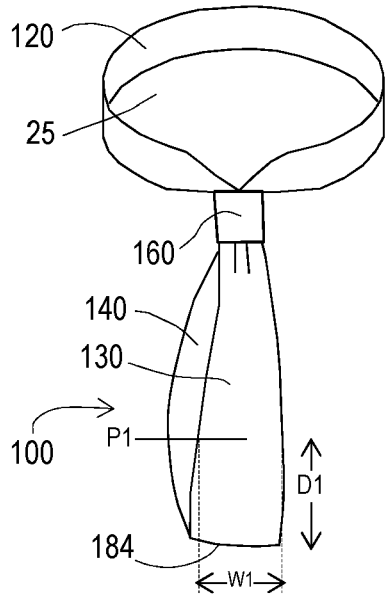
FIGS. 1A and 1B are, respectively, perspective front and rear views illustrating features of an endless plumb neck tie according to an embodiment of the invention.

The drawings include standard drafting symbol patterns for representing color. The colors of the invention are not limited to those specifically indicated in the drawings. The exemplary color shading does not require color differentiation by. In accordance with common practice, the various described features are not necessarily drawn to scale, and may be drawn to emphasize specific features relevant to the invention.

DETAILED DESCRIPTION

The "Mobius Strip", discovered by mathematician August Ferdinand Mobius (1790-1868), is a flat loop with a 180-degree twist. A Mobius strip (also known as a Mobius loop) can be made with a strip of material having two ends by twisting one end of the strip 180 degrees and attaching it to the other end of the strip. The Mobius strip is known for having a single surface and a single edge.

A study of various means of tying ended neckties and bowties led the inventor to study the class of tie knots using two successive overhand knots, such as the square knot of the bow tie. An abiding interest in the Mobius strip led the inventor to develop and experiment with a bowtie topology conforming to the Mobius strip. In embodiments comprising two contrasting fabrics, the inventor found that the two fabrics of differing color could be arranged to alternate colors from the first side of the neck band, to the first blade, to a first color of the knot, to a second color of the knot, to the second blade, and to the second side of the neck band.

Extending the study to plumb neckties led to an endless plumb necktie formed with a closed loop of fabric configured with one or more knots. Some embodiments of these endless plumb neckties feature knots only at the neckband, while others employ multiple knots affecting tie blade shape behind and near the bottom of the plumb necktie blade. Other shapes similar to those of a plumb necktie have been created by modifying traditional tie tying methods to take advantage of the closed nature of the endless or Mobius loop, for instance embodiments described herein of an endless plumb neck tie tied in a manner similar to the four-in-hand method of tying an ended plumb neck tie, or embodiments described herein of an endless bow tie tied in a manner similar to the square knot method of tying an ended bow tie. As used herein, the terms "neck tie" and "necktie" refer interchangeably to wearable neckwear including neck ties of traditional vertical configuration sometimes referred to as "four-in-hand" or "Langsdorf" or "standard" ties and herein called "plumb" neckties or "plumb" ties; and neck ties of bow tie horizontal configuration, unless otherwise specified or made clear from the context in which the term is used. The term "neckties and bowties" is used herein as an inclusive term (necktie) and a specific term (bowtie). Similarly, the term "endless" with regard to plumb neckties and bow ties refers to untwisted, Mobius, and other twisted embodiments of endless strips or loops, unless otherwise specified or made clear from the context in which the term is used. The term "ended" with regard to plumb neckties and bow ties refers to neck ties which are not endless. Prior art ended neck ties have ends which are referred to as tips, tabs, blade points, aprons, tails or, simply, ends.

"Twist" refers to a rotation transverse to the direction of endless travel along an endless loop, or transverse to the long dimension of a strip of fabric. Unless specified otherwise, "twist" refers to a "Mobius twist", i.e. a 180-degree transverse rotation.

To facilitate understanding of the written description with respect to the drawings, although not limited to such, the term vertical can be regarded as the direction that extends downward or upward with respect to a ground plane, and the term horizontal refers to a direction that extends parallel with the ground plane.

Features of embodiments of my endless plumb necktie and endless bowtie include novel topologies and novel constructions relative to providing distinct and fashionable neck garb. Embodiments of the endless plumb necktie and endless bowtie provide added advantages of not slipping off the neck as conventional ended neckties and bowties sometimes do, and of having no ends to accidently slip through while tying. The endless and Mobius plumb neckties and bowties provide the advantage over pre-formed neckties and bowties of providing elegance, in fact, of providing mathematical elegance.

The mathematical concept of the Mobius strip is embodied in an endless plumb necktie or in an endless bow tie formed with a twisted endless loop made from a piece, a length, or a tube of material, referred to respectively as a Mobius plumb necktie or a Mobius bow tie.

An embodiment of an endless plumb neck tie comprises a strip of fabric joined at opposing ends to form an endless loop and folded to define a neck band comprising an elongate length of fabric, one or more blades, and at least one knot for encircling and constricting a region between the neck band and the blades. The term "strip" may refer to an elongate tube or length of fabric.

The term "neck" refers to any structure about which a neckband may be positioned, or, at least for purposes of illustration, a space about which such a structure may be placed, e.g., about which the neckband may be positioned. Exemplary structures include, but are not limited to, a human neck, a living creature neck, a mannequin neck, a collar, an animal collar, a wrist, a post, a pinback, a fastener, about which any neck band may be positioned, e.g., any of the neck bands 120, 220, 320, or 420. The exact nature of the neck or space is not limiting of the scope of the present invention. The term "nape" refers to the back of the neck. When the neck is shown as a space, the nape refers to a region of the space which would coincide with a nape if a neck were positioned in the space. The necktie is generally tied, the blades are pulled taut, and the necktie is arranged and straightened ("dressed") at the front of the neck, a location on the neck opposite the region corresponding to the nape.

The term "neckband" refers to a ribbon-like element, i.e. a generally elongate strip, which is a segment or a section of an endless loop from which a necktie is formed. The neckband provides a means of positioning the necktie by encircling a relatively narrow region of a body, typically a neck. The exemplary embodiments illustrate neckbands as having relatively narrow widths compared to other portions of the endless loop, e.g., relatively wide blades of a plumb endless necktie. In many applications the neckband of a dressed tie is largely concealed by a collar and often need not be decorative since it is hidden from view.

Descriptions of the endless necktie and associated methods of manufacture or use are based on endless loops. Endless loops may be endless strips or endless tubes of material, e.g., fabric configurable as a wearable neck tie. A quantity of fabric, or other material, may be referred to as a length, as a piece, as a strip, or as a tube of fabric or material. A generally elongate strip of fabric has a relatively small width between two opposing "edges" along a direction in which a relatively large length extends, and also has two ends transverse to the direction in which the length extends. The terms "length of fabric" and "piece of fabric" both refer to a quantity of fabric having a relatively small width transverse to the direction in which a relatively large length extends. Referring to a quantity of fabric as a "piece of fabric" implies that the quantity of fabric may be a portion of a larger quantity of fabric, although that is not always the case, e.g., small hand-woven "pieces". A piece of fabric has two opposing sides: normally a first side identified as the presentation side, i.e., the side intended to present upon completion of the necktie; and a second side identified as the reverse side, e.g., a side intended to face the interior of the fabric tube. Such a tube of fabric (or "fabric tube") results from stitching two pieces of fabric together along two opposite edges while leaving two opposing ends not stitched. See, for example, FIGS. 19 and 21 wherein two pieces of fabric are stitched with presentation sides together. An endless fabric tube results from stitching together the two opposing ends of a fabric tube, such as illustrated in FIG. 23. An endless fabric tube has a direction of endless travel which corresponds to the direction along which the length of fabric extends.

Portions of endless loops or tubes may be referred to as elements, regions, segments or sections. Segment and section demarcation may be arbitrary, e.g., resulting from how transitions between two adjoining portions in the endless loop (e.g., between a neck band and a blade portion) are defined as a tie is configured. Exemplary transition regions 179 in FIG. 7H may demarcate a transition between segments or sections at segment or section boundary regions, also referred to as "end regions", and these transition regions are generally illustrated as transverse or perpendicular to a direction of endless travel along the loop. In FIG. 7H, variable end regions 172 are shown for an exemplary blade section 170, and variable end regions 178 are shown for an exemplary neckband section 724. In one embodiment, the end regions 172, 178 are part of a transition region 179 variably positioned between a neckband section 724 and a section 170 corresponding to one pair of blades in a plumb neck tie. The example blade section 170 has four boundaries, i.e., the two end regions 172 which vary in location along the section 170, and two opposing edge portions 174 which correspond to portions of the opposing edge portions in an endless loop of fabric and which terminate at the end regions 172. A direction 176 of endless travel along the loop is shown in a direction which would traverse the end regions 172, 178. Summarily, FIG. 7H illustrates a first section 724 of an endless plumb neck tie 100 corresponding to a neck band 120 having opposing end regions 178 which vary in location along the first section, and a second section 170 of an endless plumb neck tie 100 corresponding to a pair of blades 130, 140, i.e., a blade portion having variable opposing end regions 172. The endless neck tie includes a first transition region 179 and a second transition region 179 along the first and second sections, the first transition region 179 being about a first end portion 172 of the first section and about the first end portion 178 of the second section, and the second transition region 179 being about a second end portion 172 of the first section and about the second end portion 178 of the second section. Dashed lines are shown to indicate transitions 179 between end regions 172 and 178 of the adjoining neck band section and blade region section. It is to be understood that the locations of transitions 179 vary because the end regions 172 and 178 are variable for reasons now noted, e.g., depending, in part, on how much of the length of the endless loop is allotted to the blade pair section. From the foregoing description the term "transition" or "transition region" refers to an area where regions meet, and which may comprise, for example, portions of one or both end regions 172 and 178 of the regions which meet.

Those familiar with configuring ended neck ties will appreciate that neckbands and blade sections normally do not have fixed or predefined ends and, generally, do not have invariable lengths. Reference to a section or segment does not and should not connote portions having fixed or predefined ends. Neckbands and blade sections of endless neck ties have variable lengths so that someone configuring a neck tie has discretion to vary the length of the blade section and the neckband. Generally, the neckband length may vary depending on the neck size of the person wearing the apparel and the desired fit. For both plumb ties and bow ties, one blade section may be longer than the other by a discretionary amount to provide a desired appearance. The section or segment "end regions" thus are variable, while the terminology is necessary to describe divisions of the loop and the juxtaposition of various contiguous divisions of the loop.

The terms "blade" refers to each of one or more segments or sections in an endless loop from which a necktie is formed. For the embodiments corresponding to FIGS. 1 and 2, the blades of a dressed plumb necktie normally extend vertically downward from the front of the neck. For endless and Mobius bow tie embodiments such as illustrated in FIGS. 3A, 4A, 5C, 11G, 12L, 13L, 14G, 15K, 16K, and 17K, the blades of a dressed tie normally extend horizontally along the front of the neck and away from an inside knot or an outside knot. Disclosed embodiments illustrate blades as wide expanses of fabric in an endless loop, relative to the width of an adjoining neckband. The term width refers to a neckband width, segment width, section width, or varying loop width. The terms wide and narrow are relative terms which refer generally to the dimension of the loop in the local plane of the loop transverse to a direction of endless travel along the loop. The blade is usually relatively wide, decorative, and nonfunctional other than stabilizing the knot or knots. The blade may be made from attractive, eye-catching, luxurious, or otherwise ornamental fabric. While the blades of a bow tie are conventionally referred to as "wings", and the endless and Mobius bow tie blades may be referred to as "wings", here the terms "blade" and "blades" are used with respect to the larger class of neckwear which includes the conventional ended plumb neck tie, bow tie and ascot, as well as the endless and Mobius plumb neckties and bow ties described herein. So, the set of all necktie blades includes the set of all bow tie wings.

The term "knot" refers to an element of a configured necktie which encircles and constricts a region of the necktie. In many embodiments the knot is made by crossing, tying or intertwining blades at a relatively narrow region of the necktie. The knot is usually both functional and decorative, and in many embodiments, the knot presents the same attractive, eye-catching, luxurious, or otherwise ornamental fabric as the blade or blades. An example of a knot is an outside knot that presents between a neck band and the tied blades. Formation of a knot often slightly folds or "dimples" the blade fabric adjacent the outside knot in plumb neckties and bow ties and embodiments of neckties formed with endless loops as illustrated in the figures. The dimple is the intentionally wrinkled region of a blade adjacent a knot resulting from constriction of the blade by the knot. Another example of a knot is an inside knot which may serve the purpose of securing the position of a neckband so an outside knot may be tied, resulting in the outside knot presenting, while the inside knot may be hidden behind the outside knot.

Prior art ended neckties of both the plumb and bow tie varieties may be made with a strip of material having two longer edges and two shorter ends. Ended bow tie blade ends are often referred to as "tabs". The ends of an ended neck tie are often referred to as "aprons". Thus the terms end, tab, and apron all may refer to an end or terminus region of a conventional ended plumb necktie or conventional ended bow tie made with a generally narrow strip. A feature which distinguishes endless or Mobius neck ties of this invention from a prior art ended plumb necktie or a prior art ended bow tie is the absence of ends in the sense that endless neckties do not have edges defining segment or section lengths but, instead, are continuous and unending loops. According to embodiments of the invention, one method of construction for an endless loop or Mobius loop of fabric from a tube of fabric, as illustrated in FIGS. 18, 19, 20, 21, and 23, provides staggered tube ends seamed to join opposing tube ends, resulting in an endless loop or Mobius loop The tube ends are intermediate, ephemeral features in the construction process and, while the seams persist in the finished necktie, the tube ends are not essential fabrication features of the fabric endless loop and are not functional components of the resulting tie.

FIG. 23 are perspective views of fabric strips stitched into tube shapes. The figures illustrate a sequence of steps by which opposing tube ends are joined to form an endless loop, with staggered widthwise ends, according to embodiments of the invention.

The term "bight" refers to a bend in a strip or loop of fabric formed without crossing one part of the strip or loop over another. The term "bight" is used herein to describe such a strip of fabric which has been bent or otherwise configured into a shape which defines a space partly bordered by the strip of fabric, the space referred to as a "bight opening" through which another part of the strip or loop of fabric may be passed.

The term "loop", when referring to an endless loop or Mobius loop, is an embodiment of a shape that is circular or curved over on itself, respectively without or with a 180-degree twist. The terms "Mobius strip" and "Mobius loop" are interchangeable. Herein a loop is endless, whereas a strip may refer to a loop, e.g., a "Mobius strip" or a flat piece of fabric having two opposed ends. So, an endless loop may be made with a strip of material, having a first end and a second end, by attaching the first end of the strip to the second end of the strip. And, a Mobius loop may be made with a strip of material having a first end and a second end by twisting the first end of the strip 180 degrees and attaching it to the second end of the strip.

The term "loop" may be used as in common knot terminology, in which case a loop is a linear element such as a segment, section, blade, dual blade segment, or strip, which is folded or doubled upon itself so as to leave an opening. An "overhand loop" is created when a linear element is passed over an adjacent linear element, e.g., as described in the overhand knot method of tying illustrated in FIG. 7 and particularly in FIGS. 7E and 7F. The configured endless double bow tie 600 of FIG. 5A includes front loops 338, 348 and back loops 336, 346. Thus the terms "simple loop method", "overhand loop", "underhand loop", "blade loop", "front loop", and "back loop" clearly refer to common knot terminology, distinct from the terms "endless loop" and "Mobius loop"; the terms are distinguished by use of adjectives and by context. When used as a verb, "loop" refers to common knot terminology, as to fold or double a linear element upon itself so as to leave an opening.

The terms "tie" or "fold", when used as verbs, refer to manipulating a strip or loop of fabric to create a pattern or shape by, for example, bending, overlapping, intertwining or knotting. The term "manipulate" means to handle, control, or maneuver. The term "tie", when used as a verb, may refer to a sequence of steps which configure a strip or loop of fabric into a dressed necktie and, in particular, the term "tying" may used to describe forming or configuring an endless neck tie.

The term "staggered" refers to an arrangement of seams on adjacent fabrics such that the seams are not overlapped along their entire lengths, for purposes of minimizing the overall thickness or "bulk" of the necktie. Staggered seams inside of a neckband help reduce lumpy seams that might occur from adjacent fabrics stacked atop each other.

The terms "neck tie" and "necktie" are used interchangeably. The terms "bow tie" and "bowtie" are used interchangeably. The terms "Mobius strip" and "Mobius loop" are used interchangeably. The terms "neck band" and "neckband" are used interchangeably. The term "neck tie" refers both to plumb neck ties of traditional vertical configuration and to neck ties of bow tie horizontal configuration, unless otherwise specified or made clear from the context in which the term is used.

Figure 1B:
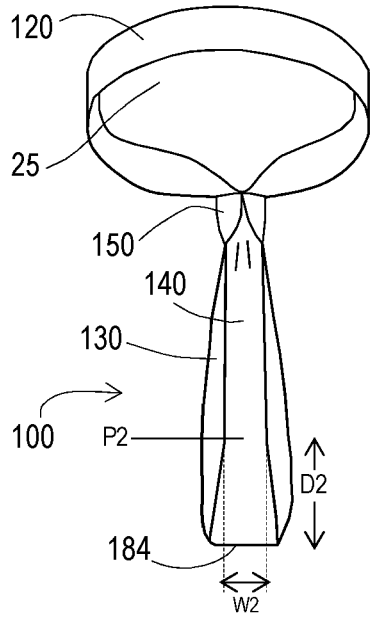

FIG. 1 illustrate an embodiment of an endless plumb neck tie 100 configured from an endless loop 110 (as shown elsewhere including FIG. 7A) as it would be worn about a neck 25 (not shown). A front view of the configured endless plumb tie is illustrated in FIG. 1A and a back/rear view of the configured endless plumb tie is shown in FIG. IB. FIGS. 7, 8, and 9 each illustrate one of three different sequences for configuring the endless plumb neck tie 100 about a neck 25, each sequence resulting in a different embodiment of an endless neck tie 100 configured with an endless loop 110.

The configured endless plumb neck tie 100 of FIG. 1 includes a neck band 120, as it would be worn about a neck 25 (not shown), a first blade 130, a second blade 140, and an outside knot 160. In some embodiments, the configured endless plumb neck tie 100 may also include an inside knot 150. The outside knot 160 is shown in FIG. 1A where it constricts the juncture of the neck band 120 and first blade 130. An inside knot 150 is shown in FIG. IB where it constricts the juncture of the neck band 120, first blade 130, and second blade 140. FIGS. 1A and IB illustrate an embodiment which includes a juncture fold 184 corresponding to a transition between the first blade 130 and the second blade 140. At a first position, PI, along the first blade 130, a measurable first distance, D1, from the juncture fold 184, the first blade 130 includes a first width, W1, which is wider than a second width, W2, of the second blade 140 at a second position, P2, along the second blade, a measurable second distance, D2, from the juncture fold 184, where the first distance D1 and the second distance D2 are equal distances. The rate at which the first blade 130 tapers as a function of distance from the juncture fold 184 is less than the rate at which the second blade 140 tapers as a function of distance from the juncture fold 184.

Figure 7A:
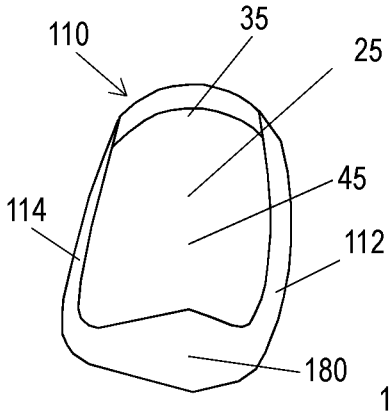
FIGS. 7A through 7G are front perspective views of a sequence of steps according to an overhand method to tie an endless plumb neck tie according to embodiments of the invention, with FIG. 7H further illustrating features of first and second sections of an endless loop shown in FIG. 7B.
Figure 7B:
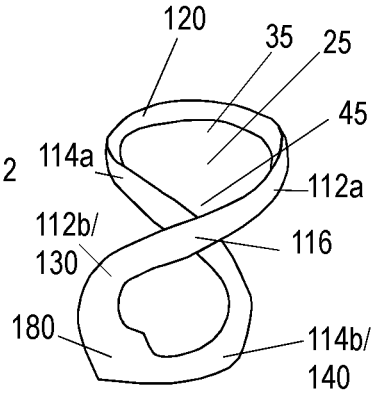
Figure 7C:
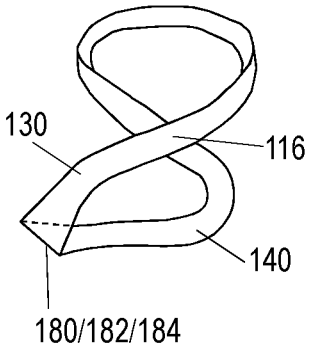
Figure 7D:
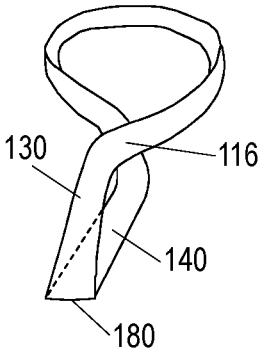
Figure 7E:
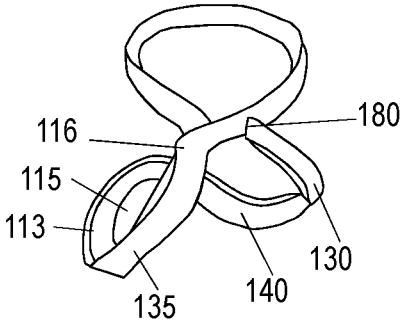
Figure 7F:
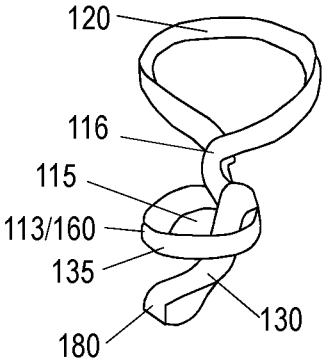
Figure 7G:
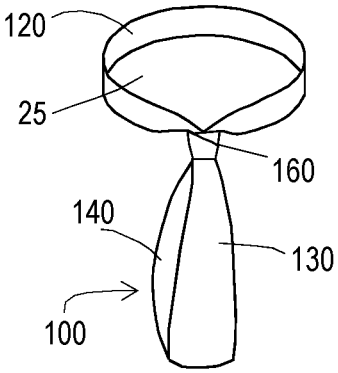
Figure 7H:
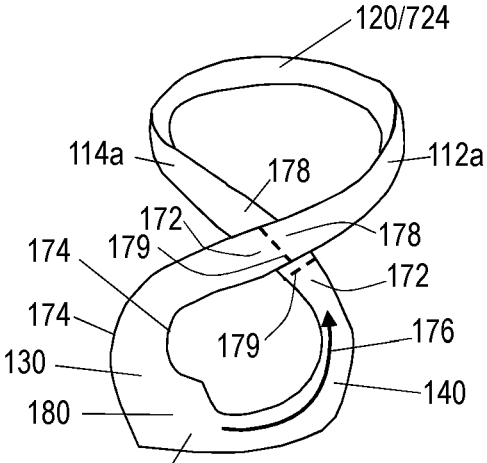
Figure 8A:
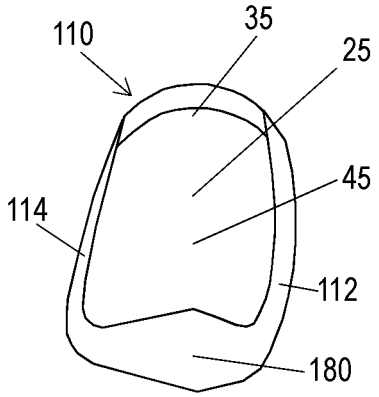
FIGS. 8A through 8I are front perspective views of a sequence of steps according to a simple loop method to tie an endless plumb neck tie according to embodiments of the invention.
Figure 8B:
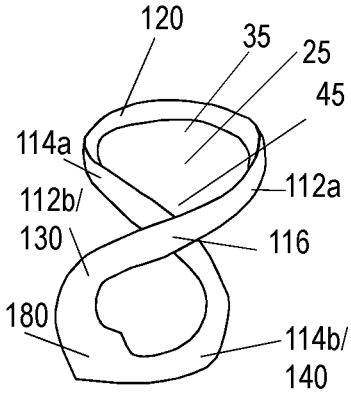
Figure 8C:
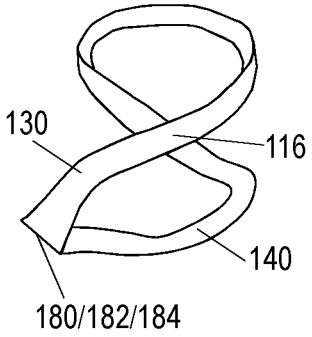
Figure 8D:
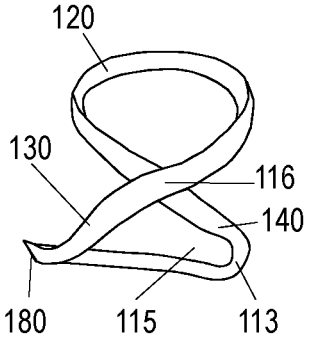
Figure 8E:
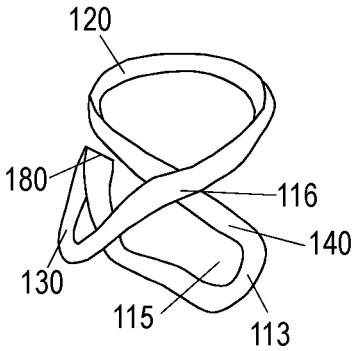
Figure 8F:
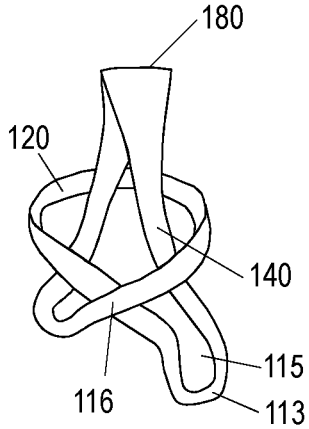
Figure 8G:
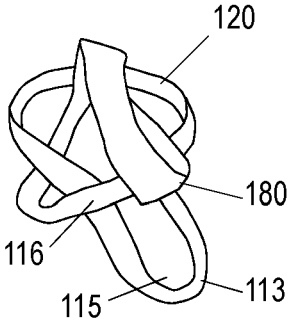
Figure 8H:
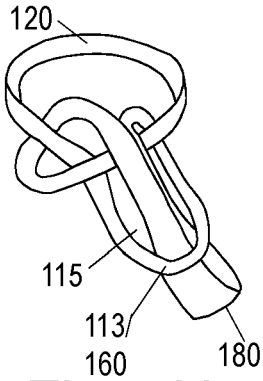
Figure 8I:
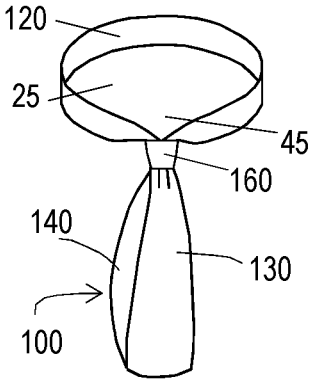
Figure 9A:
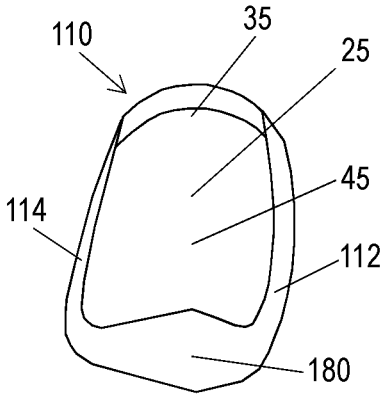
FIGS. 9A through 9F are front perspective views of a sequence of steps according to a four-in-hand method to tie an endless plumb neck tie according to embodiments of the invention.
Figure 9B:
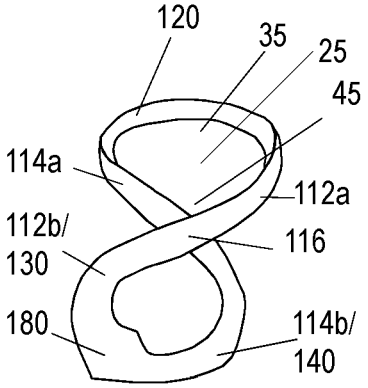
Figure 9C:
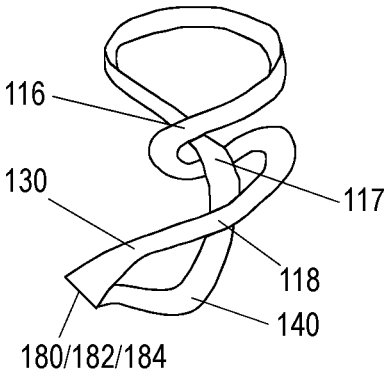
Figure 9D:
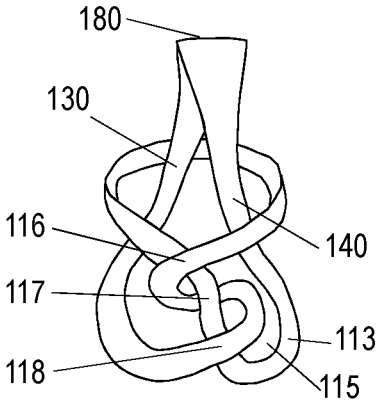
Figure 9E:
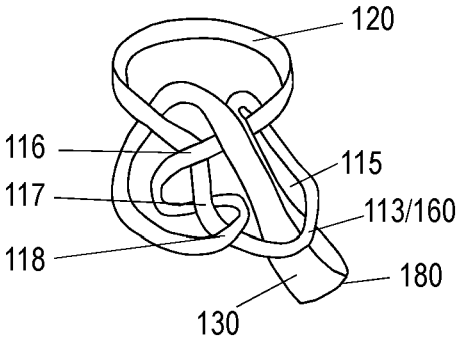
Figure 9F:
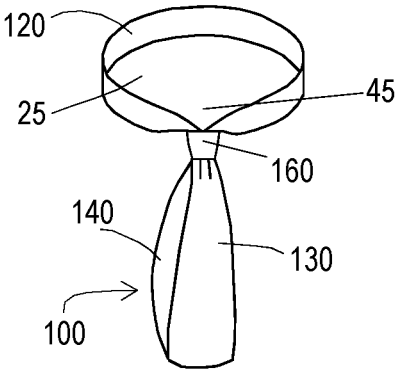

As shown in FIGS. 7A, 8A, and 9A, each of three sequences of steps, by which an endless loop 110 is configured as it would be worn about a neck 25 (not shown) to form the endless plumb neck tie 100, begins with placing an endless loop 110 about a neck 25 to define, with respect to the nape 35 of the neck 25, a first segment 112 and a second segment 114 of the endless loop 110. The segments 112, 114 each extend to an opposing side of the nape 35 and along different sides of the neck 25. The first segment 112 and the second segment 114 of the endless loop extend from the nape 35 forward to contiguously meet one another at a juncture region 180 (shown in FIGS. 7A, 8A, and 9A positioned below the front 45 of the neck 25) due to the continuous nature of the endless loop. As shown in FIGS. 7B, 8B, and 9B, the first segment 112 is then crossed over the second segment 114 to create a first crossover 116 to define the neckband 120, comprising the first portion 112*a* of the first segment 112 from the front 45 of the neck to the nape 35 and the contiguous first portion 114*a* of the second segment 114 from the nape 35 to the front 45 of the neck. The first blade 130 includes the second portion 112*b* of the first segment 112 extending from the front 45 of the neck to the juncture region 180. The second blade 140 includes the second portion 114*b* of the second segment 114 extending from the front 45 of the neck to the juncture region 180.

FIG. 7 illustrate the "overhand" method of tying an endless plumb neck tie. As shown in FIG. 7B, the first blade 130 is crossed over the second blade 140 at a crossover 116. As shown in FIG. 7C, a fold line 182 is made at the juncture region 180, and a juncture fold 184 is made at fold line 182. The fold line defines a transition between the first blade 130 and the second blade 140. The fold line may be predefined in the endless loop 110 by, for example, thermal pressing or defining a line with a pattern of stitching. As shown in FIG. 7D, the first blade 130 is brought near the second blade 140 along and near the juncture region 180. Noting that the blades as shown in FIG. 7D are not drawn to scale, FIG. 7E illustrates the same blades 130, 140 lengthened to a scale suitable for illustrating several tying steps. The first blade 130 and the second blade 140 are brought into contact with one overlapping the other, followed by smoothing the blades together to create a dual blade segment 135, which extends from the crossover 116 to the juncture region 180. As also shown in FIG. 7E, a bight 113 is formed by bending the dual blade segment 135 into a curved shape, thereby creating bight opening 115. The juncture region 180, as shown in FIG. 7E, is then positioned above the bight 113 and the crossover 116, in order to next pass the juncture region 180 through the bight opening 115. As shown in FIG. 7F, the juncture 180 is then passed or pulled through the bight opening 115 to fashion an outside knot 160 for the tie 100, shown tightened in FIG. 7G. That is, by pulling and extending the dual blade segment 135 vertically downward at the same time as controlling bight 113 to be proximal crossover 116, the size of the bight opening 115 is reduced, and through tightening, bight 113 becomes outside knot 160. Also, the action of pulling the dual blade segment 135 downward positions the bight 113 proximal the front 45 of the neck 25 so that with further pulling the outside knot 160 of the tie 100 is situated at the front 45 of the neck 25. See, also, the illustrations of FIG. 1. The first blade 130, the second blade 140, and the outside knot 160 are then dressed. In this example, the resulting endless plumb neck tie 100 approximates the look of an ended plumb neck tie.

FIG. 8 illustrate the "simple loop" method of tying an endless plumb neck tie. As shown in FIG. 8B, the first blade 130 is crossed over the second blade 140 at crossover 116. As shown in FIG. 8C, a fold line 182 is made at the juncture 180, as described for the "overhand" method and shown in FIG. 7C, and a fold 184 is made at fold line 182. The fold line defines a transition between the first blade 130 and the second blade 140. The fold line may be predefined in the endless loop 110 by, for example, thermal pressing or defining a line with a pattern of stitching. As shown in FIG. 8D, the first blade 130 is brought near the second blade 140 along and near the juncture 180. Noting that the blades as shown in FIG. 8D are not drawn to scale, FIG. 8E illustrates the same blades 130, 140 lengthened to a scale suitable for illustrating several tying steps. As shown in FIGS. 8E, 8F, and 8G, the juncture 180 is pulled under the neckband 120 and then upward, inside then over the neckband 120, and then above and past the crossover 116. This pulling configures a portion of the second blade 140 into a bight 113, and creates bight opening 115. With continued pulling, the juncture region 180 is passed or pulled through the bight opening 115, as shown in FIGS. 8G and 8H, to fashion an outside knot 160 for the tie 100, shown tightened in FIG. 81. That is, by pulling and extending juncture region 180 vertically downward at the same time as controlling bight 113 to be proximal crossover 116, the size of the bight opening 115 is reduced, and through tightening, bight 113 becomes outside knot 160. Also, the action of pulling the juncture region 180 downward positions the bight 113 proximal the front 45 of the neck 25 so that with further pulling the outside knot 160 of the tie 100 is situated at the front 45 of the neck 25. See, also, the illustrations of FIG. 1. The first blade 130, the second blade 140, and the outside knot 160 are then dressed. In this example, the resulting endless plumb neck tie 100 of FIG. 81 approximates the look of an ended plumb neck tie.

FIG. 9 illustrate the "four-in-hand" method of tying an endless plumb neck tie. As shown in FIG. 9B, the first blade 130 is crossed over the second blade 140 at a first crossover 116. Noting that the blades as shown in FIG. 9B are not drawn to scale, FIGS. 9C through 9F illustrate the same blades 130, 140 lengthened to a scale suitable for illustrating several tying steps. As shown in FIG. 9C, a fold line 182 is made at the juncture 180, as described for the "overhand" method and shown in FIG. 7C, and a fold 184 is made at fold line 182. The fold line defines a transition between the first blade 130 and the second blade 140. The fold line may be predefined in the endless loop 110 by, for example, thermal pressing or defining a line with a pattern of stitching. As also shown in FIG. 9C, the first blade 130 is brought near the second blade 140 along and near the juncture 180. The first blade 130 is next crossed under the second blade 140 at a second crossover 117, and the first blade 130 is then crossed over the second blade 140 at a third crossover 118. As shown in FIG. 9D, the juncture region 180 is pulled under the neckband 120 and upward through the neckband 120, while forming a portion of the second blade 140 into a bight 113, thereby creating bight opening 115. The juncture region 180 is then passed over the neckband 120 and then positioned over the bight opening 115 as shown in FIG. 9E. With continued pulling, the juncture region 180 is passed or pulled through the bight opening 115, to fashion an outside knot 160 for the tie 100, shown tightened in FIG. 9F. That is, by pulling and extending juncture region 180 vertically downward at the same time as controlling bight 113 to be proximal crossover 116, the size of the bight opening 115 is reduced and, through tightening, bight 113 becomes outside knot 160. Also, the action of pulling the juncture region 180 downward positions the bight 113 proximal the front 45 of the neck 25 so that with further pulling, the outside knot 160 of the endless plumb neck tie 100 is situated at the front 45 of the neck 25. See, also, the illustrations of FIG. 1. The first blade 130, the second blade 140, and the outside knot 160 are then dressed. In this example, the resulting endless plumb neck tie 100 of FIG. 9F approximates the look of an ended plumb neck tie. The four-in-hand method of tying an endless plumb neck tie may be used to advantage with the endless loop 110 of FIG. 9A by further including a twist which is an integer multiple of 180 degrees (not shown), to compensate for twisting of the endless loop during the steps shown in FIGS. 9B and 9C, as blades 130 and 140 are crossed over each other at crossovers 116, 117, and 118; e.g., an endless loop with a left-hand twist of 540 degrees can provide a smooth appearance when the endless plumb neck tie is configured using the four-in-hand method of FIG. 9.

Figure 2A:
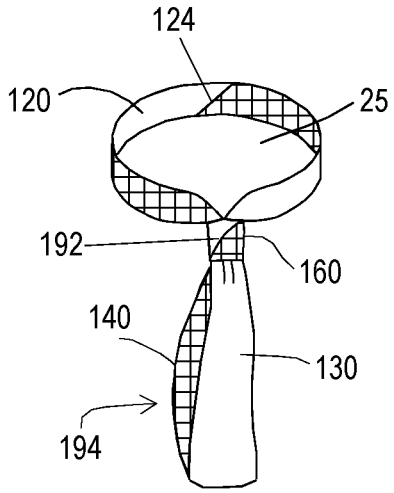
FIGS. 2A and 2B are perspective front views illustrating features of a Mobius plumb neck tie with, respectively, a twist at the outside knot and a twist on the front blade, according to embodiments of the invention.
Figure 2B:
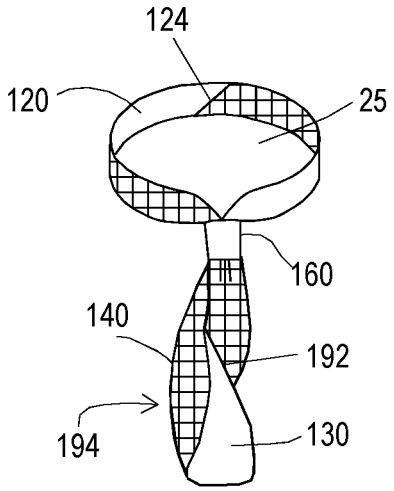

FIG. 2 illustrate an embodiment of a Mobius plumb neck tie 194 as it would be worn about a neck 25. The Mobius plumb neck tie 194 is configured from a Mobius loop 190, shown in FIG. 10A, comprising a characteristic Mobius twist 192. FIGS. 2A and 2B are both front views of the Mobius plumb neck tie 194. FIG. 2A shows the Mobius twist 192 positioned in an outside knot 160 while FIG. 2B shows the Mobius twist 192 positioned in a first blade 130. Multiple fabric color shadings and seam 124 are shown for the Mobius plumb neck tie 194 in FIGS. 2A and 2B to illustrate an exemplary alternation of fabrics.

The configured Mobius plumb neck tie 194 of FIG. 2 includes a neck band 120, a first blade 130, a second blade 140, an outside knot 160, and a Mobius twist 192. The configured Mobius plumb neck tie 194 may also include an inside knot 150 as shown in the rear perspective view of the Mobius plumb neck tie 194 of FIG. 101. The neck band 120 is shown in FIG. 2 encircling a neck 25. The outside knot 160 is shown in FIGS. 2A and 2B positioned where it constricts the juncture of the neck band 120, first blade 130, and second blade 140.

Figure 10A:
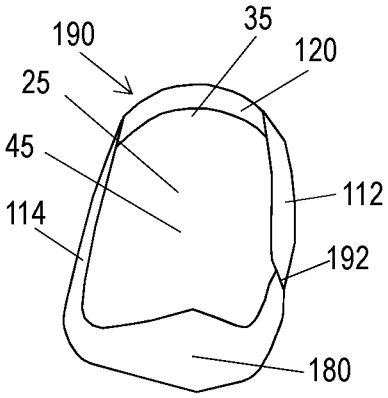
FIGS. 10A through 10H are front perspective views of a sequence of steps according to a simple loop method to tie a Mobius plumb neck tie according to embodiments of the invention.

As shown in FIG. 10, a sequence of steps using the "simple loop" method by which a Mobius loop 190 is configured to form a Mobius plumb neck tie 194, begins as in FIG. 10A with placing a Mobius loop 190 as it would be worn about a neck 25 (not shown) to define, with respect to the nape 35 of the neck 25, a first segment 112 and a second segment 114 of the Mobius loop 190. The segments 112, 114 each extend from an opposing side of the nape 35 and along different sides of the neck 25. The segments 112, 114 meet contiguously at a juncture region 180 (shown positioned below the front 45 of the neck 25) due to the continuous nature of the Mobius loop. The first segment 112 and the second segment 114 of the endless loop extend from the nape 35 forward to meet one another near the front 45 of the neck 25 (shown in FIG. 10A). As shown in FIG. 10B, the first segment 112 is then crossed over the second segment 114 to create a first crossover 116 to define the neckband 120, comprising the first portion 112*a* of the first segment 112 from the front 45 of the neck to the nape 35 and the contiguous first portion 114*a* of the second segment 114 from the nape 35 to the front 45 of the neck. The first blade 130 includes the second portion 112*b* of the first segment 112 extending from the front 45 of the neck to the juncture region 180. The second blade 140 includes the second portion 114*b* of the second segment 114 extending from the front 45 of the neck to the juncture region 180.

Figure 10B:
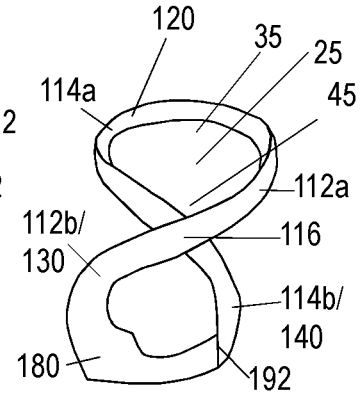
Figure 10C:
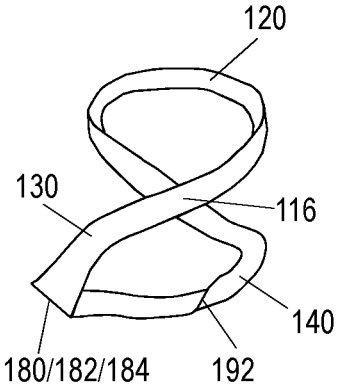

With conformal positioning of the neckband 120 along the neck, the position of the Mobius twist 192 may be constrained to be located near the juncture region 180, or on the first blade 130, or as shown in FIGS. 10B and IOC, on the second blade 140.

Figure 10D:
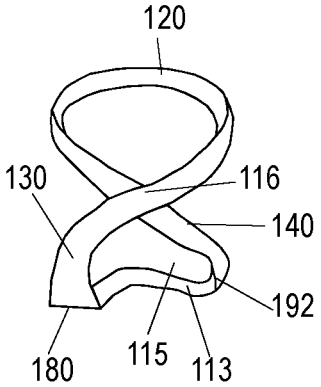
Figure 10E:
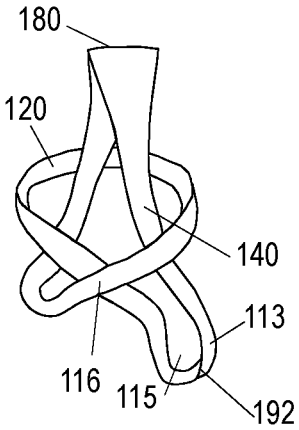
Figure 10F:
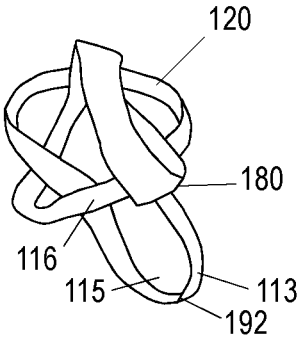
Figure 10G:
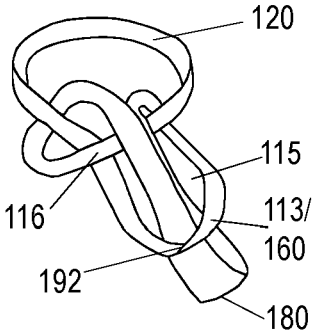
Figure 10H:
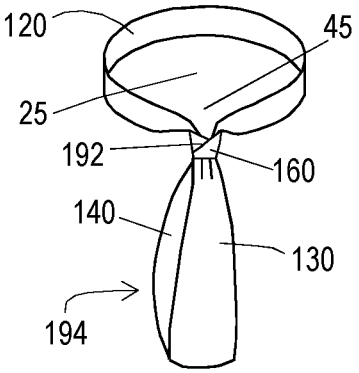
Figure 10I:
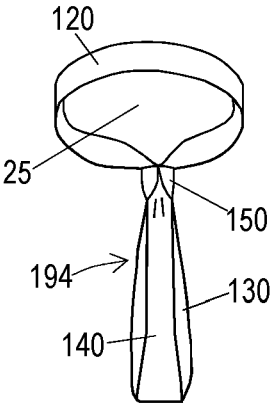
FIG. 10I is a rear perspective view of the configured Mobius plumb neck tie.

Crossover 116 is shown in FIGS. 10B and IOC where the first blade 130 is crossed over the second blade 140. As shown in FIGS. IOC and 10D, a fold line 182 is made at the juncture 180, and a fold 184 is made at fold line 182. As shown in FIG. 10D, the first blade 130 is brought near the second blade 140 along and near the juncture 180. Noting that the blades as shown in FIG. 10D are not drawn to scale, FIG. 10E illustrates the same blades 130, 140 lengthened to a scale suitable for illustrating several tying steps. As shown in FIG. 10E, the juncture region 180 is pulled under the neckband 120 and then upward, inside then over the neckband 120, and then above and past the crossover 116. This pulling configures a portion of the second blade 140 into a bight 113, thereby creating bight opening 115. The juncture region 180 is passed over the neckband 120 as shown in FIG. 10F. With continued pulling the juncture region 180 is passed or pulled through the bight opening 115, as shown in FIG. 10G, to fashion an outside knot 160 for the Mobius plumb neck tie 194 as shown in FIG. 10H. That is, by pulling and extending juncture region 180 vertically downward at the same time as controlling bight 113 to be proximal crossover 116, the size of the bight opening 115 is reduced and, through tightening, bight 113 becomes outside knot 160. Also, the action of pulling the juncture region 180 downward positions the bight 113 proximal the front 45 of the neck 25 so that with further pulling, the outside knot 160 of the Mobius plumb neck tie 194 is situated at the front 45 of the neck 25. See, also, the illustrations of FIG. 1. The first blade 130, the second blade 140, and the outside knot 160 are then dressed. In this example, the resulting Mobius plumb neck tie 194, shown in the front perspective view of FIG. 10H and in the rear perspective view in 101, approximates the look of an ended plumb neck tie. FIG. 10H shows the Mobius twist 192 positioned in the outside knot 160, although the Mobius twist 192 may be constrained to appear in any element of the neck tie, as noted in following paragraph describing some other embodiments of this invention. A feature of the Mobius plumb neck tie 194 made from two distinctive fabrics is the alternation of the fabrics in the dressed neck tie, as an exemplary arrangement, shown in FIGS. 2A and 2B.

Embodiments of this invention include varying the simple loop method, overhand method, or the four-in-hand method of tying the Mobius plumb neck tie 194 by changing the configured location of the Mobius twist 192. In one embodiment the Mobius twist 192 is constrained to the bight 113, in which case the Mobius twist 192 may be positioned in the resulting outside knot 160 as shown in FIGS. 2A and 10H. In another embodiment the Mobius twist 192 is constrained during tying to the region of the juncture region 180, in which case the Mobius twist 192 may be unsecured and left to settle near the juncture region 180; or, the Mobius twist 192 may be moved to the first blade 130 as shown in FIG. 2B, and further may be constrained to the middle of first blade 130 using standard tie hardware such as a tie pin or tie bar to better display contrasting fabrics. The Mobius twist 192 may be constrained to appear in any element of the neck tie, including the first blade 130, the second blade 140, the inside knot 150, the outside knot 160, and the neckband, for these alternate tying methods. Further, additional twists may be added in any element. For example, a 180-degree right-hand twist may be positioned in the neckband of an untwisted endless plumb necktie in order to create a corresponding 180-degree left-hand twist in the front blade to simulate the appearance of a Mobius plumb necktie.

An embodiment of an endless bow tie 200 according to the invention is illustrated in FIG. 3. FIG. 3A is a front view of the dressed bow tie and 3B is a view in cross-section taken from above the bow tie 200. FIGS. 3C, 3D, and 3E are schematic knot diagrams of the endless bow tie 200 viewed from above, illustrating, respectively, an overhand knot, a square knot, and a rotated knot. The rotated knot of FIG. 3E is formed with a variation of the square knot method.

Figure 3A:
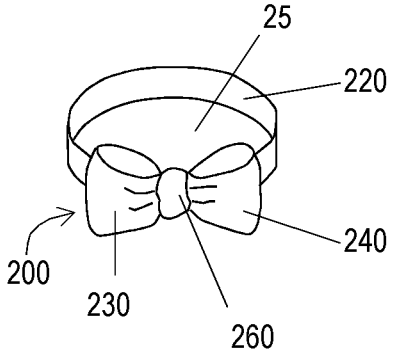
FIG. 3A is a perspective front view of an endless bow tie configured from an endless loop according to an embodiment of the invention.
Figure 3B:
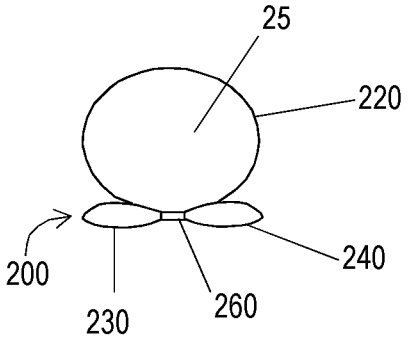
FIG. 3B is a view in cross-section of the endless bow tie shown in FIG. 3A taken along the endless loop.
Figure 3C:
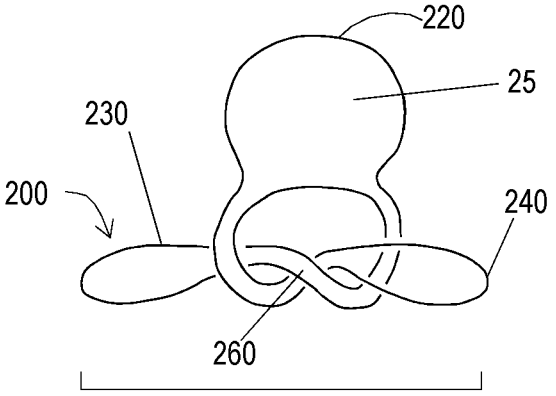
FIGS. 3C, 3D, and 3E are schematic knot diagrams for an endless bow tie from above, according to embodiments of the invention.
Figure 3D:
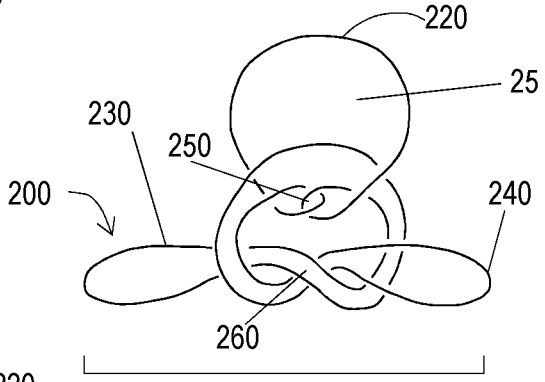
Figure 3E:
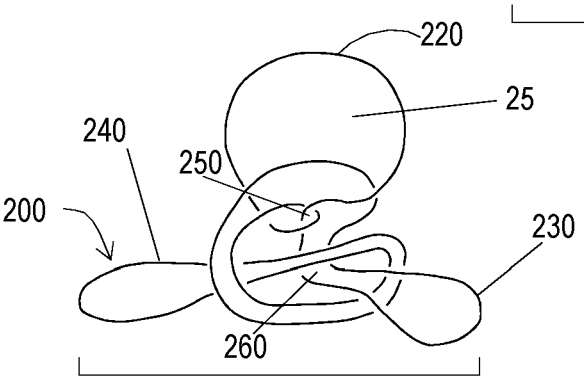

The configured endless bow tie 200 of FIGS. 3A and 3B includes a neck band 220, as it would be worn about a neck 25 (not shown), a first blade 230, a second blade 240, and an outside knot 260. In some embodiments, the endless bow tie 200 may also be configured with an inside knot 250. Endless loop 210, shown in FIGS. 11A, 12A, and 13A, is constricted by outside knot 260 as shown in FIGS. 3A and 3B, about the juncture of the neck band 220, the first blade 230, and the second blade 240.

Figure 11A:
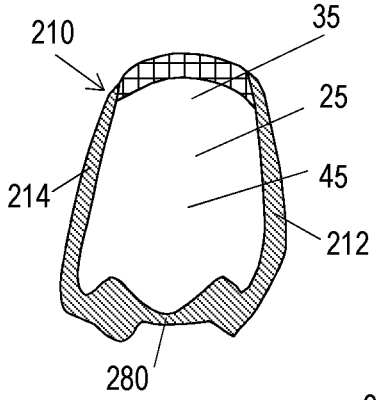
FIGS. 11A through 11G are views of a sequence of steps according to an overhand knot method for configuring an endless bow tie according to the invention, where
Figure 11B:
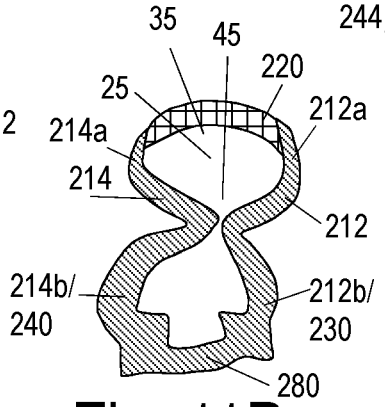
Figure 11C:
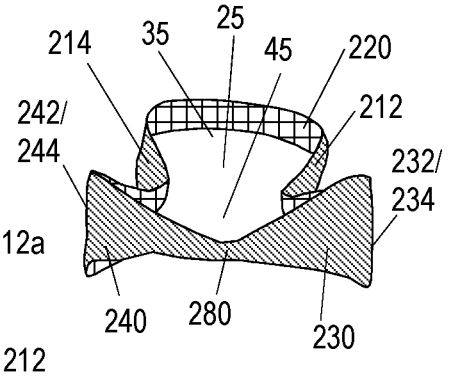
Figure 11D:
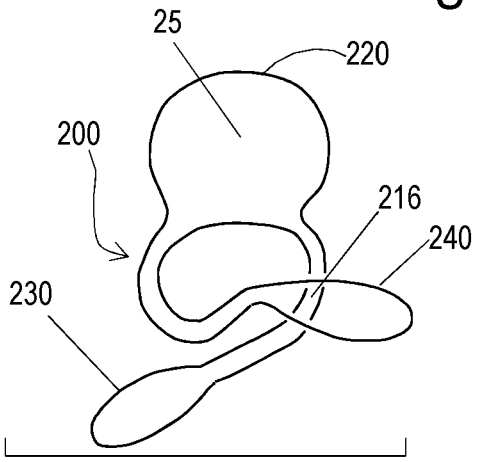
Figure 11E:
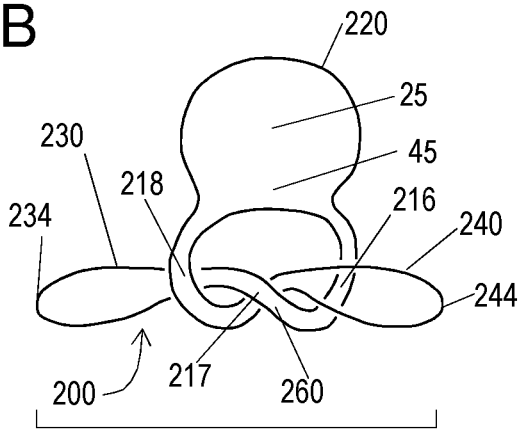
Figure 11F:
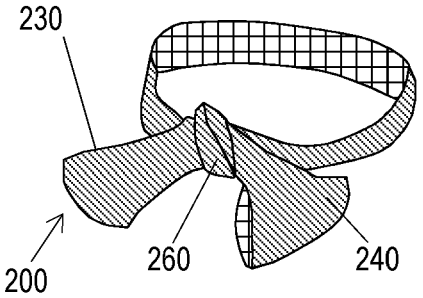
Figure 11G:
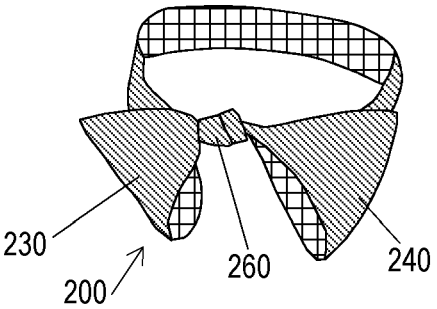
Figure 12A:
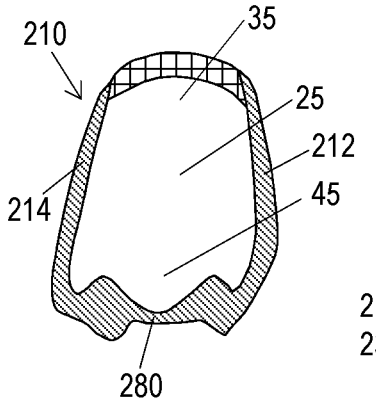
FIGS. 12A through 12L are views of a sequence of steps according to a square knot method for configuring an endless bow tie according to the invention, where
Figure 13A:
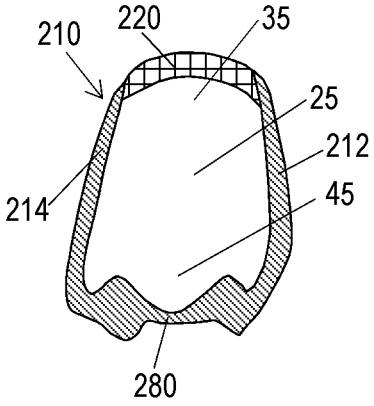
FIGS. 13A through 13L are views of a sequence of steps according to a rotated knot method for configuring an endless bow tie according to the invention, where

As shown in FIGS. 11A, 12A, and 13A, each of three sequences of steps, by which an endless loop 210 is configured as it would be worn about a neck 25 (not shown) to form one embodiment of the endless bow tie 200, begins with placing an endless loop 210 about a neck 25 to define, with respect to the nape 35 of the neck 25, a first segment 212 and a second segment 214 of the endless loop 210. The segments 212, 214 each extend along an opposing side of the nape 35 and along different sides of the neck 25. The segments 212, 214 meet contiguously at a juncture region 180 (shown positioned below the front 35 of the neck) due to the continuous nature of the endless loop. The first segment 212 and the second segment 214 of the endless loop extend from the nape 35 forward to meet one another near the front 45 of the neck 25 (shown in FIGS. 11A, 12A, and 13A).

Figure 12B:
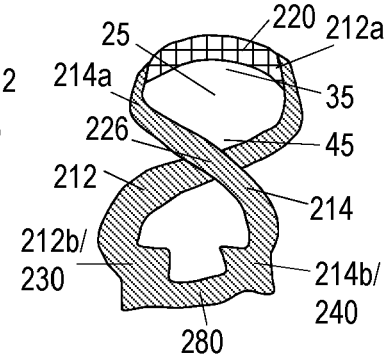
Figure 13B:
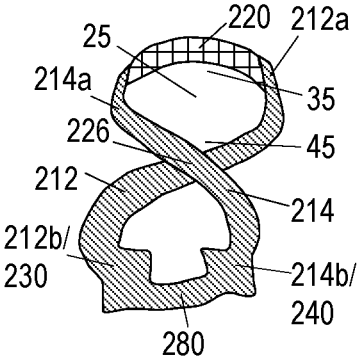

Portions of the first segment 212 and the second segment 214 of the endless loop are conformed with the shape of the neck 25 as they extend from the nape 35 forward to (i) nearly meet near the front 45 of the neck 25 (FIG. 1 IB), or (ii) contact or cross over one another at a crossover 226 near the front 45 of the neck 25 (FIGS. 12B and 13B), to form the neckband 220. As shown in FIG. 1 IB, the first subsegment 212*a* of the first segment 212 extends from the front 45 of the neck to the nape 35, and the first subsegment 214*a* of the second segment 214 extends from the nape 35 to the front 45 of the neck. As shown in FIGS. 12B and 13B, the first subsegment 212*a* of the first segment 212 extends from the front 45 of the neck at a crossover 226 to the nape 35, and the first subsegment 214*a* of the second segment 214 extends from the nape 35 to the front 45 of the neck, also at the crossover 226. As shown in FIGS. 1 IB, 12B, and 13B, the first blade 230 comprises a remaining portion, second subsegment 212*b*, of the first segment 212 extending from near the front 45 of the neck at the crossover 226 to a juncture region 280, and the second blade 240 comprises a remaining portion, second subsegment 214*b*, of the second segment 214 extending from the front 45 of the neck at the crossover 226 to the juncture region 280. The terms "bridge" or "bridge region" may be used to refer to juncture regions of relatively narrow width for which a first blade end region and a second blade end region terminate at opposed ends of the juncture region, such as juncture regions 280 and 380 for the endless bow tie. The terms "integrally connected blades" and "integrally connected blade region" may refer to a juncture region in an endless loop 210 that is of relatively wide width in, or about which, the first and second blades meet or are connected, such as juncture regions 180 and 780 for the endless neck tie. The terms "integrally formed blades" and "integrally connected blades" in an endless loop 210 refer to the presence of juncture regions at, or about which, the first and second blades meet or are connected.

FIG. 11 illustrate the "overhand knot" method of tying the endless bow tie. As shown in FIG. 11C, a fold line 232 is made near the middle of the first blade 230, and a fold 234 is made at fold line 232; a fold line 242 is made near the middle of the second blade 240, and a fold 244 is made at fold line 242. Noting that the blades as shown in FIG. 11C are not drawn to scale, FIG. 1 ID illustrates the same blades 230, 240 lengthened to a scale suitable for illustrating several tying steps. As shown in FIG. 11D, the second blade 240 is crossed over the first blade 230 at a first crossover 216. Noting that the blades as shown in FIGS. 11A, 11B, 11C are not drawn to scale, FIGS. 1 ID and 1 IE illustrate the same blades 230, 240 lengthened to a scale suitable for illustrating several tying steps. As shown in FIG. 1 IE, the first fold 234 is crossed over the second blade 240 at a second crossover 217 and is then crossed under the second blade 240 at a third crossover 218, forming an outside knot 260 near the front of the neck 45 (FIG. 1 IF). The first blade 230, the second blade 240, and the outside knot 260 are then dressed so the resulting endless bow tie 200 approximates the look of an ended bow tie (FIG. 11G).

FIG. 12 illustrate the "square knot" method of tying the endless bow tie and FIG. 13 illustrate the "rotated knot" method of tying the endless bow tie. As shown in FIGS. 12B, 12C, 13B and 13C, the second segment 214 is crossed over the first segment 212 at a first crossover 226.

Figure 12C:
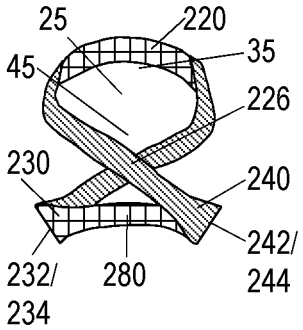
Figure 12D:
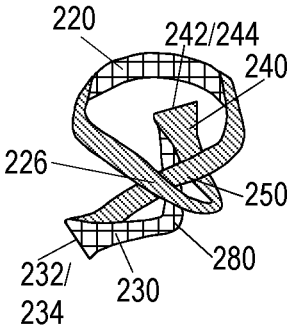
Figure 12E:
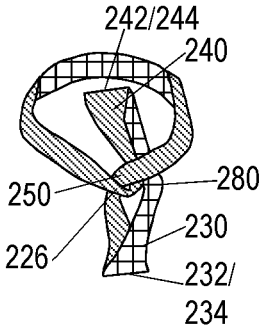
Figure 12F:
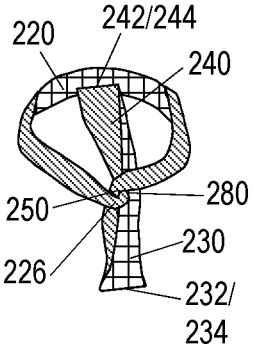
Figure 12G:
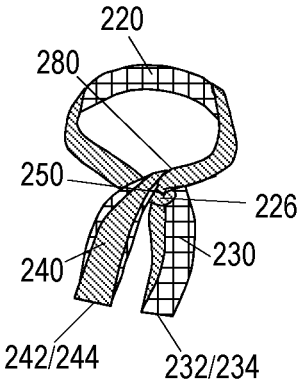
Figure 12H:
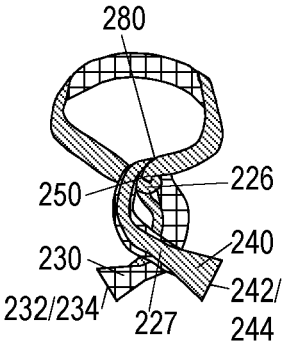
Figure 12I:
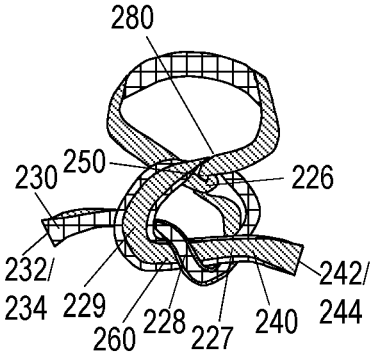
Figure 12J:
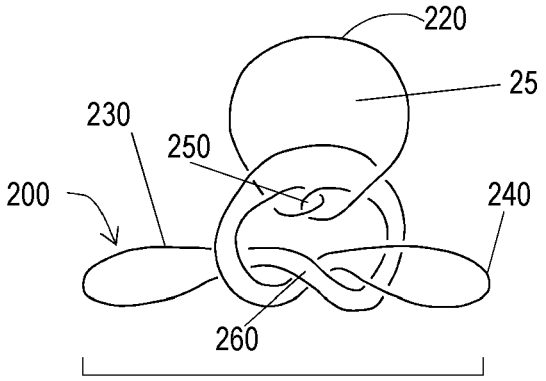
Figure 12K:
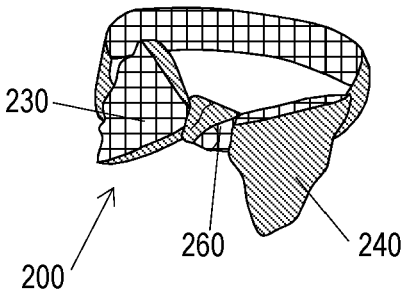
Figure 12L:
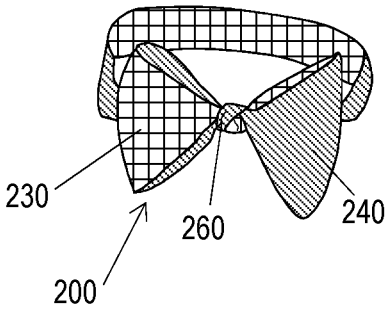
Figure 13C:
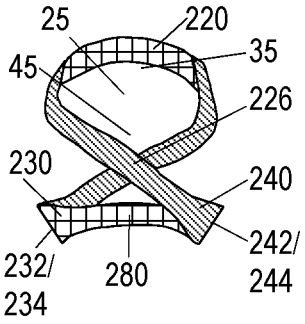
Figure 13D:
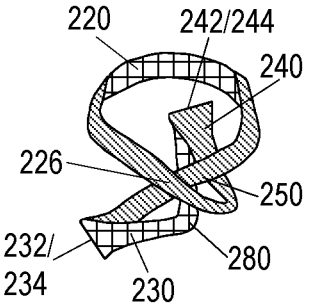
Figure 13E:
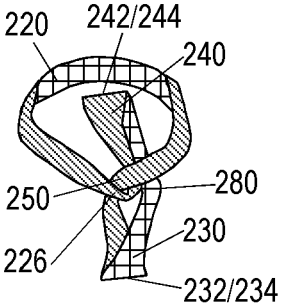
Figure 13F:
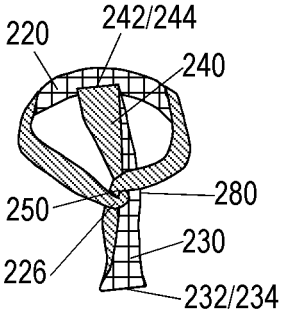
Figure 13G:
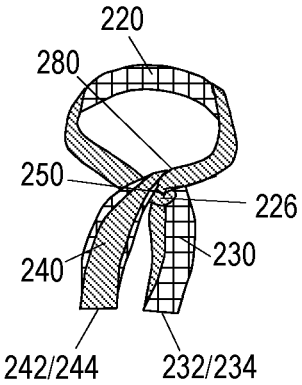
Figure 13H:
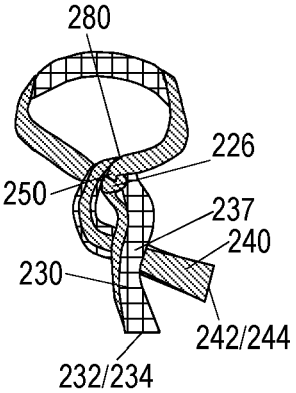
Figure 13I:
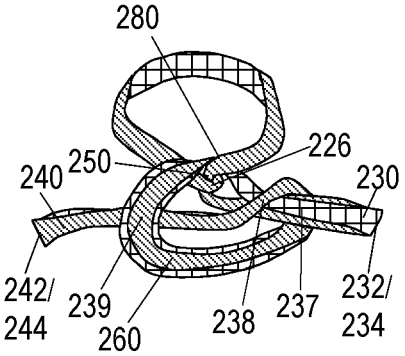
Figure 13J:
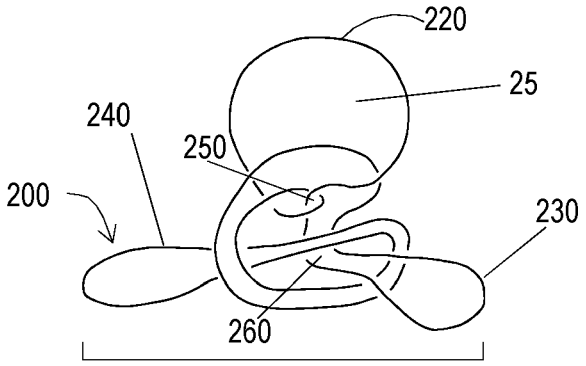
Figure 13K:
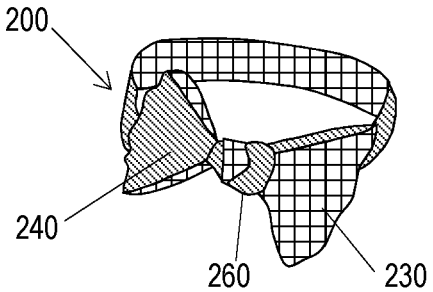
Figure 13L:
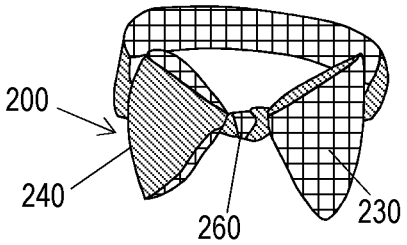
Figure 14A:
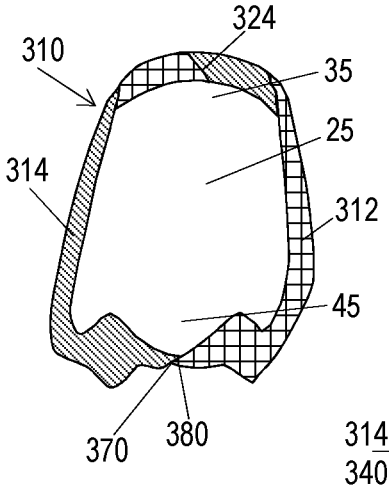
FIGS. 14A through 14G are views of a sequence of steps according to an overhand knot method for configuring a Mobius bow tie according to the invention, where
Figure 14B:
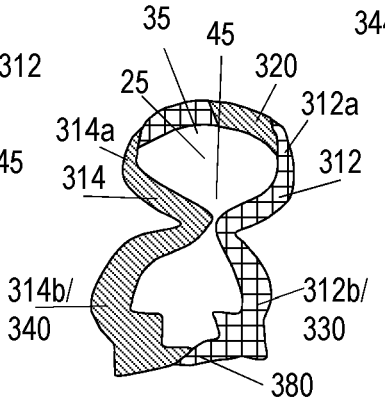
Figure 14C:
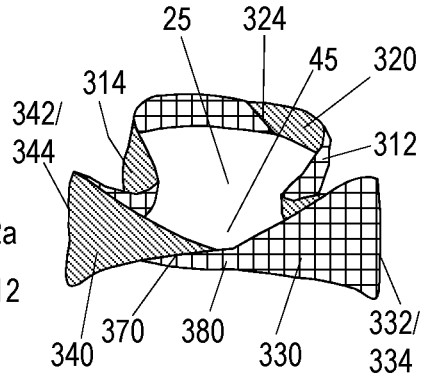
Figure 14D:
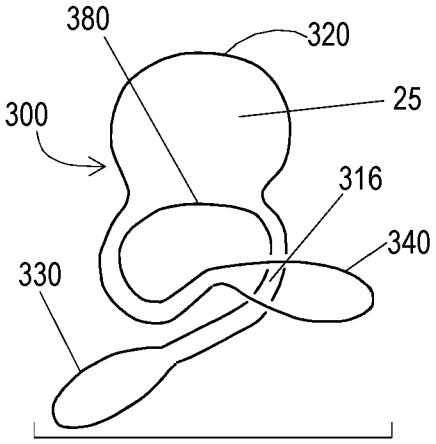
Figure 14E:
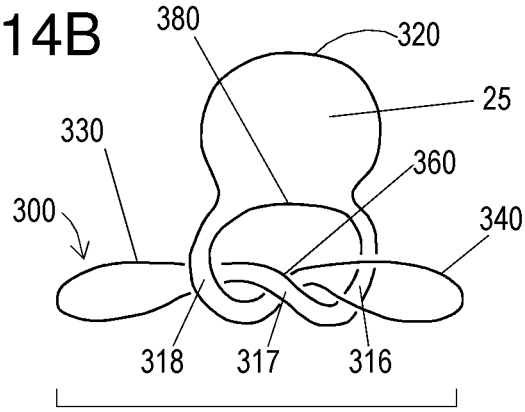
Figure 14F:
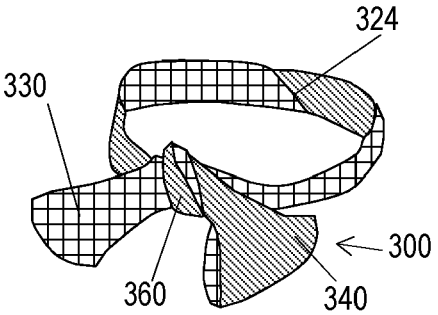
Figure 14G:
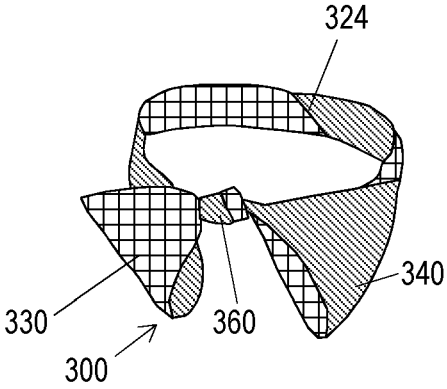

As shown in FIGS. 12C and 13C, a fold line 232 is made near the middle of the first blade 230, and a fold 234 is made at fold line 232; a fold line 242 is made near the middle of the second blade 240, and a fold 244 is made at fold line 242. As shown in FIGS. 12D and 13D, the second blade 240 is pulled at or near the second fold 242 to cross the second blade 240 beneath the first crossover 226 and through the neckband 220. This forms an inside knot 250. Pulling of the second blade 240 continues until the juncture region 280 moves under the first crossover 226 (FIGS. 12E, 12F, 13E, 13F). As shown in FIGS. 12G and 13G, the second fold 244 and second blade 240 are then crossed over the neckband 220. As shown in FIG. 12H, the second fold 244 and the second blade 240 are crossed over the first blade 230, creating a second crossover 227. Noting that the blades as shown in FIG. 12H are not drawn to scale, FIG. 121 illustrates the same blades 230, 240 lengthened to a scale suitable for illustrating several tying steps. As shown in FIG. 121, the first fold 232 is drawn over the second blade 240, creating a third crossover 228, and then passed under the second blade 240 to create a fourth crossover 229, forming an outside knot 260. FIG. 12J schematically illustrates the resulting outside knot 260. As shown in FIG. 12K, the first blade 230, the second blade 240, and the outside knot 260 are dressed so the resulting endless bow tie 200 approximates the look of an ended bow tie (FIG. 12L).

FIG. 13 illustrate the "rotated knot" method of tying the endless bow tie. As shown in FIG. 13H, the second fold 242 and the second blade 240 are pulled under the first blade 230 at a second crossover 237. Noting that the blades as shown in FIG. 13H are not drawn to scale, FIG. 131 illustrates the same blades 230, 240 lengthened to a scale suitable for illustrating several tying steps. As shown in FIG. 131, the second fold 242 is drawn over the first blade 230 at a third crossover 238, then under the second blade 240 at a fourth crossover 239, forming an outside knot 260. FIG. 13J shows the corresponding knot diagram. As shown in FIG. 13K, the first blade 230, the second blade 240, and the outside knot 260 are then dressed so the resulting endless bow tie 200 approximates the look of an ended bow tie (FIG. 13L).

Figure 4A:
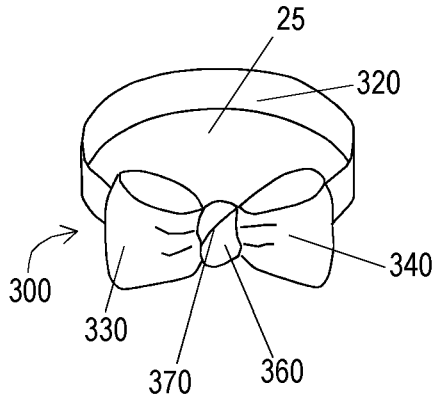
FIGS. 4A and 4B are perspective front views illustrating features of embodiments of a Mobius bow tie, respectively, without and with contrasting fabrics.
Figure 4B:
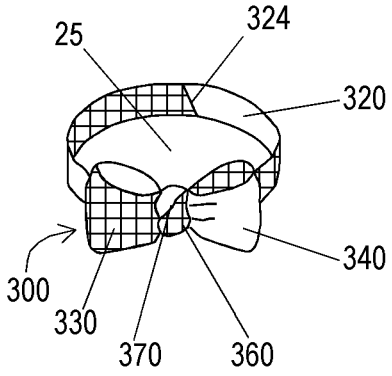

A typical embodiment of a Mobius bow tie 300 of the present invention is illustrated in FIG. 4. FIGS. 4A and 4B are front views, both showing a Mobius twist 370 constrained to an outside knot 360. FIG. 4B illustrates by color shading a possible alternation of fabrics and seam 324.

Figure 15A:
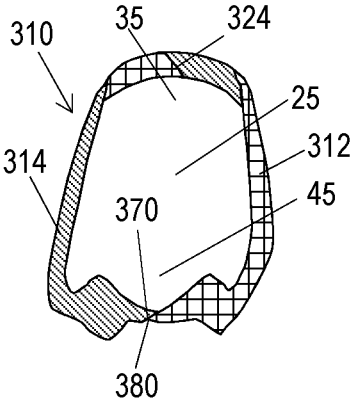
FIGS. 15A through 15K are views of a sequence of steps according to a square knot method for configuring a Mobius bow tie according to the invention, where
Figure 15B:
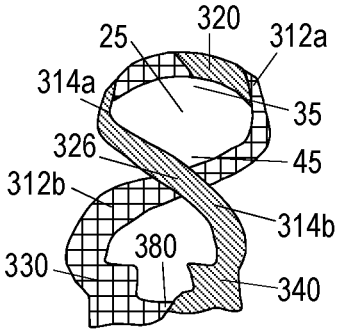
Figure 15C:
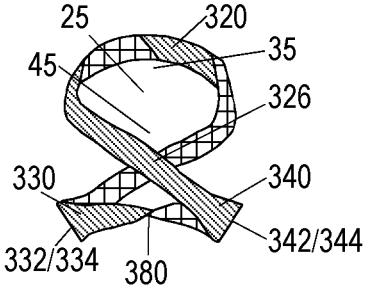
Figure 15D:
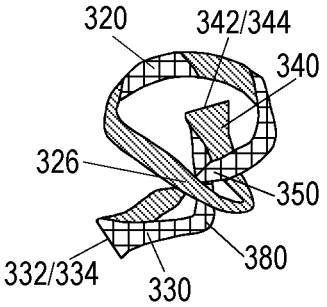
Figure 15E:
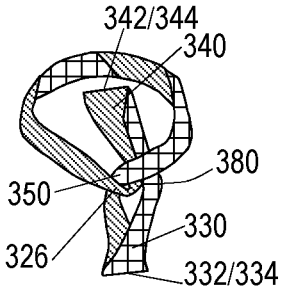
Figure 15F:
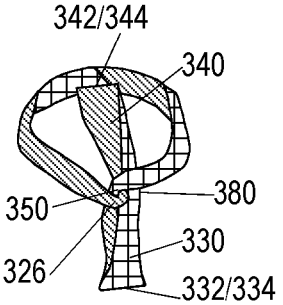
Figure 15G:
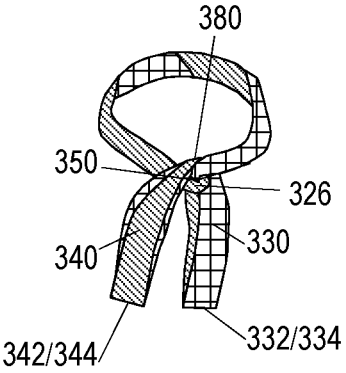
Figure 15H:
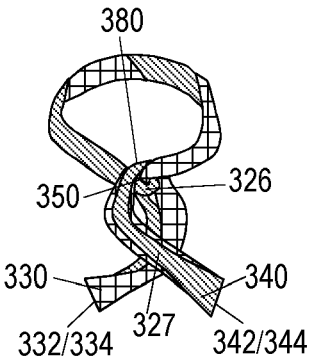
Figure 15I:
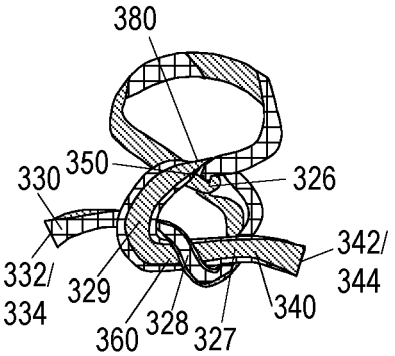
Figure 15J:
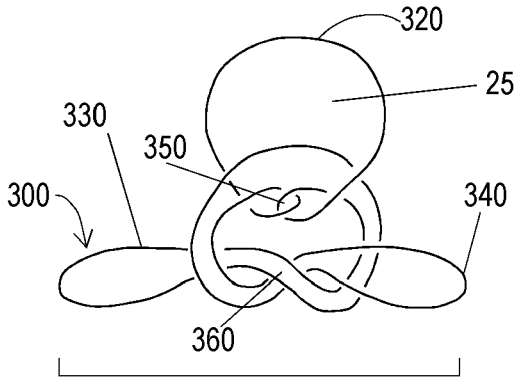
Figure 15K:
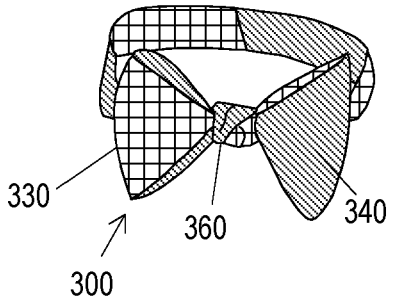
Figure 16A:
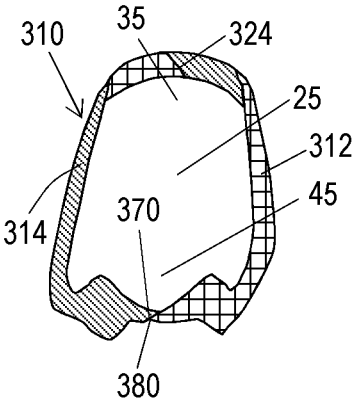
FIGS. 16A through 16K are views of a sequence of steps according to a rotated knot method for configuring a Mobius bow tie according to the invention, where
Figure 16B:
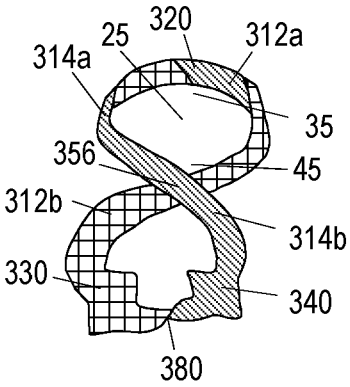
Figure 16C:
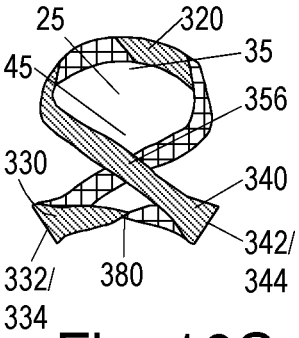
Figure 16D:
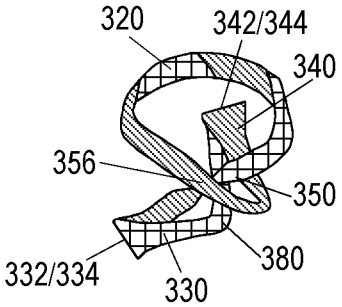
Figure 16E:
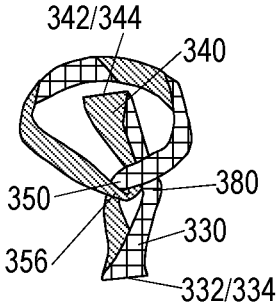
Figure 16F:
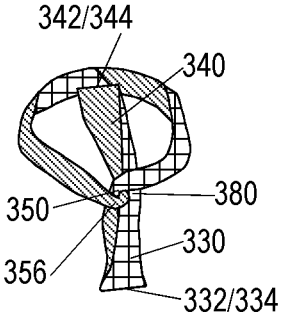
Figure 16G:
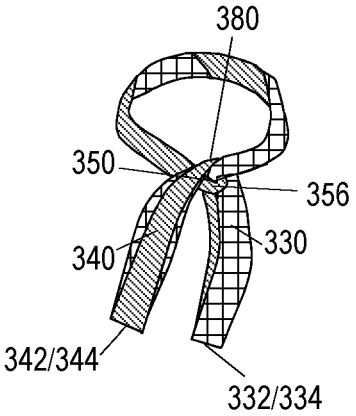
Figure 16H:
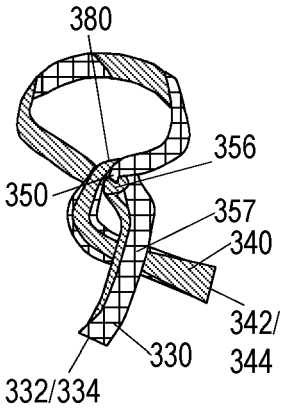
Figure 16I:
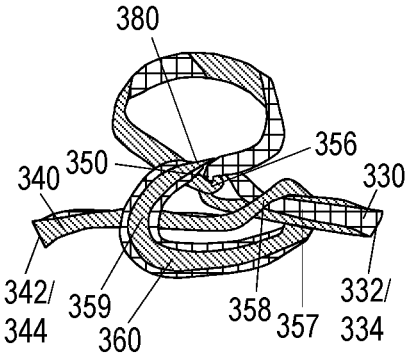
Figure 16J:
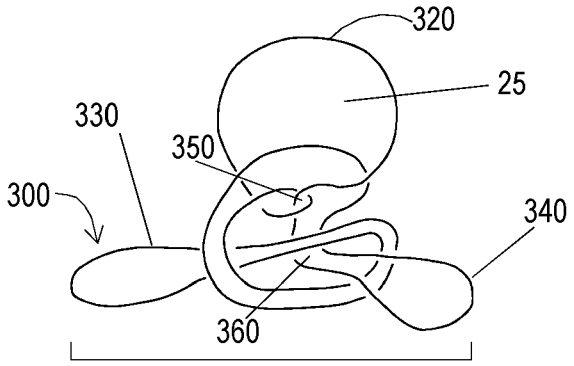
Figure 16K:
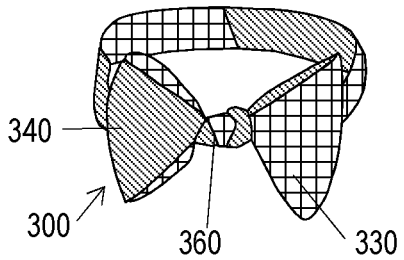

The configured Mobius bow tie 300 of FIG. 4 includes a neck band 320, a first blade 330, a second blade 340, an outside knot 360, and a Mobius twist 370. The configured Mobius bow tie 300 may also include an inside knot 350, as shown for example in FIGS. 15J and 16J. In FIG. 4, the neck band 320 is shown as it would be worn about a neck 25 (not shown). The outside knot 360 is shown in FIGS. 4A and 4B constricting the juncture of the neck band 320, first blade 330, and second blade 340.

FIGS. 14, 15, and 16 each illustrate a sequence of steps by which a Mobius loop 310 with Mobius twist 370 is configured as it would be worn about a neck 25 (not shown) to form an embodiment of a Mobius bow tie 300. As shown in FIGS. 14A, 15A, and 16A, initially a Mobius loop 310 with Mobius twist 370 and seam 324 is placed over a nape 35 of a neck 25, defining a first segment 312 and a second segment 314 of the Mobius loop 310, which extend in opposite directions from the nape 35 and contiguously meet at a juncture region 380 due to the continuous nature of the Mobius loop 310.T The first segment 312 and the second segment 314 of the Mobius loop are conformed with the shape of the neck 25 from the nape 35 forward to the front 45 of the neck to define the neckband 320 (shown in FIGS. 14B, 15B, and 16B), comprising the portion 312*a* of the first segment 312 extending from the front 45 of the neck to the nape 35 and the contiguous portion 314*a* of the second segment 314 from the nape 35 to the front 45 of the neck. The first blade 330 comprises the portion 312*b* of the first segment 312 from the front 45 of the neck to the juncture region 380. The second blade 340 comprises the portion 314*b* of the second segment 314 from the front 45 of the neck to the juncture region 380. With the neckband 320 conformed with the shape of the neck 25, the Mobius twist 370 may be constrained to be located at the juncture region 380, or on the first blade 330, or on the second blade 340. A variation allows for the Mobius twist 370 to be constrained to be located on the neckband, in which case the Mobius bow tie may present the same as the endless bow tie of FIGS. 3, 11, 12, and 13.

FIG. 14 illustrate the "overhand knot" method of tying the Mobius bow tie. As shown in FIG. 14C, a fold line 332 is made near the middle of the first blade 330, and a fold 334 is made along fold line 332; a fold line 342 is made near the middle of the second blade 340, and a fold 344 is made along fold line 342. Noting that the blades as shown in FIG. 14C are not drawn to scale, FIG. 14D illustrates the same blades 330, 340 lengthened to a scale suitable for illustrating several tying steps. As shown in FIG. 14D, the second blade 340 is crossed over the first blade 330 at a first crossover 316. As shown in FIG. 14E, the first blade 330 is crossed over the second blade 340 at a second crossover 317, and the first blade 330 is crossed under the second blade 340 at a third crossover 318, forming an outside knot 360 next to the front of the neck 45 (FIG. 14F). The first blade 330, the second blade 340, and the outside knot 360 are then arranged and straightened ("dressed") so the resulting Mobius bow tie 300 approximates the look of an ended bow tie (FIG. 14G).

FIG. 15 illustrate the "square knot" method of tying the Mobius bow tie. As shown in FIGS. 15B and 15C, the second blade 340 is crossed over the first blade 330 at a first crossover 326. As shown in FIG. 15C, a fold line 332 is made near the middle of the first blade 330, and a fold 334 is made at fold line 332; a fold line 342 is made near the middle of the second blade 340, and a fold 344 is made at fold line 342. As shown in FIG. 15D, the second fold 342 is pulled beneath and past the first crossover 326, pulling the second blade 340 up through the neckband 320 and forming an inside knot 350, until the juncture region 380 moves directly under the first crossover 326 (FIGS. 15E, 15F). As shown in FIG. 15G, the second fold 344 and second blade 340 are drawn and then pulled down over the neckband 320. As shown in FIG. 15H, the second fold 342 and second blade 340 are pulled over the first blade 330 at a second crossover 327. Noting that the blades as shown in FIG. 15H are not drawn to scale, FIG. 151 illustrates the same blades 330, 340 lengthened to a scale suitable for illustrating several tying steps. As shown in FIG. 151, the first fold 332 is drawn over the second blade 340 at a third crossover 328, then under the first blade 330 at a fourth crossover 329, forming an outside knot 360 next to the front of the neck 45. FIG. 15J shows the corresponding knot diagram. As shown in FIG. 15K, the first blade 330, the second blade 340, and the outside knot 360 are then arranged and straightened ("dressed") so the resulting Mobius bow tie 300 approximates the look of an ended bow tie.

FIG. 16 illustrate the "rotated knot" method of tying the Mobius bow tie. As shown in FIGS. 16B and 16C, the second blade 340 is crossed over the first blade 330 at a first crossover 356. As shown in FIG. 16C, a fold line 332 is made near the middle of the first blade 330, and a fold 334 is made at fold line 332; a fold line 342 is made near the middle of the second blade 340, and a fold 344 is made at fold line 342. As shown in FIG. 16D, the second fold 344 is pulled beneath and past the first crossover 356, pulling the second blade 340 up through the neckband 320 and forming an inside knot 350, until the juncture region 380 moves directly under the first crossover 356 (FIGS. 16E, 16F). As shown in FIG. 16G, the second fold 342 and second blade 340 are drawn and then pulled down over the neckband 320. As shown in FIG. 16H, the second fold 342 and second blade 340 are pulled under the first blade 330 at a second crossover 357. Noting that the blades as shown in FIG. 16H are not drawn to scale, FIG. 161 illustrates the same blades 330, 340 lengthened to a scale that illustrates several tying steps. As shown in FIG. 161, the second fold 342 is drawn over the first blade 330 at a third crossover 358, then under the second blade 340 at a fourth crossover 359, forming an outside knot 360. FIG. 16J shows the corresponding knot diagram. As shown in FIG. 16K, the first blade 330, the second blade 340, and the outside knot 360 are then dressed so the resulting endless bow tie 300 approximates the look of an ended bow tie.

Figure 5A:
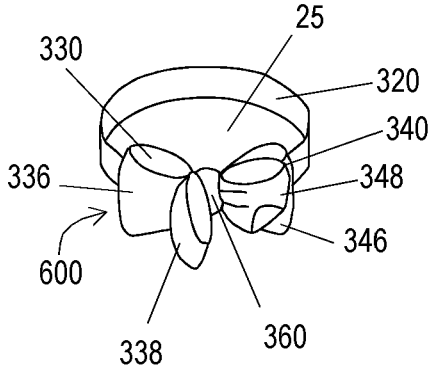
FIG. 5A is a perspective front view of an endless bow tie configured from an endless loop with double blades according to an embodiment of the invention.
Figure 5B:
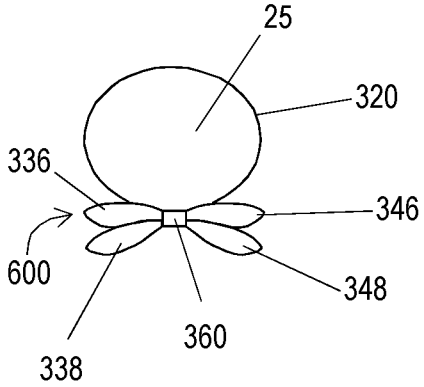
FIG. 5B is a view in cross-section of the endless bow tie shown in FIG. 5A taken along the endless loop.

A typical embodiment of an endless double bow tie 600 of the present invention is illustrated in the front view of FIG. 5A and in the top view of FIG. 5B. A typical embodiment of the Mobius double bow tie 604 of the present invention is illustrated in the front view in FIG. 5C.

The configured endless double bow tie 600 of FIG. 5A includes a neck band 320, a front loop 338 of a first blade 330, a back loop 336 of the first blade 330, a front loop 348 of a second blade 340, a back loop 346 of the second blade 340, and an outside knot 360. There may be an inside knot 350 (not shown) behind the outside knot 360, depending on the tying method. The neck band 320 is shown encircling a neck 25. The outside knot 360 is shown in FIG. 5 where it constricts the juncture of the neck band 320, first blade 330, and second blade 340.

FIG. 17 illustrate the "square knot" method of tying the endless double bow tie 600. FIG. 17 illustrate a sequence of steps by which an endless loop 602 is configured as it would be worn about a neck 25 to form an endless double bow tie 600. As shown in FIG. 17A, initially an endless loop 602 is placed over a nape 35 of a neck 25, thereby defining a first segment 312 and a second segment 314 of the endless loop 602, which segments extend from opposing sides of the nape 35 and contiguously meet at a juncture region 380 due to the continuous nature of the endless loop 602. The first segment 312 and the second segment 314 of the endless loop are conformed to the shape of the neck 25 from the nape 35 forward to meet near the front 45 of the neck 25. The neckband 320 (shown in FIG. 17B) comprises the portion of the first segment 312 extending from the front 45 of the neck to the nape 35 and the contiguous portion of the second segment 314 extending from the nape 35 to the front 45 of the neck. The first blade 330 comprises the portion of the first segment 312 from the front 45 of the neck to the juncture region 380. The second blade 340 comprises the portion of the second segment 314 from the front 45 of the neck to the juncture region 380.

Figure 17A:
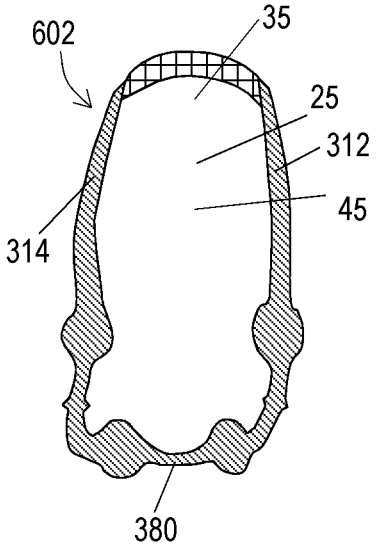
FIGS. 17A through 17K are views of a sequence of steps according to a square knot method for configuring an endless double bow tie according to the invention, where
Figure 17B:
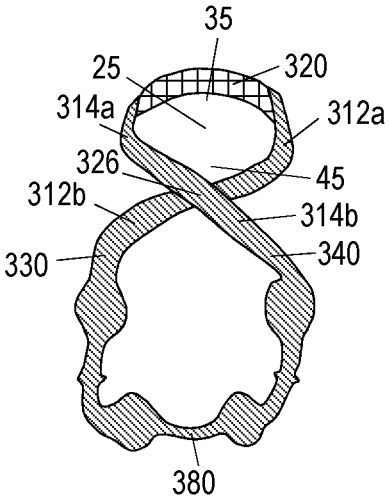
Figure 17C:
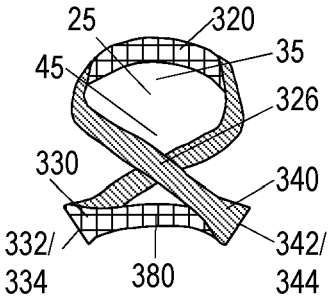
Figure 17D:
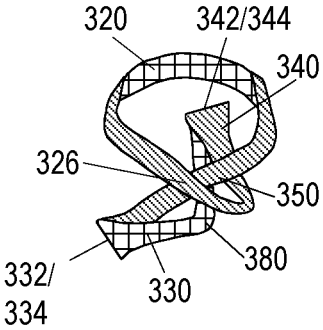
Figure 17E:
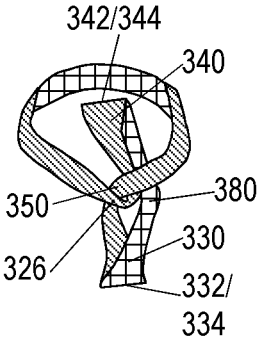
Figure 17F:
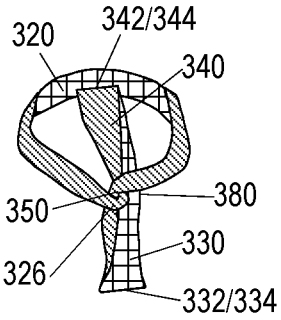
Figure 17G:
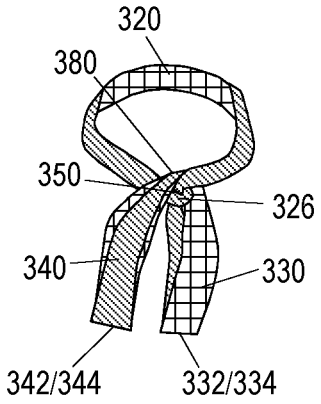
Figure 17H:
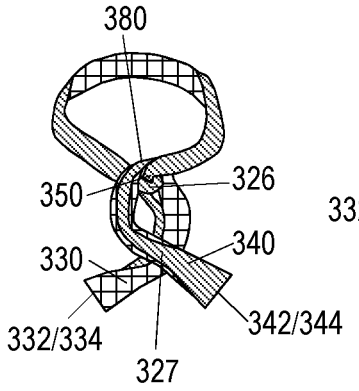
Figure 17I:
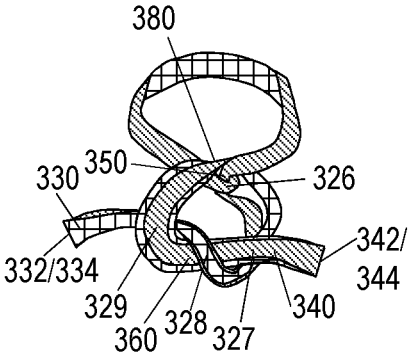
Figure 17J:
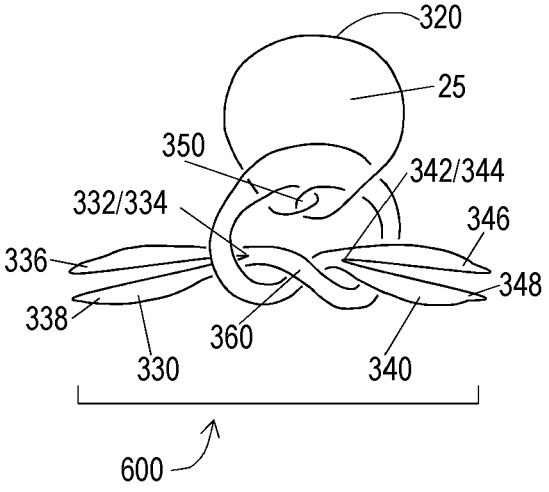

As shown in FIG. 17B, the first blade 330 is crossed over the second blade 340 at a crossover 326. As shown in FIG. 17C, a fold line 332 is identified near the middle of the first blade 330, and a fold 334 is made at fold line 332; and a fold line 342 is identified near the middle of the second blade 340, and a fold 344 is made at fold line 342. As shown in FIG. 17D, the second fold 342 is pulled beneath and past the crossover 326, pulling the second blade 340 up inside the neckband 320 and forming an inside knot 350, until the juncture region 380 moves directly under first crossover 326 (FIGS. 17E and 17F). As shown in FIG. 17G, the second fold 342 and second blade 340 are drawn over the neckband 320. As shown in FIG. 17H, the second fold 342 is drawn over the first blade 330 at a second crossover 327. Noting that the blades as shown in FIG. 17H are not drawn to scale, FIG. 171 illustrates the same blades 330, 340 lengthened to a scale suitable for illustrating several tying steps. As shown in FIG. 171, the first fold 332 is drawn over the second blade 340 at a third crossover 328 and under the second blade 340 at a fourth crossover 329, forming an outside knot 360 next to the front of the neck 45. As shown in FIG. 17J, the first fold 332 is inverted by first unfolding it, then folding it in the other direction, and the inverted first fold 332 is then tucked between the inside knot 350 and the outside knot 360 to present as double blades, thereby defining a front loop 338 of the first blade 330 and a back loop 336 of the first blade 330. Similarly, the second fold 342 is inverted by first unfolding it, then folding it in the other direction, and the inverted second fold 342 is then tucked between the inside knot 350 and the outside knot 360 to present as double blades, thereby defining a front loop 348 of the second blade 340 and a back loop 346 of the second blade 340.

In one embodiment of the endless double bow tie 600, notches 335 (shown in FIG. 20H) are located at fabric edges near fold line 332 between the back and front loops 336, 338 (shown in FIGS. 17J, 20H), and notches 345 (shown in FIG. 20H) are located at fabric edges near fold line 342 between the back and front loops 346, 348. See FIGS. 17J and 20H. Notches 335, 345 may help stabilize the positions of the inverted folds 332, 342 between the inside knot 350 and the outside knot 360 during wear.

Figure 17K:
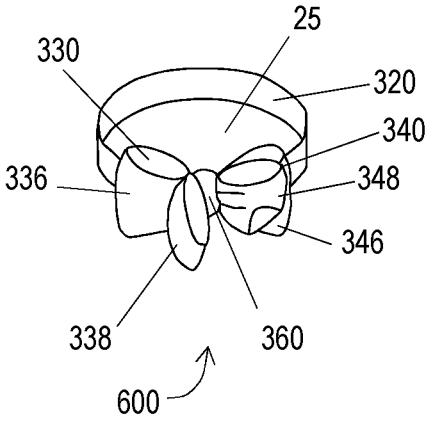

The front loop 338 and back loop 336 of the first blade 330, the front loop 348 and back loop 346 of the second blade 340, and the outside knot 360 are then arranged and straightened ("dressed") so the resulting endless double bow tie 600 approximates the look of an ended bow tie (FIG. 17K). The outside knot 360 constricts the juncture of the neck band 320, the first blade 330 and the second blade 340.

Figure 5C:
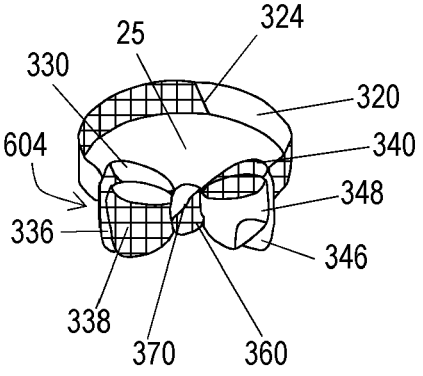
FIG. 5C is a perspective front view of the endless bow tie having double blades, as shown in FIG. 5A, configured from an endless loop comprising contrasting fabrics.

Front views of a Mobius double bow tie 604 are illustrated in FIGS. 5A and 5C, both showing a Mobius twist 370 constrained to an outside knot 360. FIG. 5C illustrates by color shading a possible alternation of fabrics and an associated seam 324. The exemplary color shading does not require color differentiation.

The configured Mobius double bow tie 604 of FIG. 5C includes a neck band 320, a front loop 338 of a first blade 330, a back loop 336 of the first blade 330, a front loop 348 of a second blade 340, a back loop 346 of the second blade 340, an inside knot 350, an outside knot 360, and a Mobius twist 370. The outside knot 360 constricts the juncture of the neck band 320, first blade 330, and second blade 340.

The Mobius double bow tie 604 is tied the same way as the endless double bow tie 600, as shown in FIG. 17. Similar to the Mobius bow tie 300, the Mobius twist 370 may be constrained to be located anywhere in the Mobius double bow tie 604, including the neckband 320, first and second blades 330 and 340, inside and outside knots 350 and 360, and juncture region 380. There is great latitude in turning the blades right-side or inside out, in locating the Mobius twist, and in arranging the knots to present more or less fabric contrast.

Embodiments of a Mobius bow tie ornament 400 are illustrated in FIG. 6. The configured Mobius bow tie ornament 400 comprises a first blade 430, a second blade 440, an outside knot 460, and a Mobius twist 470. See FIG. 6A. FIG. 6B shows an embodiment where the Mobius bow tie ornament is tied directly to a body, in this case a wrist. In some embodiments the Mobius bow tie ornament may be tied to a fastener. The term "fastener" refers to a means for attaching a bowtie or a bowtie ornament to a substrate such a clothing material, a body, hair, or an accessory. In the embodiment of FIG. 6C, a pin fastener 411 attaches a decorative Mobius bow tie ornament 400 to clothing. FIG. 6D shows an embodiment in which a fastener includes a simple hooked closure 412. FIG. 6E shows an embodiment in which a fastener is a carabiner clip 452. FIG. 6F shows an embodiment in which a hair clip 414 called a "French clip" or "banana clip" acts as the fastener. In the embodiment of FIG. 6G, the Mobius bow tie ornament 400 is fastened to a necklace 415. In the embodiment of FIG. 6H, the Mobius bow tie ornament is tied directly about a napkin 416. Other embodiments include Mobius bow tie ornaments with or without fasteners arranged as hair bows, lapel pins, wrist bands, gift ribbon and wrap, and bracelets.

Figure 6A:
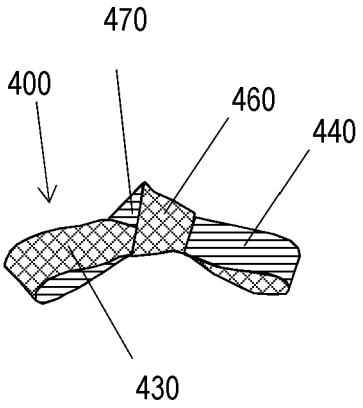
FIGS. 6A through 6H provide perspective views of Mobius bow tie ornaments according to embodiments of the invention.
Figure 6B:
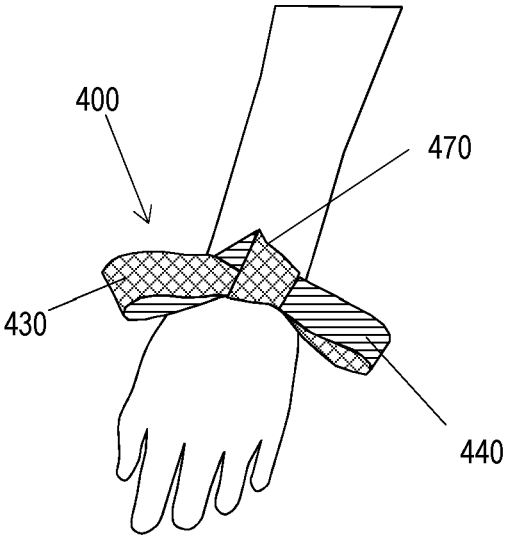
Figure 6C:
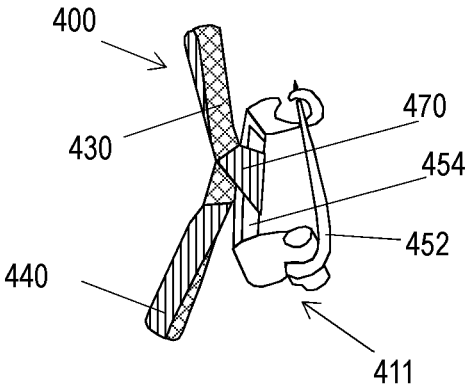
Figure 6D:
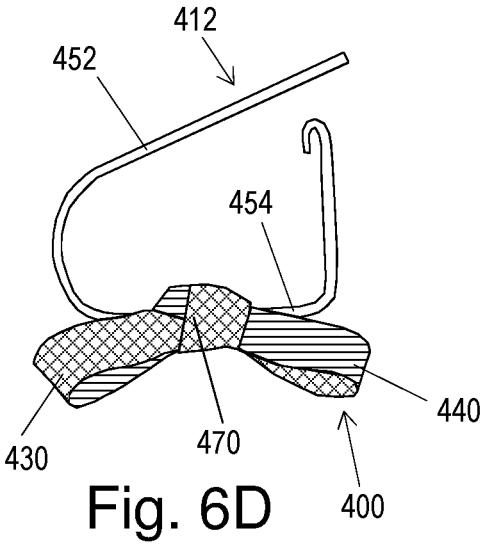
Figure 6E:
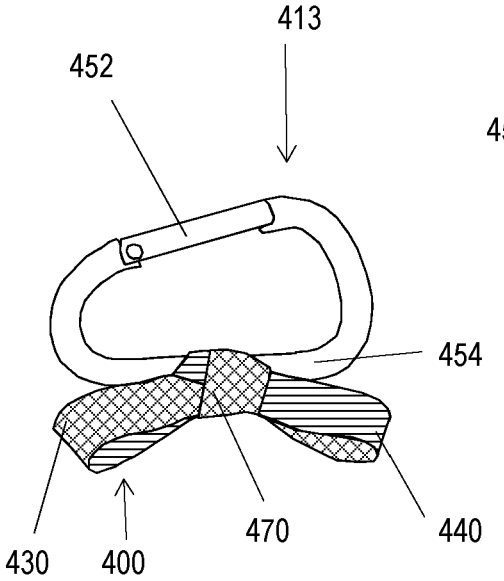
Figure 6F:
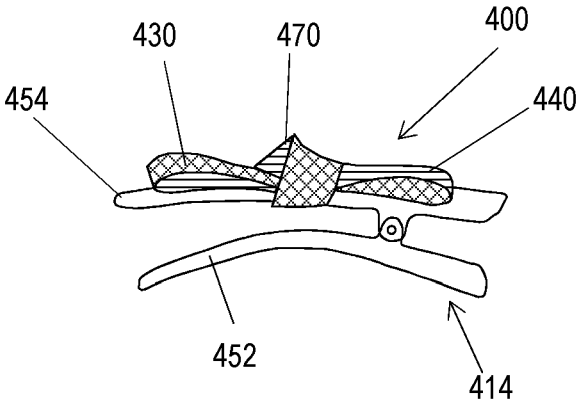
Figure 6G:
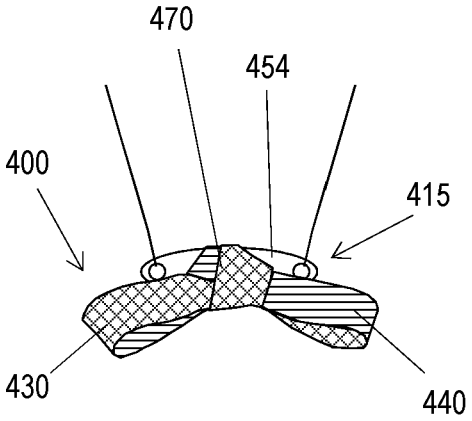
Figure 6H:
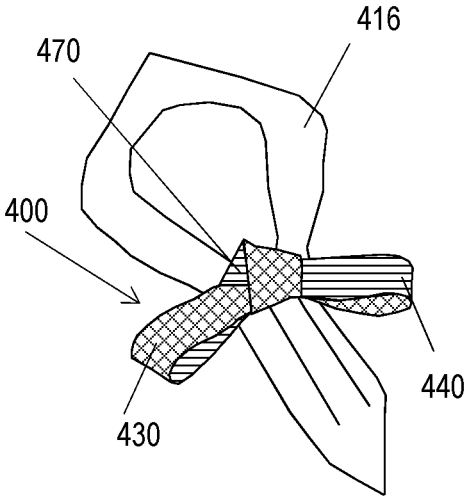

The Mobius bow tie ornament 400 is tied in a similar manner to the Mobius bow tie 300, as shown in FIG. 14 (the overhand knot method) and FIG. 15 (the square knot method). FIGS. 6C, 6D, 6E, 6F, and 6G all show first and second blades parallel to the fastener structure 460. This arrangement is best accomplished with the overhand knot method of FIG. 14. FIGS. 6B and 6H show first and second blades perpendicular to the body structure. This is best accomplished with the square knot method of FIG. 15.

An exemplary method for making an endless or Mobius loop with varying width customized for a plumb neck tie is illustrated in FIGS. 18, 19, 22, and 23. Embodiments of an endless neck tie may be fabricated from multiple strips of fabric formed into an endless tube. However, the invention is not so limited. For example, other embodiments may be fabricated with single strips of material, such as flat strips or extruded tubes that are flattened. Other embodiments comprise combinations of flat strips and tubes to form endless loops, and these may comprise different materials, including use of ribbon for the neckband and "patchwork" designs comprising discrete strips made from multiple pieces of fabric.

Figure 18:
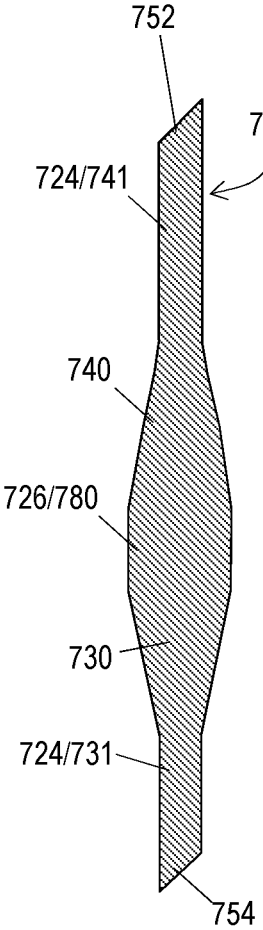
FIG. 18 is a perspective view of a first strip of fabric of varying width during an early stage of fabrication, patterned as a component for an endless plumb neck tie according to an embodiment of the invention.

FIG. 18 illustrates a typical first strip of fabric 721 cut to be joined with a like second strip of fabric to make an endless or Mobius plumb neck tie. The first strip of fabric 721 includes a neckband section 724 and a blade region 726. The neckband section 724 comprises a first neck band sub-section 731 and a second neck band subsection 741. Indicated portions of the blade region 726 correspond to a first blade 730 and a second blade 740. The strip of fabric 721 includes first and second opposing ends 752, 754 which, when combined with corresponding ends of a like second strip 722, as shown in FIGS. 19B-19G, form first and second tube ends 762, 764. See FIGS. 19D-19G. A juncture region 780, located in the blade region 726 demarcates portions corresponding to the first and second blades 730, 740.

FIG. 19 illustrate a sequence of steps by which pieces of fabric are stitched and turned to form a fabric tube 710, which may later be joined to make an endless or Mobius plumb neck tie by the method illustrated in FIGS. 22 and 23. FIG. 19 further illustrate use of a turn assist 709, shown here as a tied loop of thread, to reduce time spent coaxing the widest part of the turned tube to its fullest width for pressing. See FIGS. 19D and 19E.

Figure 19A:
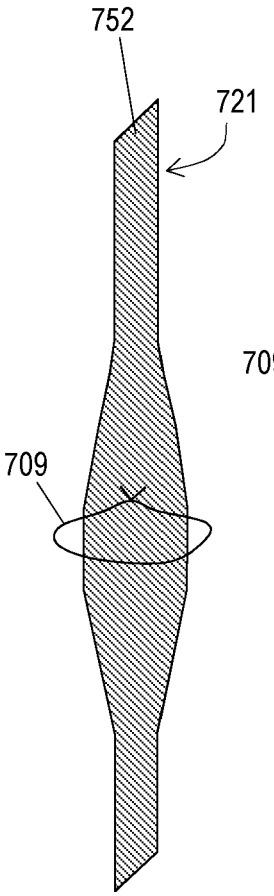
FIGS. 19A through 19G are perspective views illustrating the first strip of FIG. 18 and another strip of fabric in an exemplary sequence of steps to form a tube which can be fashioned into an endless plumb neck tie.
Figure 19B:
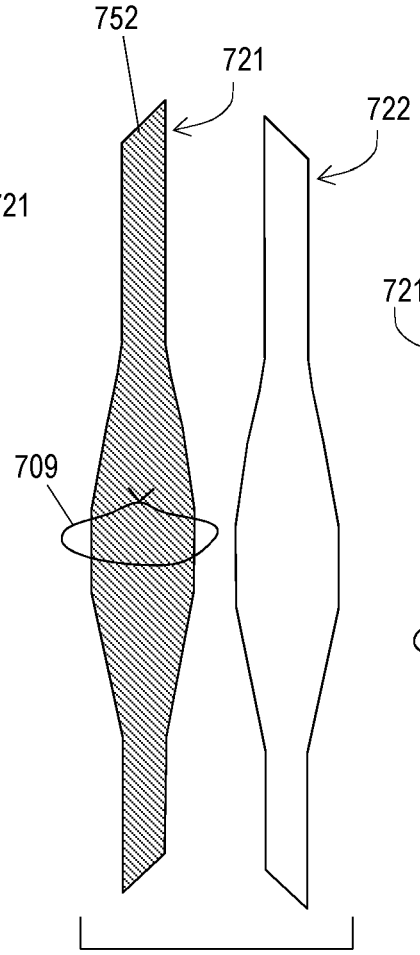
Figure 19C:
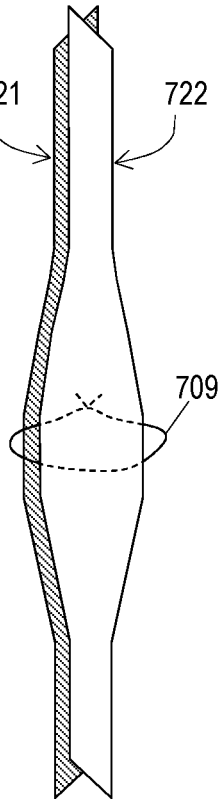
Figure 19D:
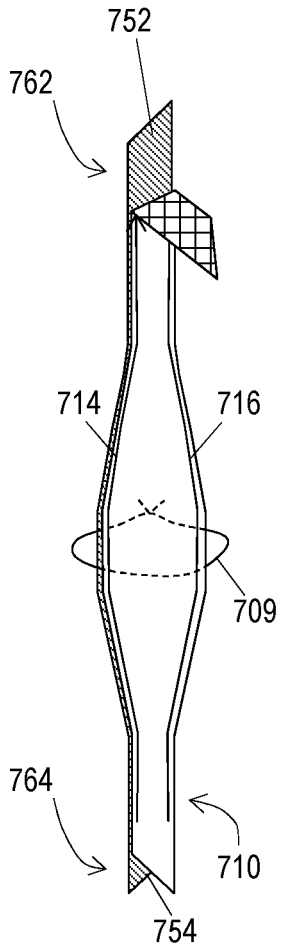
Figure 19E:
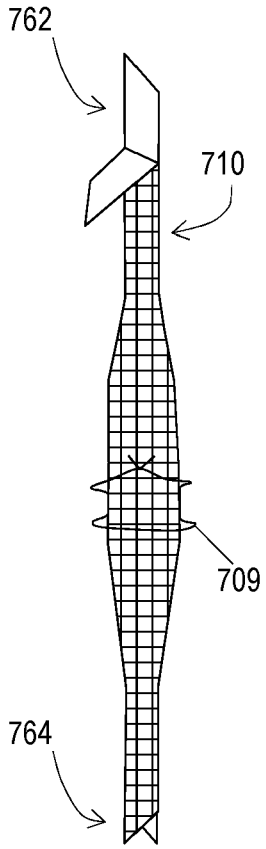
Figure 19F:
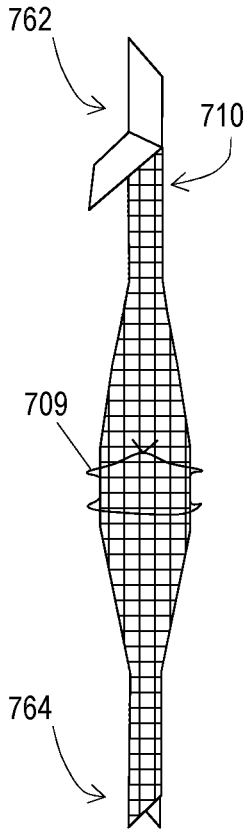
Figure 19G:
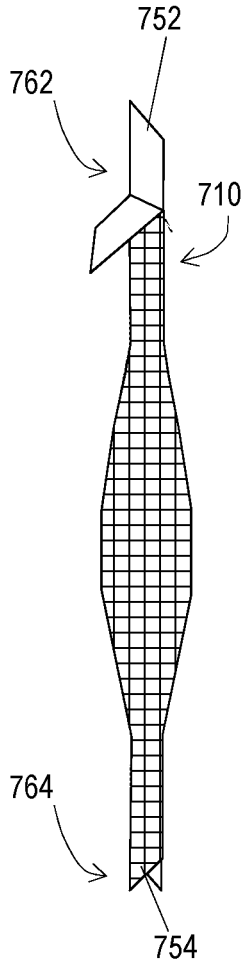

As shown in FIG. 19A, initially a turn assist 709 is placed on the right side of a piece of fabric 721 at its widest part. As shown in FIGS. 19B and 19C, a second piece of fabric 722 is placed right side down on the first piece of fabric 721, sandwiching the turn assist 709 between the two pieces of fabric. As shown in FIG. 19D, the two pieces of fabric are stitched together along elongate edges to form inside-out tube 710, leaving the tube ends 752 and 754 free, and capturing the turn assist 709 in a first edge seam 714 and a second edge seam 716. As shown in FIG. 19E, the tube 710 is turned right-side out, with the turn assist 709 accessible on the outside of tube 710. By pulling the turn assist 709, the tube 710 is pulled wide for pressing, as shown in FIG. 19F. With seams pressed and turn assist 709 cut away as shown in FIG. 19G, tube 710 is complete and ready for joining of ends 752, 754 to make an endless or Mobius plumb neck tie by the method illustrated in FIGS. 22 and 23. FIG. 19G shows an exemplary embodiment of a tubular strip (prior to joining of the ends 752, 754) for an endless or Mobius loop with varying width, customized for endless and Mobius plumb neck ties, e.g. with variations in shape, width and length, as well as where and how to join tube ends 752, 754 to make a twisted or untwisted loop.

An exemplary method for making an endless or Mobius loop with varying width customized for endless and Mobius bow ties is illustrated in FIGS. 20, 21, 22, and 23. FIGS. 20A and 20B illustrate, respectively, a tied top view and an unrolled view of a prior art one-sided bow tie 390 which, when tied, has a tab 391 on one side of a knot and a blade 392 on the other side of the knot. FIGS. 20C and 20D are, respectively, a tied top view and an unrolled view of an endless or Mobius loop with varying width customized for endless and Mobius bow ties 200. FIGS. 20C and 20D illustrate the endless bow tie 200 or Mobius bow tie 300 according to an embodiment of the invention which, when tied, has a first blade 330, a second blade 340, a juncture region 380, an outside knot 360 and a neckband 320. The neckband includes a first neckband portion 331, a second neckband portion 341, a first tube end 352 and a second tube end 354. FIGS. 20E and 20F illustrate, respectively, a tied top view and an unrolled view of a prior art bow tie 395 which, when tied, has a tab 391 and a blade 392 on each side of a knot. FIGS. 20G and 20H illustrate, respectively, a tied top view and an unrolled view of the double endless bow tie 600 or double Mobius bow tie 604 which, when tied, presents as having pairs of blade loops (336, 338 and 346, 348) on each side of a knot 360.

Figure 20A:
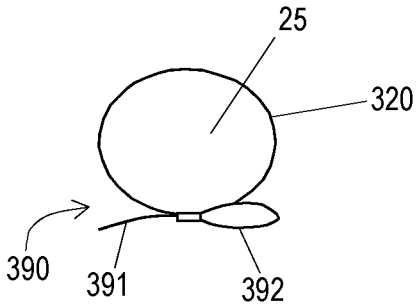
Fig. 20A Prior Art
FIGS. 20A through 20H are views of an endless loop or Mobius loop of varying width according to embodiments of the invention, with comparable views of prior art, where.
Figure 20C:
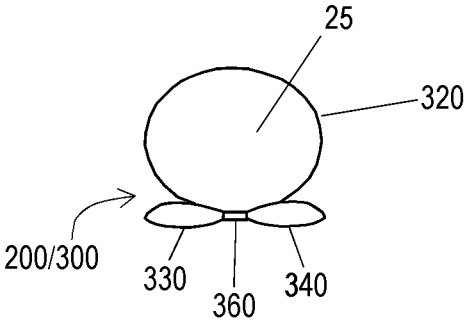
Figure 20B:
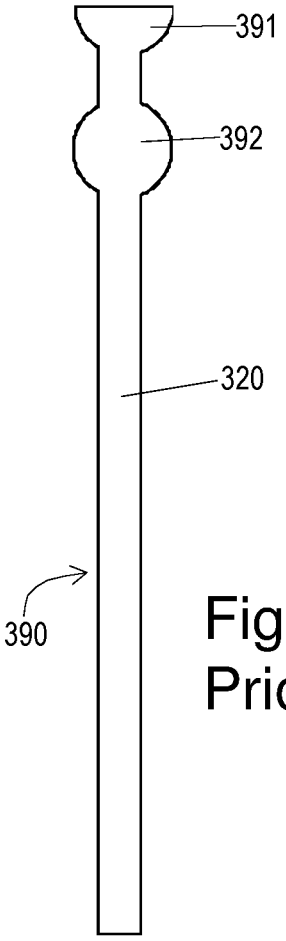
Fig. 20B Prior Art
Figure 20D:
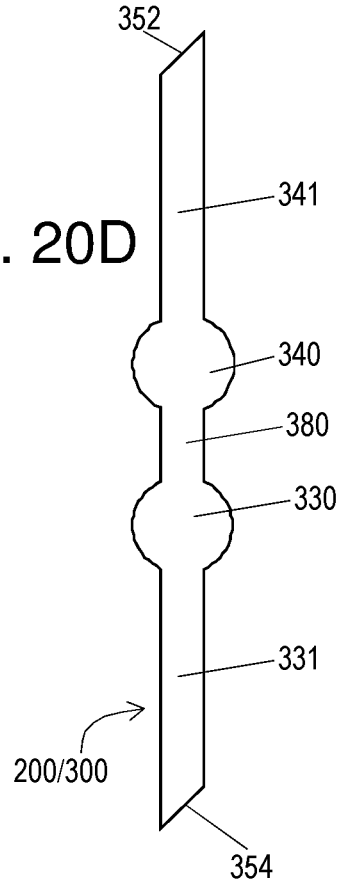
Figure 20E:
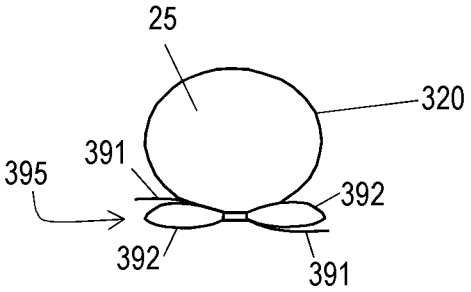
Fig. 20E Prior Art
Figure 20G:
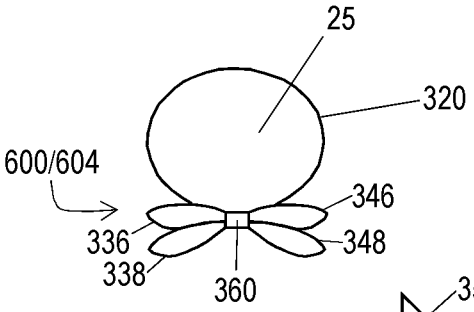
Figure 20F:
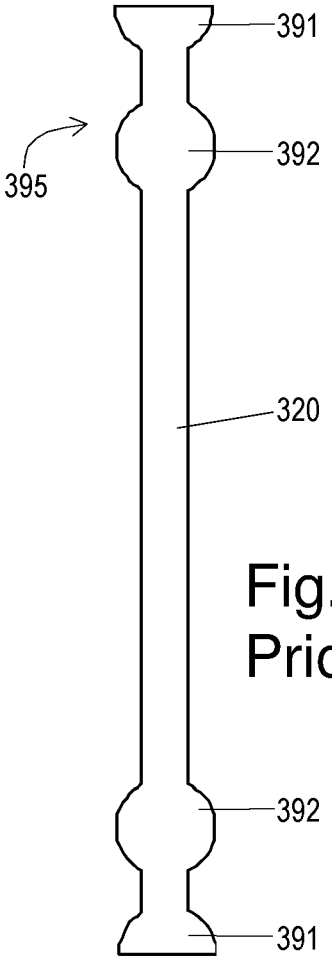
Fig. 20F Prior Art
Figure 20H:
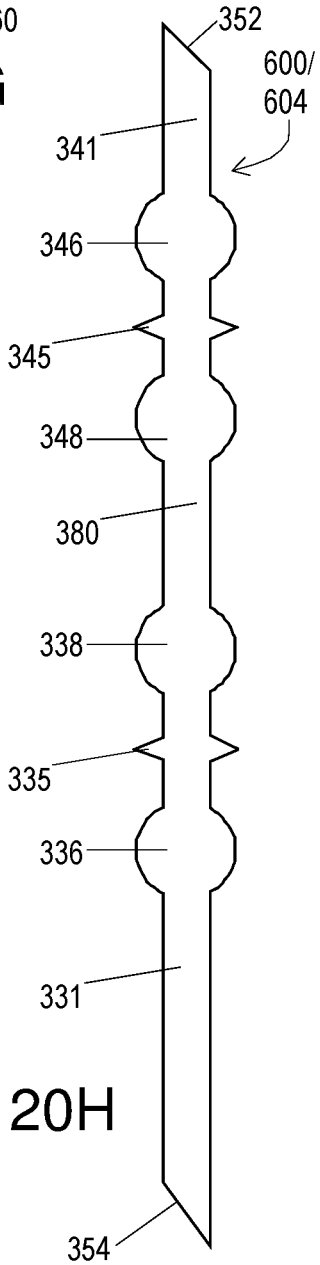

An ended prior art bow tie 395 comprising tabs 391 on each side, blades 392 on each side, a neckband 320, and an outside knot 360, is shown tied in the top view of FIG. 20E and in the unrolled view of FIG. 20F. A double endless bow tie 600 and double Mobius bow tie 604, according to embodiments of the invention are shown tied in the top view of FIG. 20G and in the unrolled view of FIG. 20H. The bow tie 600 or 604 each, when tied, comprises a neckband, a first front blade 338, a first back blade 336, first notches 335, a second front blade 348, a second back blade 346, second notches 345, a juncture region 380, and an outside knot 360. The tied top view FIG. 20G illustrates the neckband 320. With reference to the unrolled view of FIG. 20H, the neckband includes a first neck band sub-section 331, a first tube end 352, a second neck band sub-section 341, and a second tube end 354.

Figure 21A:
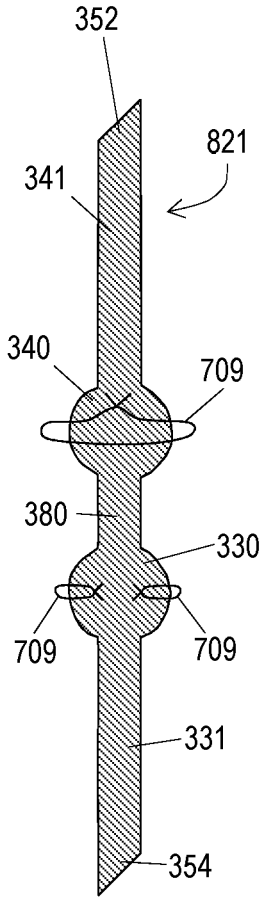
FIG. 21A is a perspective view of a first strip of material of varying width during an early stage of fabrication, patterned as a component for an endless untwisted or Mobius bow tie according to an embodiment of the invention.
Figure 21B:
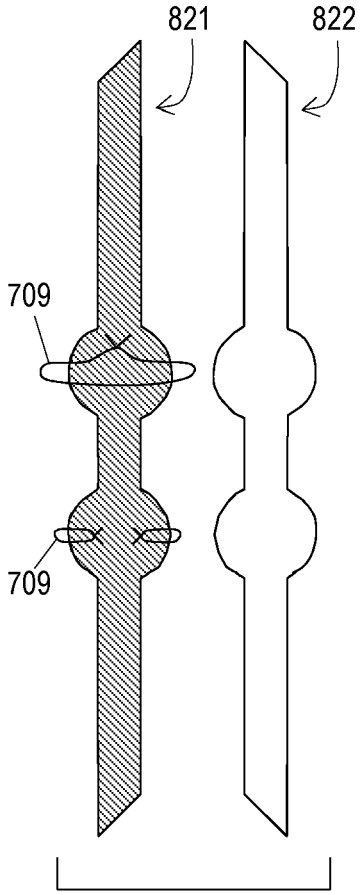
FIGS. 21B through 21G are perspective views illustrating the first strip of FIG. 21A and another strip of material in an exemplary sequence of steps to form a tube which can be fashioned into an endless untwisted or Mobius bow tie.
Figure 21C:
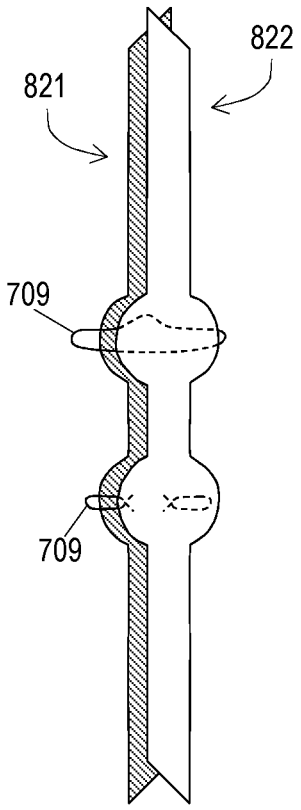
Figure 21D:
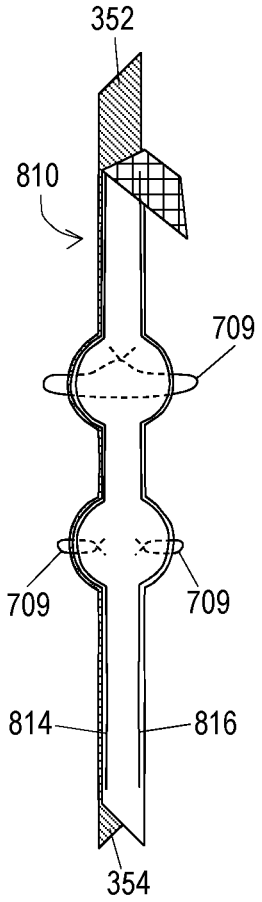
Figure 21E:
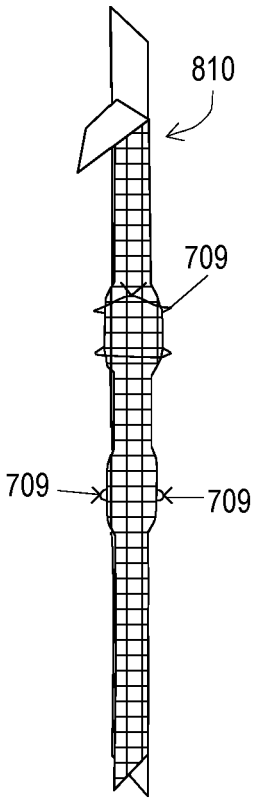
Figure 21F:
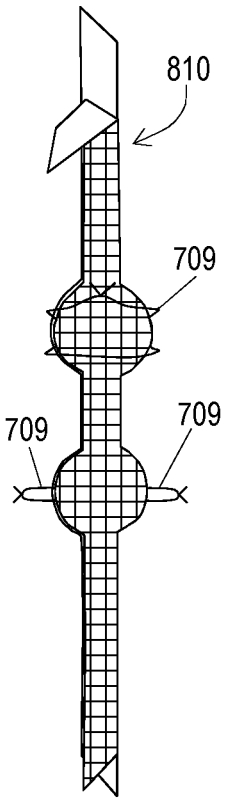

FIGS. 21A-21G illustrate a sequence of steps by which pieces of fabric are stitched and turned to form a fabric tube 810, which may later be joined at opposing ends 352, 354 to make an endless or Mobius bow tie by the method illustrated in FIGS. 22 and 23. FIG. 21 further illustrate the use of turn assists 709, shown here as tied loops of thread, to reduce time spent coaxing the widest part of a turned fabric tube 810 to its fullest width for pressing, as shown in FIGS. 21E and 21F.

Figure 21G:
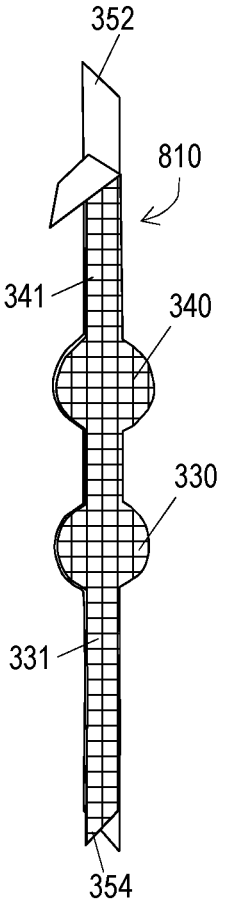

As shown in FIG. 21A, initially turn assists 709 are placed on the right side of a piece 821 of fabric at its widest parts, where piece 821 has been cut as in FIG. 20D. As shown in FIGS. 21B and 21C, a second piece of fabric 822 is placed right side down on the first piece of fabric 821, sandwiching the turn assists 709 between the two pieces of fabric. As shown in FIG. 21D, the two pieces of fabric are stitched along opposing elongate edges with presentation sides together to form inside-out tube 810, leaving the tube ends 352 and 354 open, and capturing the turn assists 709 in a first edge seam 814 and a second edge seam 816. A turn assist may be caught in one seam, e.g. blade 330 is shown with two short turn assists 709 each crossing one edge; or, a turn assist may be caught in more than one seam, e.g. blade 340 is shown with one long turn assist 709 crossing two edges. As shown in FIG. 21E, the tube 810 is turned right-side out, with the turn assists 709 accessible on the outside of tube 810. By pulling the turn assists 709, the tube 810 is pulled wide for pressing, as shown in FIG. 21F. With seams pressed and the turn assists 709 cut away as shown in FIG. 21G, the tube 810 is complete and ready for joining of the ends 352, 354 to make an endless or Mobius bow tie by the method illustrated in FIGS. 22 and 23. FIG. 21G shows a typical embodiment of an endless or Mobius loop with variations in shape, width and length, as well as where and how to join ends 352, 354 of the tube to make a twisted or untwisted loop.

Figure 22A:
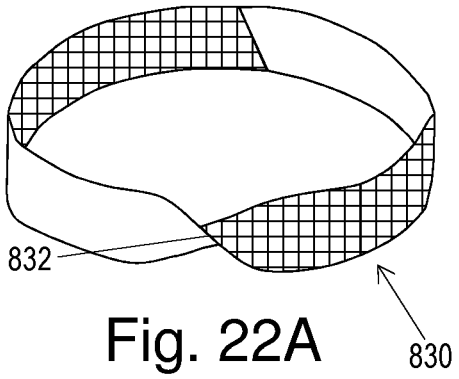
FIGS. 22A, 22B, and 22C are perspective front views of, respectively, a right-handed Mobius loop, a left-handed Mobius loop, and an untwisted endless loop, illustrating the chirality convention used to describe embodiments of the invention.
Figure 22B:
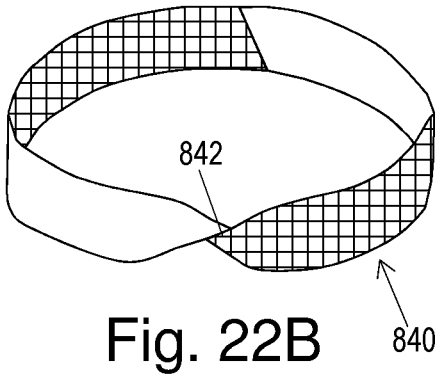
Figure 22C:
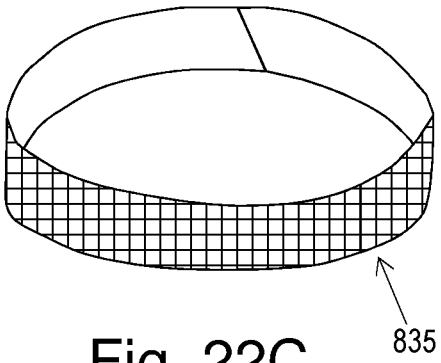

FIG. 22 illustrate the chirality (i.e., the "handedness") of various endless and Mobius loops. In the United States a typical screw or bolt is likely to exhibit a "right-hand" orientation, that is, it has screw threads presenting as "\\\\" ("backslash"). A right-hand screw is driven in a right-hand manner and is referred to as being right-handed. On the other hand, a screw or bolt from a toilet handle, from the left pedal of a bicycle, or from one half of a turnbuckle may exhibit a "left-hand" orientation, i.e., it has screw threads presenting as "/ / / /" ("forward slash"). A left-hand screw is referred to as being left-handed or having a "left-hand" orientation, and is driven in a left-handed manner. With this convention in mind, Mobius loops presenting as "==\==" are described as right-handed, and Mobius loops presenting as "==/==" are described as left-handed. Embodiments of the invention include both non-chiral (untwisted) loops and both right-handed and left-handed twists. FIG. 22A shows a right-handed Mobius loop 830 with a right-handed Mobius twist 832, FIG. 22B shows a left-handed Mobius loop 840 with a left-handed Mobius twist 842, and FIG. 22C shows a non-chiral endless loop 850. Individuals might favor left-handed or right-handed Mobius plumb neck ties or bow ties, and otherwise wonder why seemingly identical Mobius plumb neck ties or bow ties might differ in ease of use.

FIG. 23 illustrate a sequence of steps by which a fabric tube 510 may be configured to form an endless fabric tube or endless loop or Mobius loop 500, selecting twist chirality from FIG. 22. While variation in width is not illustrated in fabric tube 510 in FIG. 23, the exemplary method shown in FIG. 23 of making an endless fabric tube from a fabric tube applies as well to fabric tubes with varying width, such as fabric tube 710 of FIG. 19G and fabric tube 810 of 21G.

Figure 23A:
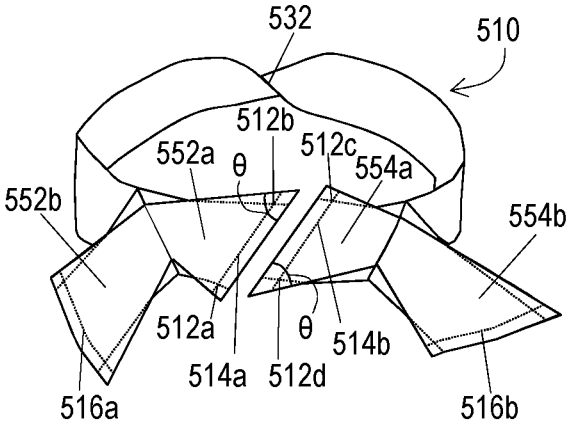
FIGS. 23A through 23I are perspective front views of a partially fabricated endless neck tie according to an embodiment of the invention, illustrating a sequence of steps to join opposing tube ends of an endless untwisted loop or Mobius loop, with staggered widthwise ends.
Figure 23B:
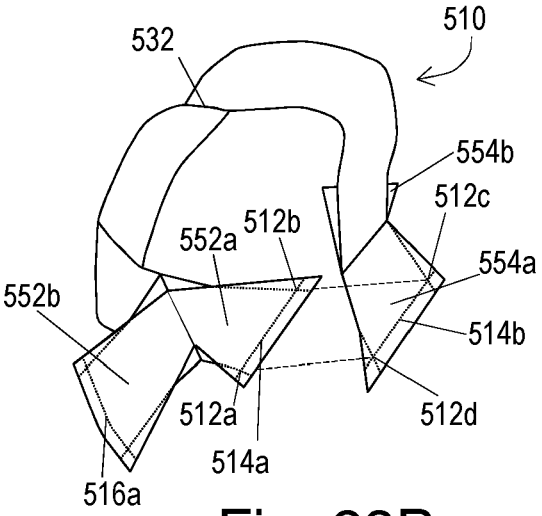

Ends 552*a*, 552*b*, 554*a*, and 554*b* are cut identically at a slant angle between 20 and 70 degrees, here illustrated as a slant angle Θ of 45 degrees, with respect to the strip edge. By cutting all four ends identically, each end may accept stitching to an opposite end, regardless of whether right twist (as in FIG. 22A), left twist (as in FIG. 22B), or no twist (as in FIG. 22C) is applied to the strip. FIG. 23A shows an exemplary right twist 532 in fabric tube 510. FIG. 23A shows ends 552*a* and 554*a* near each other, with their respective end seam lines 514*a* and 514*b* parallel to each other. Ends 552*b* and 554*b* are held out of the way. FIG. 23A shows the fabric reverse side of all four ends 552*a*, 552*b*, 554*a*, and 554*b*. End seam lines 514*a*, 514*b*, 516*a*, and 516*b*, are positioned on ends 552*a*, 554*a*, 552*a*, and 554*a*, respectively. Points where end seam lines intersect with edge seam lines provide effective "register marks" for positioning edges together for seaming; e.g., seam line intersection 512*a* is shown at the obtuse angle of end 552*a*, seam line intersection 512*b* is shown at the acute angle of end 552*a*, seam line intersection 512*c* is shown at the obtuse angle of end 554*a*, and seam line intersection 512*d* is shown at the acute angle of end 554*a*. In the view of FIG. 23B, end 554*a* is shown turned down so that the fabric presentation side of the end 554*a* is showing, with the presentation side of the end 554*a* facing the presentation side of the end 552*a*. In this configuration, the edge of the end 554*a* is again positioned parallel to the edge of the end 552*a*.

Figure 23C:
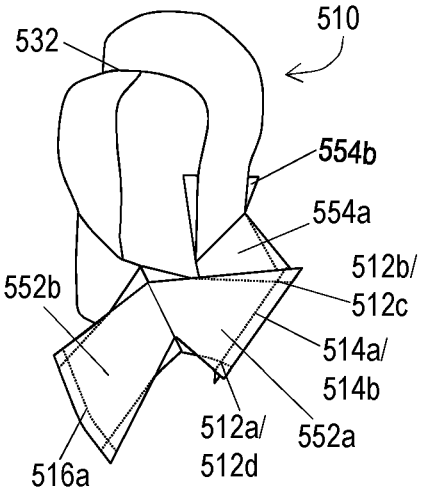
Figure 23D:
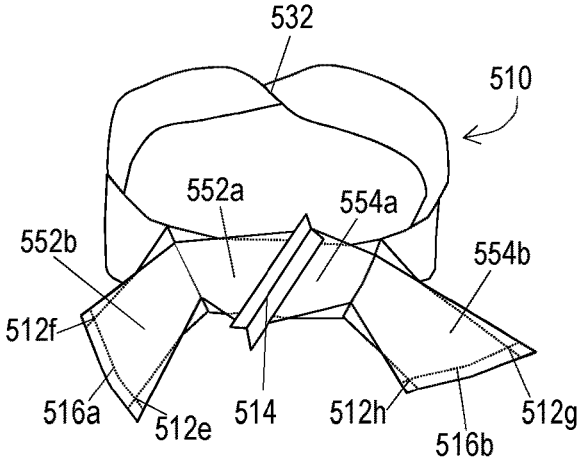

In FIG. 23C, end 552*a* is translated over end 554*a*, presentation sides facing each other, so that the seam line intersection 512*b* is positioned over intersection 512*c*, and intersection 512*a* is positioned over intersection 512*d*; and seam line 514*a* is positioned over seam line 514*b*. Ends 552*a* and 554*a* are stitched together along seam lines 514*a* and 514*b*, to make seam 514. FIG. 23D shows seam 514 pressed open. FIG. 23D shows the fabric reverse side of all four ends 552*a*, 552*b*, 554*a*, and 554*b*. Seam line intersection 512*f* is shown at the obtuse angle of end 552*b*, seam line intersection 512*e* is shown at the acute angle of end 552*b*, seam line intersection 512*h* is shown at the obtuse angle of end 554*b*, and seam line intersection 512*g* is shown at the acute angle of end 554*b*.

Figure 23E:
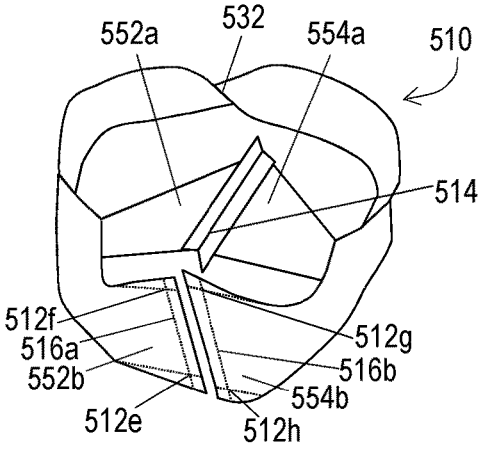
Figure 23F:
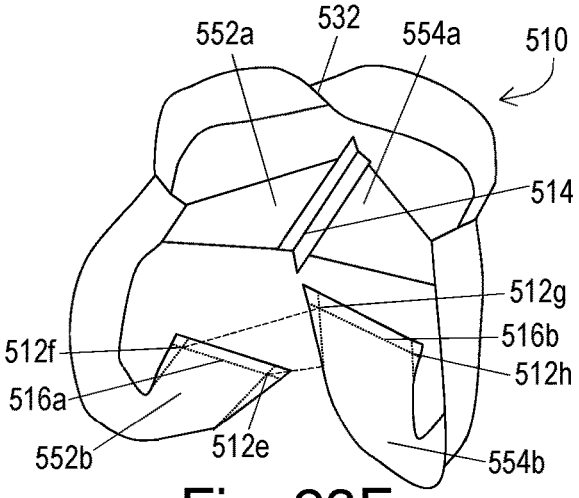
Figure 23G:
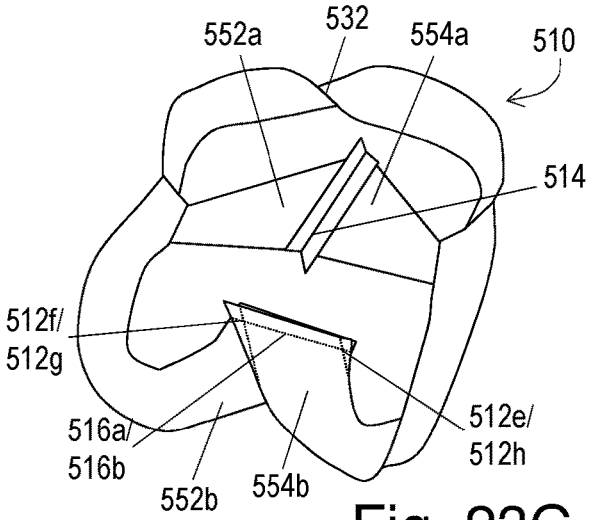
Figure 23H:
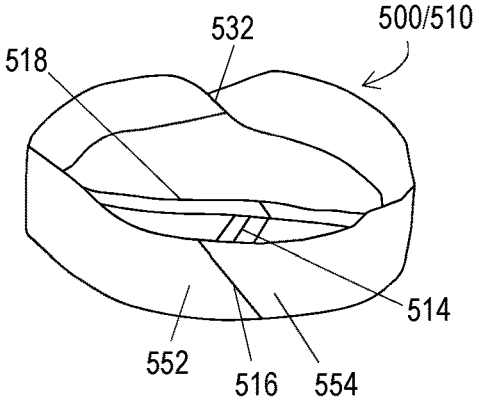
Figure 23I:
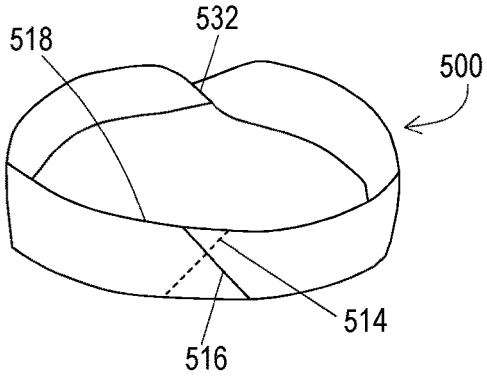
Figure 24A:
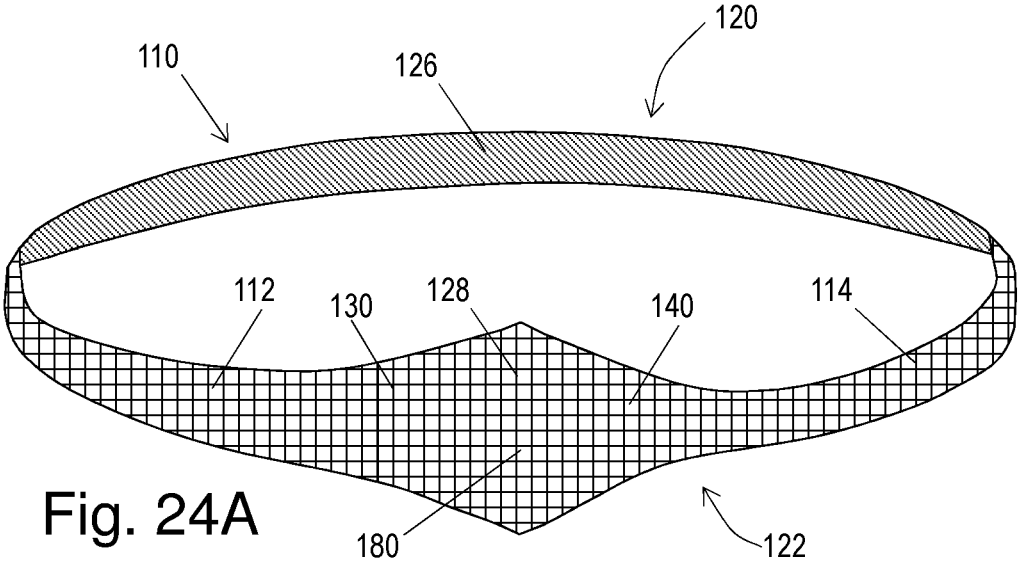
FIGS. 24A and 24B are front perspective views of an endless loop of varying width customized for, respectively, an endless untwisted plumb neck tie and a Mobius plumb neck tie.
Figure 24B:
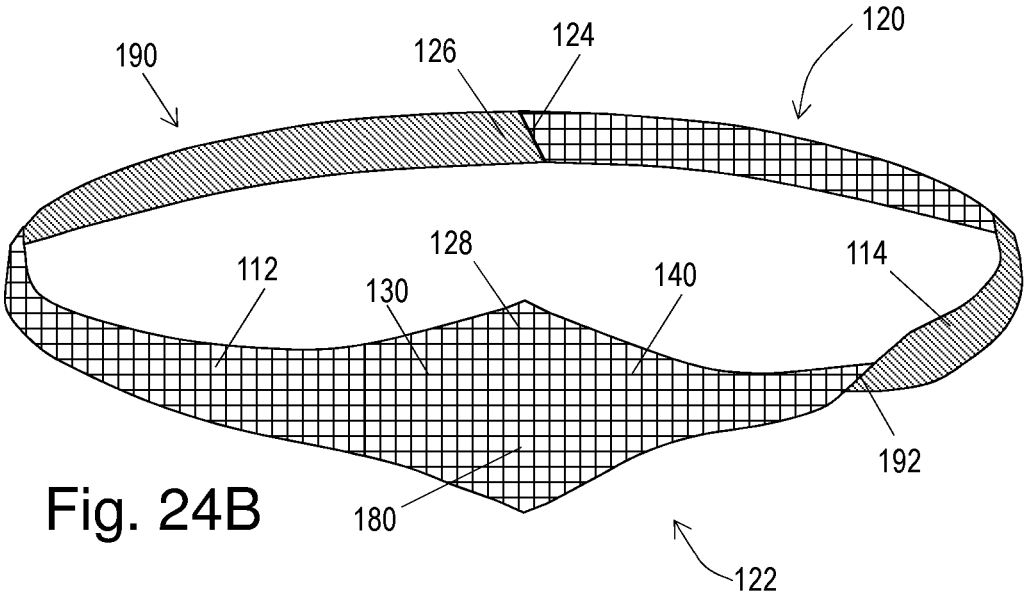
Figure 25A:
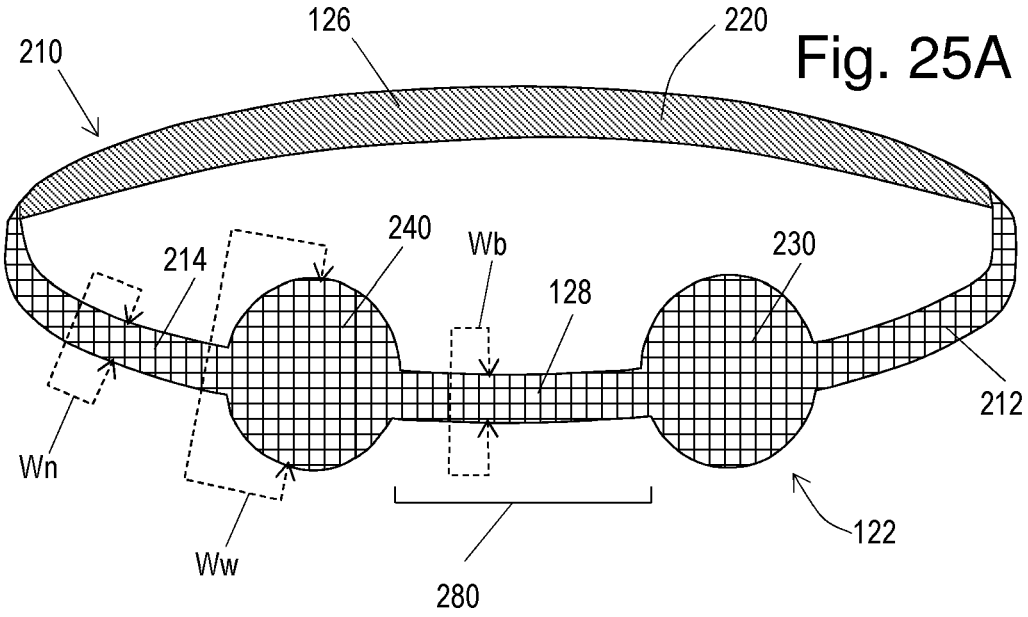
FIGS. 25A and 25B are front perspective views of an endless loop of varying width customized for, respectively, an endless untwisted bow tie and a Mobius bow tie.
Figure 25B:
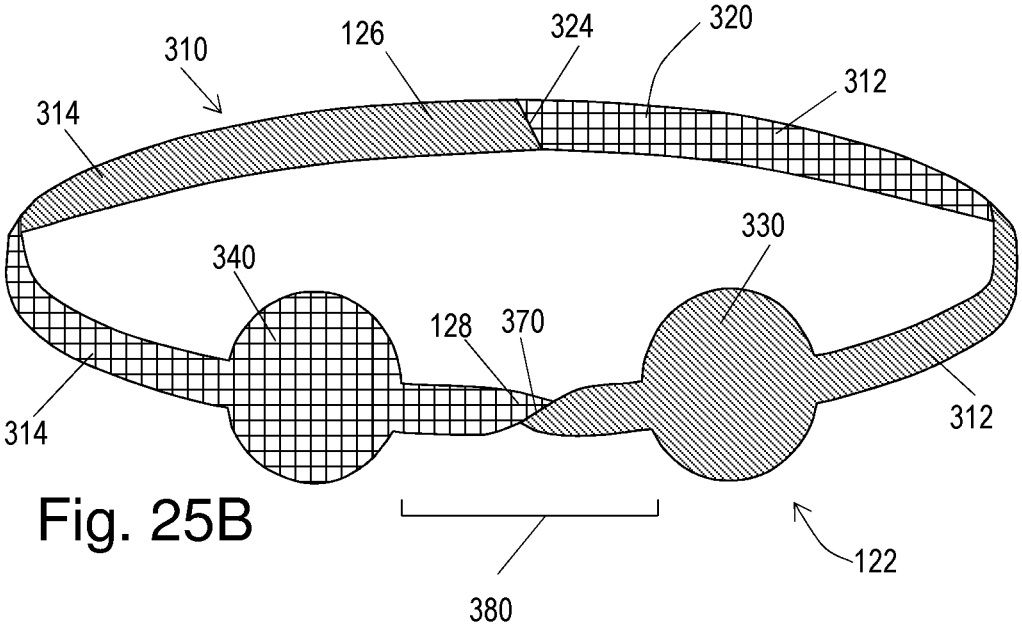

FIG. 23E shows ends 552*b* and 554*b* near each other, with their respective seam lines 516*a* and 516*b* parallel to each other. Ends 552*a* and 554*a* are pulled up and out of the way. FIG. 23E shows the fabric presentation side of ends 552*b* and 554*b*. In the view of FIG. 23F, end 554*b* is shown turned up so that the reverse side of the end 554*a* is showing, with the presentation side of the end 554*b* facing the presentation side of the end 554*b*. In this configuration, the edge of the end 554*b* is again positioned parallel to the edge of the end 552*b*. In FIG. 23G, end 554*b* is translated over end 552*b*, presentation sides facing each other, so that seam line intersection 512*g* is positioned over 512*f*, and 512*h* is positioned over 512*e*; and seam line 516*b* is positioned over 516*a*. Ends 552*b* and 554*b* are stitched together along seam lines 516*a* and 516*b*, to make seam 516. Seam 516 is pressed open. FIG. 23H shows edge fabric turned to the inside of the loop along an edge seam line 518, with the transformation of tube 510 to endless tube 500 nearly complete. Finishing stitches along edge seam line 518 complete loop 500, as shown in FIG. 231. The method as illustrated results in seam 516 crossing seam 514 in a staggered or offset manner, to avoid an otherwise bulky seam. FIGS. 24A and 24B show, respectively, an endless loop 110 with varying width customized for an endless plumb neck tie 100 (FIG. 24A), and a Mobius loop 190 with varying width customized for a Mobius plumb neck tie 194 (FIG. 24B) with Mobius twist 192 and seam 124. FIGS. 25A and 25B show respectively, an endless loop 210 with varying width customized for endless bow tie 200 (FIG. 25A), and a Mobius loop 310 with varying width customized for Mobius bow tie 300 (FIG. 25B) with Mobius twist 370 and seam 324. When an endless loop such as loop 110, 190, 210, or 310 is in the shape of a circle, as shown in the front perspective views in FIGS. 24A, 24B, 25A, and 25B, a juncture position 128, in the juncture region 180, 280, or 380 along a blade portion 122 having a wide width along the endless loop, is diametrically opposed to a neckband position 126 along a neckband segment 120, 220, or 320 having a narrow width relative to a blade portion 122. The blade portion 122 includes the juncture region 180, 280, or 380 (i) integrally formed with first and second blades 130, 140 of the second segment to meet with the blades 130, 140; or (ii) integrally formed with the first and second blades 230, 240 or 330, 340 of the second segment to terminate about the bridge 280 or 380 which includes a juncture position 128. The width of the two blades may vary asymmetrically as a function of distance from the juncture position 128. For numerous embodiments, the reference to blades as being integrally formed and the reference to a juncture region and blades as being integrally formed means that the components are formed along the same piece of material.

In FIG. 25A, the neckband section 220 includes a narrow width, Wn, and the blade section 122 includes a wide width, Ww, relative to the narrow width Wn of the neckband section, with which at least a first blade and a second blade of the wearable bow tie can be configured for presentation, the blade section 122 also including the juncture region 280 also referred to as a bridge 280 connecting the first blade and the second blade. The bridge has a width, Wb, narrower than the wide width Ww of the blade portion, the bridge 280 demarcating the first blade from the second blade.

Figure 26:
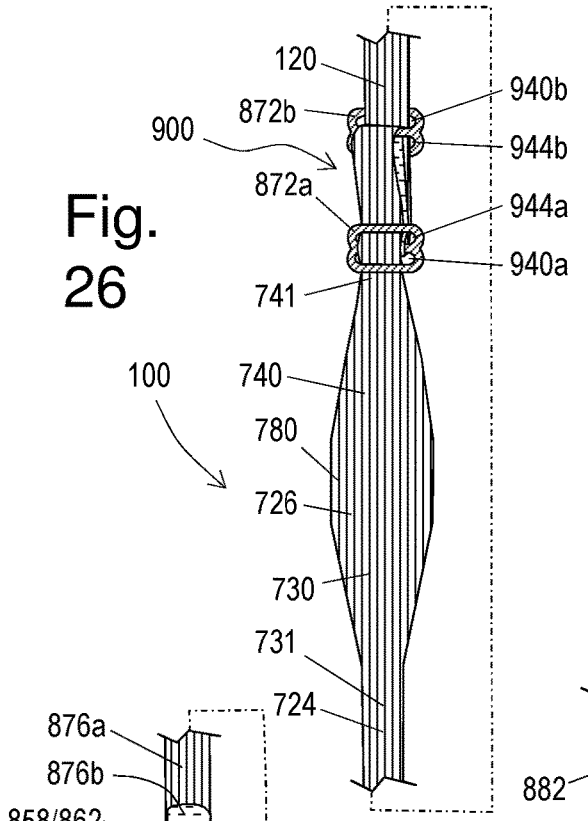
FIG. 26 is a view of an endless plumb necktie incorporating an adjustment mechanism for the length of an endless neckband using slide hardware according to an embodiment of the invention.

FIG. 26 is a view of an endless plumb necktie 100 comprising a combination of slide hardware with an endless neckband 120 to adjust the length of the endless neckband 120, according to embodiments of the invention. Although this embodiment of the invention comprises two figure-8 slides 872 (referred to as slides 872*a* and 872*b*), other combinations of the slides shown in FIG. 30 may be incorporated in this tie. The neck tie 100 includes a blade region 726 comprising material of a relatively wide width with which integrally connected first and second blades 730 and 740 are formed. The blade region 726 includes a juncture region 780 for variably demarcating the integrally connected first and second blades 730 and 740 from one another. The neckband 120, also referred to as a neckband section 724, includes a first neck band sub-section 731 which transitions to the first blade 730, and a second neck band sub-section 741 which transitions to the second blade 740. The portion of the neckband 120 corresponding to the second sub-section 741 passes through both openings in the first figure-8 slide 872*a*, then passes through both openings in the second figure-8 slide 872*b*, then once more passes through both openings in the first figure-8 slide 872*a*, then once more passes through both openings in the second figure-8 slide 872*b*, at which point the portion of the neckband corresponding to the first sub-section 731 transitions to the first blade 730.

Figure 29A:
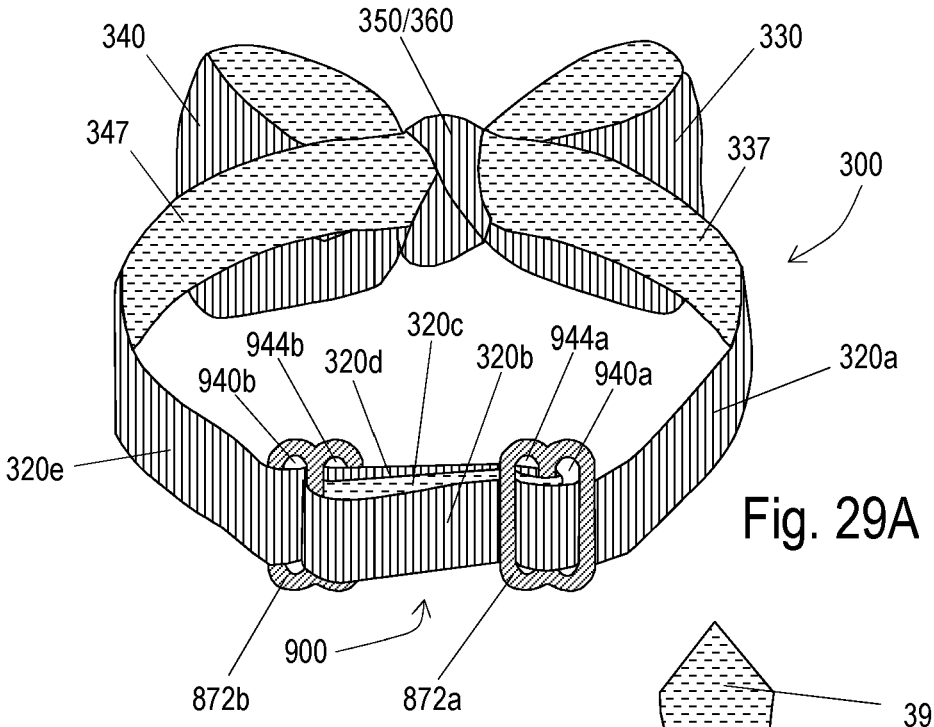
FIGS. 29A and 29B are perspective rear views of, respectively, an endless bow tie and an ended bow tie, each incorporating an adjustable-length neckband according to an embodiment of the invention.
Figure 29B:
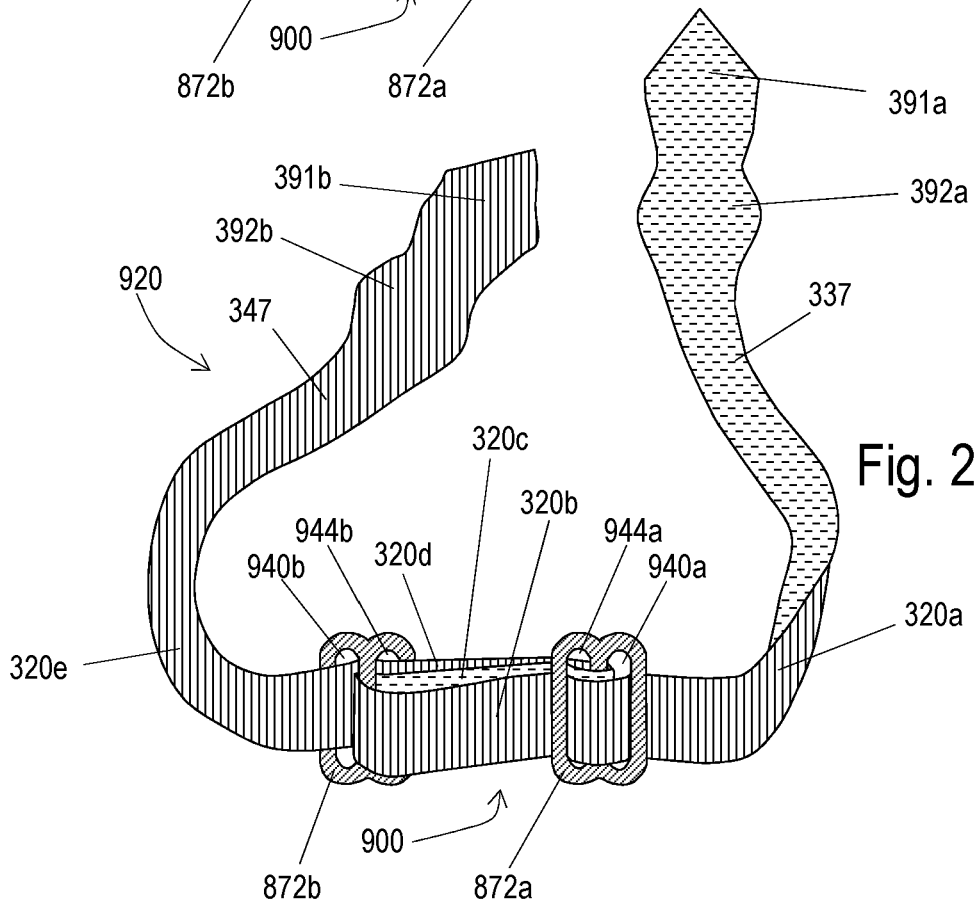
Figure 30A:
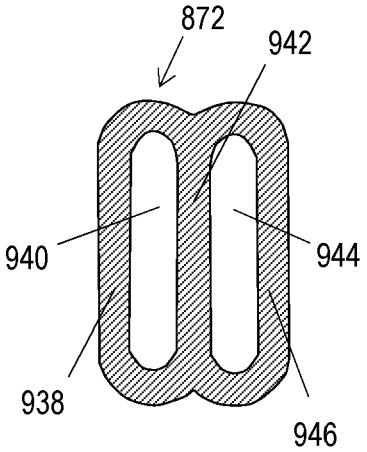
Prior Art Fig. 30A
FIGS. 30A through 30D illustrate front views of length adjustment hardware suitable for use with neck bands of ended and endless neck ties according to embodiments of the invention, where.
Figure 30B:
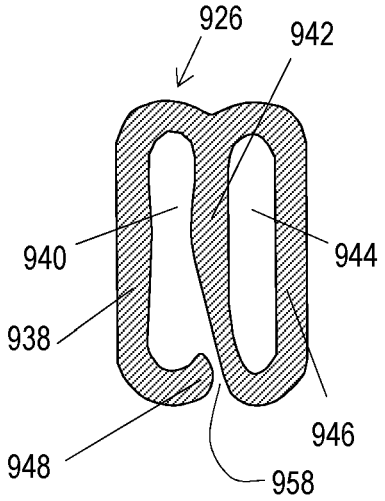
Prior Art Fig. 30B
Figure 30C:
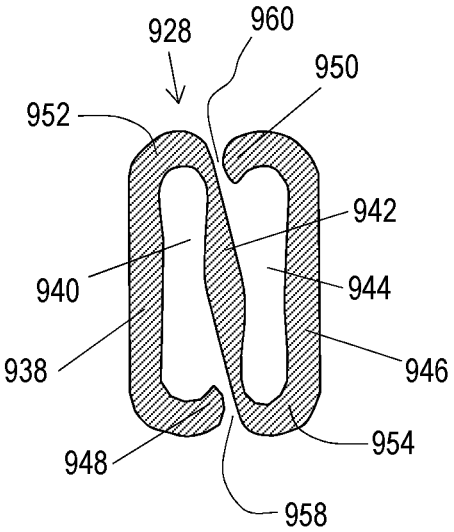
Figure 30D:
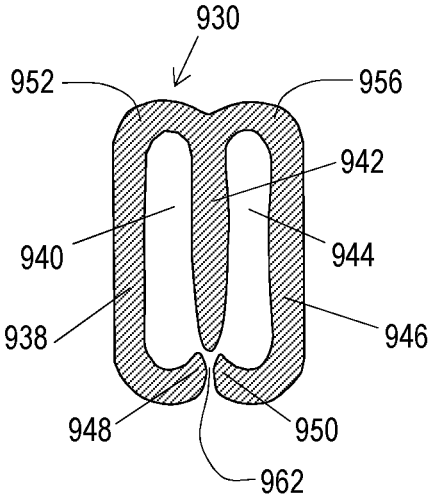

Although FIGS. 27 through 29 illustrate plumb neckties comprising figure-8 slides 872 shown in FIG. 30, other slides shown in FIGS. 30B-30D may be used. FIG. 27A illustrates a plumb necktie 860 with integrally connected blades, with a T-hook (also referred to as T-hook hardware, or T-hardware) for neckband size adjustment. The neck tie 860 includes a blade region 726 comprising material of a relatively wide width with which integrally connected first and second blades 730 and 740 are formed. The blade region 726 includes a juncture region 780 for variably demarcating the integrally connected first and second blades 730 and 740 from one another. The neckband 120, also referred to as a neckband section 724, includes a first neck band sub-section 866 which transitions to the part of the blade region 726 corresponding to the first blade 730 of the configured neck tie 860, and a second neck band sub-section 868 which transitions to the part of the blade region 726 corresponding to the second blade 740 of the configured neck tie 860.

For purposes of illustrating the path of the neckband 120 passing through a ring 862 and into the T-hook 864, the first neck band sub-section 866 is illustrated as a series of serially connected neck band sub-sections 866*a*, 866*b*, 866*c* and 866*d*, and the second neck band sub-section 868 is illustrated as a series of serially connected neck band subsections 868*a* and 868*b*. The first neck band sub-section 866*a* transitions from the first blade 730 to connect to a second neck band sub-section 866*b* which has size adjustment slits 863. The second neck band sub-section 866*b* extends into the ring 862, from which the third neck band sub-section 866*c* overlaps neck band sub-section 866*b* and extends into an opening in the T-hardware 864, with the fourth neck band sub-section 866*d* looping back along the third neck band sub-section 866*c*. The fourth neck band subsection 866*d* may be stitched against or otherwise attached to the rear or front side of the third neck band sub-section 866*c* to form a closed loop.

In use, T-hardware 864 is engaged through a slit 863 chosen to customize the neck size of necktie 860. Necktie 860 is an endless loop including the neckband section 865 with connectable opposing ends, first end 866 connected to second opposing end 868 via ring 862 at connection point 858, including an adjustment mechanism which variably overlaps part of the neckband portion 866 with itself to adjust the length of the endless loop as the segment 866*c* overlaps neck band sub-section 866*b*.

Figure 27A:
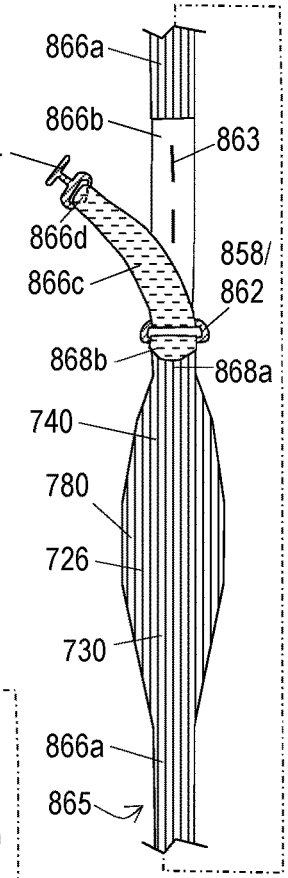
FIGS. 27A through 27D are views of a plumb necktie with integrally connected blades, each view incorporating an adjustment or closure mechanism according to an embodiment of the invention.
Figure 27B:
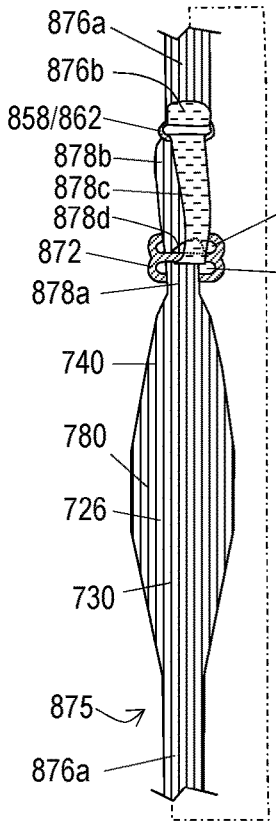

FIG. 27B illustrates a plumb necktie 870 with integrally connected blades, with a figure-8 slide 872 for neckband size adjustment, and a blade region 726 corresponding to first and second blades 730 and 740 of the configured neck tie. The blade region 726 includes a juncture region 780 for variably demarcating integrally connected first and second blades 730 and 740, from one another. The neckband 120, also referred to as a neckband section 724, includes a first neck band sub-section 876 which transitions to the part of the blade region 726 corresponding to the first blade 730 of the configured neck tie 870, and a second neck band sub-section 878 which transitions to the part of the blade region 726 corresponding to the second blade 740 of the configured neck tie 870. For purposes of illustrating the path of the neckband 120 through a ring 862 and the slide 872, the first neck band sub-section 876 is illustrated as serially connected neck band sub-sections 876*a* and 876*b*, and the second neck band sub-section 878 is illustrated as serially connected neck band sub-sections 878*a*, 878*b*, 878*c* and 878*d*.

The first neck band sub-section 876*a* transitions from the first blade 730 to extend into the ring 862, with the second neck band sub-section 876*b* looping back along the first neck band sub-section 876*a*. The second neck band sub-section 876*b* may be stitched against or otherwise attached to the rear or front side of the first neck band subsection 876*a*. The second neck band sub-section 878 first neck band sub-section 878*a* transitions from the second blade 740 through first and second channels 940, 944 of the figure-8 slide 872, from which the second neck band sub-section 878*b* extends through the ring 862, from which the third neck band sub-section 878*c* overlaps neck band subsection 878*b* and extends through one of the channels 940, 944 then through the other of the channels 940, 944 of the figure-8 slide 872, with the fourth neck band sub-section 878*d* looping back along the third neck band sub-section 876*c*. The fourth neck band sub-section 876*d* may be stitched against or otherwise attached to the rear or front side of third neck band sub-section 876*c* to form a closed loop.

In use, the figure-8 slide 872 is moved along neckband second portion 878 to customize the size of necktie 870. Plumb necktie 870 is an endless loop including the neckband section 875 with connectable opposing ends, first end 876 connected to second opposing end 878 via ring 862 at connection point 858, including an adjustment mechanism which variably overlaps part of the neckband portion 878 with itself to adjust the length of the endless loop as the segment 878*c* overlaps neck band sub-section 878*b*.

Figure 27C:
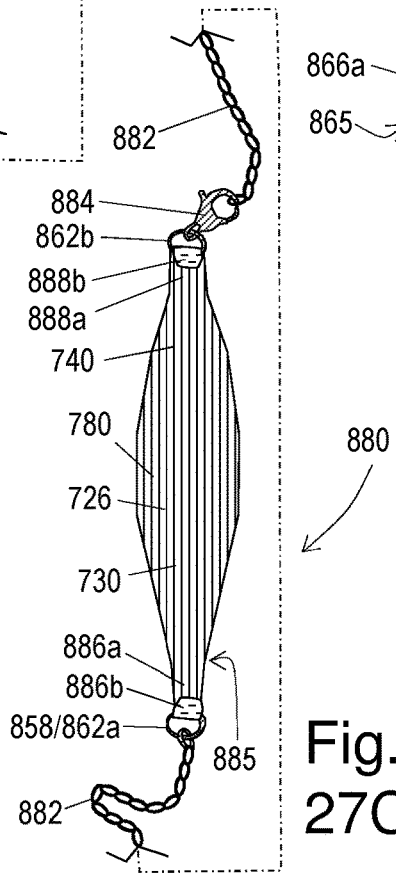

FIG. 27C illustrates a plumb necktie 880 with integrally connected blades, with a closure and chain for neckband size adjustment. The neck tie 880 includes a blade region 726 comprising material of a relatively wide width with which integrally connected first and second blades 730 and 740 are formed. The blade region 726 includes a juncture region 780 for variably demarcating the integrally connected first and second blades 730 and 740 from one another. The neckband 120, also referred to as a neckband section 724, includes a first neck band sub-section 886 which transitions to the part of the blade region 726 corresponding to the first blade 730 of the configured neck tie 880, and a second neck band sub-section 888 which transitions to the part of the blade region 726 corresponding to the second blade 740 of the configured neck tie 880. For purposes of illustrating the path of the neckband 120 through a ring 862, also referred to as first ring 862*a* and second ring 862*b*, the first neck band sub-section 886 is illustrated as a series of serially connected neck band sub-sections 886*a* and 886*b*, and the second neck band subsection 888 is illustrated as serially connected neck band sub-sections 888*a* and 888*b*. The first neck band sub-section 886*a* transitions from the first blade 730 to extend into the first ring 862*a*, with the second neck band sub-section 886*b* looping back along the first neck band sub-section 886*a*. The second neck band sub-section 886*b* may be stitched against or otherwise attached to the rear or front side of first neck band subsection 886*a* to form a closed loop. A flexible member such as a chain 882 is attached to ring 862*a*.

The first neckband sub-section 888*a* of the second neckband sub-section 888 transitions from the second blade 740 to extend into the second ring 862*b*, with the second neck band sub-section 888*b* looping back along the first neck band sub-section 888*a*. The second neck band sub-section 888*b* may be stitched against or otherwise attached to the rear or front side of first neck band sub-section 888*a* to form a closed loop. A closure device, illustrated here as a lobster claw clasp 884, is attached to ring 862*b*. Ring 862*b*, chain 882, and lobster claw clasp 884 are part of neckband second portion 888. In use, the lobster claw clasp 884 overlaps the chain 882 and is attached through a link of the chain 882 at a position so as to customize the neck size of necktie 880. Plumb necktie 880 is an endless loop including the neckband section 885 with connectable opposing ends, first end 886 connected to second opposing end 888 via ring 862*a* at connection point 858, including an adjustment mechanism which variably overlaps part of the neckband portion 878 with itself to adjust the length of the endless loop as the lobster claw clasp 884 overlaps chain 882.

Figure 27D:
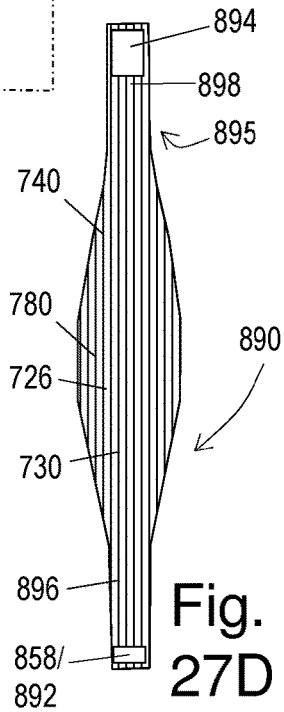

FIG. 27D illustrates a plumb necktie 890 with integrally connected blades, with a hook-and-loop closure assembly comprising a hook portion 892 and a loop portion 894 for neckband size adjustment. The neck tie 890 includes a blade region 726 comprising material of a relatively wide width with which integrally connected first and second blades 730 and 740 are formed. The blade region 726 includes a juncture region 780 for variably demarcating integrally connected first and second blades 730, 740, from one another. The neckband 120, also referred to as a neckband section 724, includes a first neck band sub-section 896 which transitions to the part of the blade region 726 corresponding to the first blade 730 of the configured neck tie 890, and a second neck band sub-section 898 which transitions to the part of the blade region 726 corresponding to the second blade 740 of the configured neck tie 890. The hook portion 892 is attached to neckband first sub-section 896 and the loop portion 894 is attached to neckband second sub-section 898. The loop portion 894 is shown larger than the hook portion 892 so that, in use, the hook portion 892 may be variably positioned along the loop portion 894 so as to customize the size of necktie 890. An additional loop portion may be attached on a second side (not shown) of necktie 890, opposite loop portion 894, allowing choice of chirality by providing the option to attach the hook portion 892 to either the first or second side of necktie 890. Plumb necktie 890 is an endless loop including the neckband section 895 with connectable opposing ends, first end 896 connected to second opposing end 898 via hook-and-loop closure at connection point 858, including an adjustment mechanism which variably overlaps part of the neckband 885 with itself to adjust the length of the endless loop as the hook-and-loop hook portion 892 overlaps hook-and-loop loop portion 894.

Figure 28A:
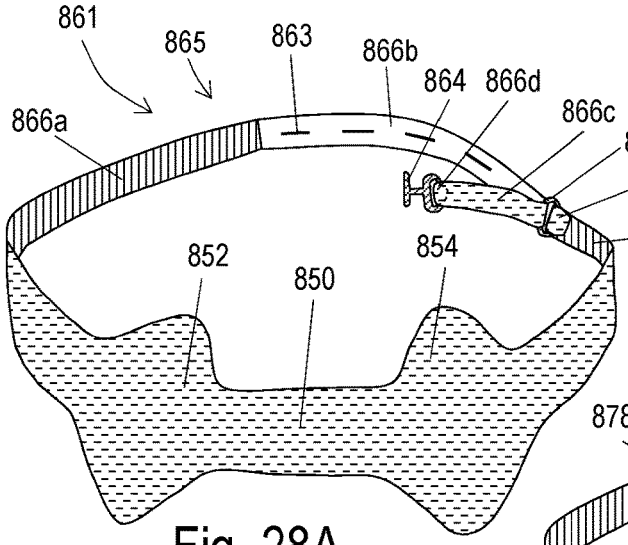
FIGS. 28A through 28D are views of a bridged bow tie according to embodiments of the invention, each view incorporating an adjustment or closure mechanism.

FIG. 28A illustrates a bridged bow tie 861 with a T-hook for neckband size adjustment. The bridged bow tie 861 includes serially-connected first blade 852 of a relatively wide width, bridge 850 of a relatively narrow width, and second blade 854 of a relatively wide width. The bridged bow tie 861 includes a neckband section 865 including a first neck band sub-section 866 which transitions to the first blade 852 of the configured bow tie 861, and a second neck band sub-section 868 which transitions to the second blade 854 of the configured bow tie 861. For purposes of illustrating the path of the neckband 865 through a ring 862 and into a T-hook 864, the first neck band subsection 866 is illustrated as a series of serially connected neck band sub-sections 866*a*, 866*b*, 866*c* and 866*d*, and the second neck band sub-section 868 is illustrated as a series of serially connected neck band sub-sections 868*a* and 868*b*. The first neck band subsection 866*a* transitions from the first blade 852 to connect to a second neck band subsection 866*b* which has size adjustment slits 863. The second neck band sub-section 866*b* extends into the ring 862, from which the third neck band sub-section 866*c* overlaps neck band sub-section 866*b* and extends into an opening in the T-hook 864, with the fourth neck band sub-section 866*d* looping back along the third neck band sub-section 866*c*. The fourth neck band sub-section 866*d* may be stitched against or otherwise attached to the rear or front side of the third neck band sub-section 866*c* to form a closed loop. In use, T-hook 864 is engaged through a slit 863 chosen to customize the neck size of necktie 860. Although the T-hook 864 illustrated in FIGS. 27A and 28A may be referred to as hardware, composition of T-hooks used to practice the invention is not limited to any particular metallic or non-metallic material. The T-hook may, for example, be formed of a metal or a plastic.

Bow tie 861 is an endless loop including the neckband section 865 with connectable opposing ends, first end 866 connected to second opposing end 868 via ring 862 at connection point 858, including an adjustment mechanism which variably overlaps part of the neckband portion 866 with itself to adjust the length of the endless loop as the segment 866*c* overlaps neck band sub-section 866*b*.

Figure 28B:
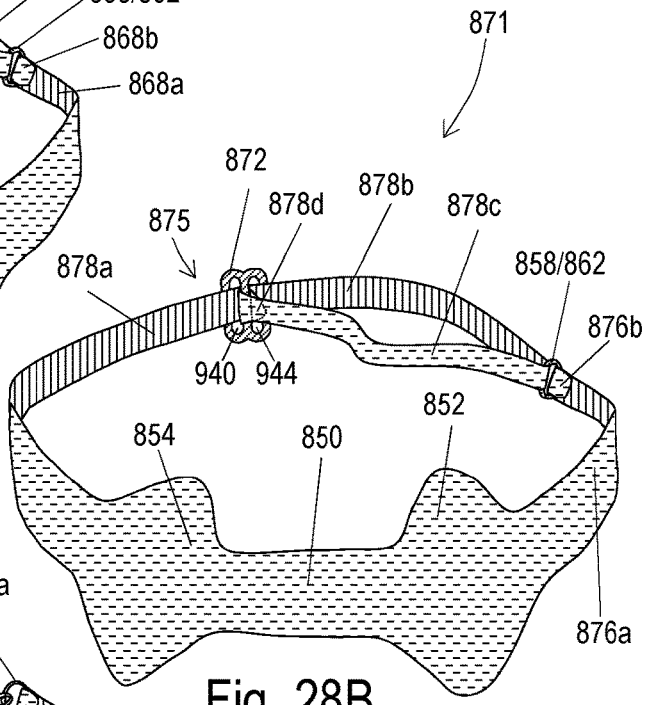

FIG. 28B illustrates a bridged bow tie 871 with a figure-8 slide for neckband size adjustment. The bridged bow tie 871 includes serially-connected a first blade 852 of a relatively wide width, a bridge 850 of a relatively narrow width, and a second blade 854 of a relatively wide width. The bridged bow tie 871 includes a neckband section 875 including a first neck band sub-section 876 which transitions to the first blade 852 of the configured bow tie 871, and a second neck band sub-section 878 which transitions to the second blade 854 of the configured bow tie 871. For purposes of illustrating the path of the neckband 865 through a ring 862 and the slide 872, the first neck band sub-section 876 is illustrated as serially connected neck band sub-sections 876*a* and 876*b*, and the second neck band sub-section 878 is illustrated as a series of serially connected neck band sub-sections 878*a*, 878*b*, 878*c* and 878*d*. The first neck band sub-section 876*a* transitions from the first blade 852 to extend into the ring 862, with the second neck band sub-section 876*b* looping back along the first neck band sub-section 876*a*. The second neck band sub-section 876*b* may be stitched against or otherwise attached to the rear or front side of the first neck band sub-section 876*a*. The first neck band sub-section 878*a* of second neck band sub-section 878 transitions from the second blade 854 through first and second channels 940, 944 of the figure-8 slide 872, from which the second neck band sub-section 878*b* extends through the ring 862, from which the third neck band subsection 878*c* extends through one of the channels 940, 944 then through the other of the channels 940, 944 of the figure-8 slide 872, with the fourth neck band sub-section 878*d* looping back along the third neck band sub-section 876*c*. The fourth neck band subsection 876*d* is stitched against or otherwise attached to the rear or front side of third neck band sub-section 876*c* to form a closed loop. In use, the figure-8 slide 872 is moved along neckband second portion 878 to customize the size of bridged bow tie 861. Bow tie 871 is an endless loop including the neckband section 875 with connectable opposing ends, first end 876 connected to second opposing end 878 via ring 862 at connection point 858, including an adjustment mechanism which variably overlaps part of the neckband portion 878 with itself to adjust the length of the endless loop as the segment 878*c* overlaps neck band sub-section 878*b*.

Figure 28C:
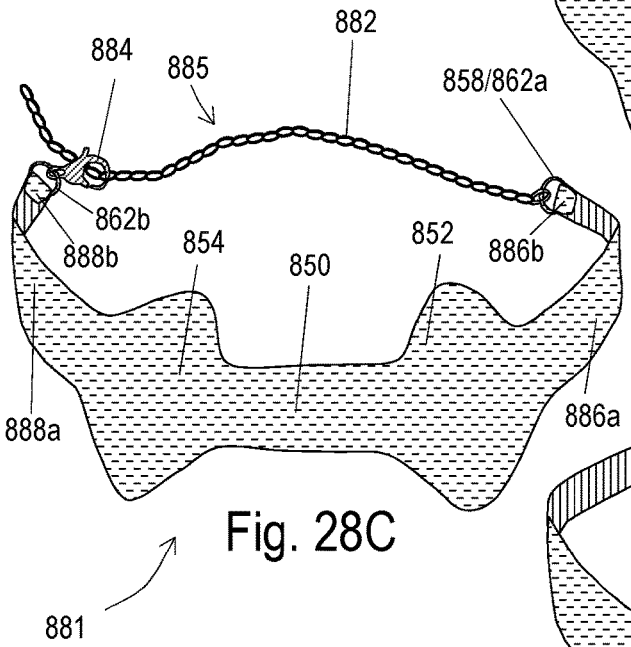

FIG. 28C illustrates a bridged bow tie 881 with a closure and chain for neckband size adjustment. The bridged bow tie 881 includes serially-connected a first blade 852 of a relatively wide width, a bridge 850 of a relatively narrow width, and a second blade 854 of a relatively wide width. The bridged bow tie 881 includes a neckband section 885 including a first neck band sub-section 886 which transitions to the first blade 852 of the configured bow tie 881, and a second neck band sub-section 888 which transitions to the second blade 854 of the configured bow tie 881. For purposes of illustrating the path of the neckband 885 through a first ring 862*a* and a second ring 862*b*, the first neck band sub-section 886 is illustrated as serially connected neck band sub-sections 886*a* and 886*b*, and the second neck band sub-section 888 is illustrated as serially connected neck band sub-sections 888*a* and 888*b*. The first neck band sub-section 886*a* transitions from the first blade 852 to extend into the first ring 862*a*, with the second neck band sub-section 886*b* looping back along the first neck band sub-section 886*a*. The second neck band sub-section 886*b* is stitched against or otherwise attached to the rear or front side of first neck band sub-section 886*a* to form a closed loop. A flexible member such as a chain 882 is attached to the ring 862*a*. The first neckband sub-section 888*a* of the second neckband sub-section 888 transitions from the second blade 854 to extend into the second ring 862*b*, with the second neck band sub-section 888*b* looping back along the first neck band sub-section 888*a*. The second neck band sub-section 888*b* is stitched against or otherwise attached to the rear or front side of first neck band sub-section 888*a* to form a closed loop. A closure device, illustrated here as a lobster claw clasp 884, is attached to the ring 862*b*. The ring 862*b*, the chain 882 and the lobster claw clasp 884 are part of the neckband second portion 888. In use, the lobster claw clasp 884 captures a link in the chain 882, being attached through a link of the chain 882 selected at a chain position so as to customize the neck size of bridged bow tie 881. Bow tie 881 is an endless loop including the neckband section 885 with connectable opposing ends, first end 886 connected to second opposing end 888 via ring 862*a* at connection point 858, including an adjustment mechanism which variably selects part of the chain 882 with the lobster claw clasp 884 to adjust the length of the endless loop.

Figure 28D:
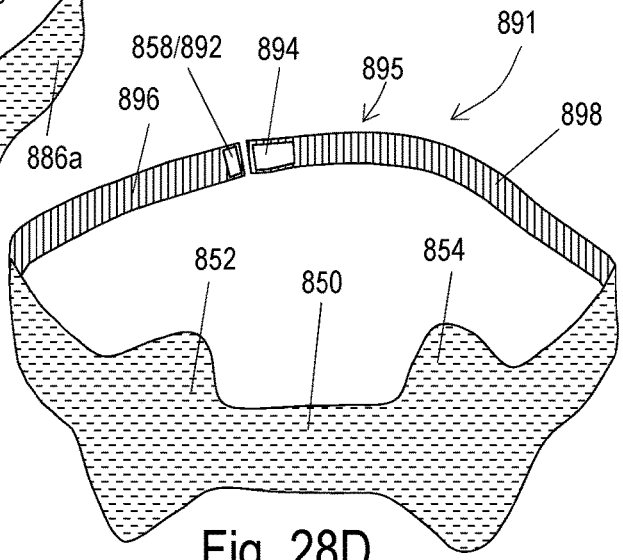

FIG. 28D illustrates a bridged bow tie 891 with a hook-and-loop closure assembly, comprising hook portion 892 and a loop portion 894 for neckband size adjustment. The bridged bow tie 891 includes serially-connected a first blade 852 of a relatively wide width, a bridge 850 of a relatively narrow width, and a second blade 854 of a relatively wide width. The bridged bow tie 891 includes a neckband section 895 including a first neck band portion 896 which transitions to the first blade 852 of the configured bow tie 891, and a second neck band portion 898 which transitions to the second blade 854 of the configured bow tie 891. The first blade 852 is attached to the neckband first portion 896 of the configured bow tie 891, and the second blade 854 is attached to the neckband second portion 898 of the configured bow tie 891. The hook-and-loop closure assembly is attached to the neckband first and second portions 896 and 898, such that one neckband portion receives the hook portion 892 of hook-and-loop closure assembly and the other neckband portion receives the loop portion 894 of hook-and-loop closure assembly. FIG. 28D shows the hook portion 892 attached to neckband first portion 896 on the first side of bow tie 891, and the loop portion 894 attached to neckband second portion 898 on the first side of bow tie 891. The loop portion 894 is shown larger than the hook portion 892 so that, in use, the hook portion 892 may be adjustably positioned along the loop portion 894 at a connection point 892 to customize the size of the bow tie 891. An additional loop portion may be attached on the second side of bow tie 891, opposite the loop portion 894, allowing choice of chirality by providing the option to attach the hook portion 892 to the loop portion on either the first or second side of necktie 891. The bow tie 881 is an endless loop including the neckband section 895 with connectable opposing ends, first end 896 connected to second opposing end 898 via the hook-and-loop closure assembly at the selectable connection point 858. This adjustment mechanism variably overlaps part of the neckband 885 with itself to adjust the length of the endless loop, securing the selected length by attaching the hook portion 892 to the hook-and-loop loop portion 894. FIGS. 29A and 29B are perspective rear views of, respectively, an endless bow tie 300 and an ended bow tie 920, each with an endless length adjustment system 900 comprising an arrangement of exemplary hardware slides 872 to adjust neckband length. See, also, FIG. 26. The embodiments of FIG. 29 illustrate two figure-8 slides 872*a* and 872*b*, but any combination of the slide hardware components 872, 926, 928 and 930, shown in FIG. 30, may be employed in the adjustment system 900. The endless bow tie 300 of FIG. 29A includes a first blade 330, an inside knot 350 or an outside knot 360, a second blade 340, a first reference point 337 on the neckband 320, positioned near the blade 330, and a second reference point 347 on the neckband 320, positioned near the blade 340. The ended bow tie 920 of FIG. 29B includes a first tab 391*a*, a first blade 392*a*, a first reference point 337 on the neckband 320, positioned near the blade 392*a*, a second tab 391*b*, a second blade 392*b*, and a second reference point 347 on the neckband 320, positioned near the blade 392*b*. For both of the bowties 300 and 920, for purposes of illustrating the path of the neckband 320 through the two figure-8 slides 872*a* and 872*b*, the neck band 320 is illustrated as a series of serially connected neck band sub-sections 320*a*, 320*b*, 320*c*, 320*d*, and 320*e*. Beginning with the first reference point 337, the neckband first subsection 320*a* extends to and goes through both channels 940*a*, 944*a* of the first figure-8 slide 872*a*, then transitions as the neckband second subsection 320*b* to and through both channels 940*b*, 944*b* of the second figure-8 slide 872*b*, where direction is reversed such that the adjoining third neckband subsection 320*c* extends through both channels 944*a*, 940*a* of the first figure-8 slide 872*a*. Next, the adjoining fourth neckband subsection 320*d*, which extends away from the slide 872*a*, reverses the neckband path for a second time to travel through both channels 944*b*, 940*b* of the second figure-8 slide 872*b*, with the adjoining fifth neckband subsection 320*e* continuing to the second reference point 347.

FIGS. 30A through 30D are front views of the exemplary slides 872, 926, 928 and 930 for incorporation into an endless neckband length adjustment system to enable neckband length adjustment of endless and Mobius plumb neckties and bow ties, as well as ended plumb neckties and ended bowties. FIGS. 30A and 30B illustrate prior art slides 872 and 926. Slide 872 is shown in FIGS. 26 and 29 applied in a configuration according to the invention which adjusts the length of an endless portion of a neckband 120 or 320 or strap in an endless neckband or strap length adjustment system 900. FIGS. 30C and 30D illustrate slides 928 and 930 according to embodiments of the invention. The figure-8 slide 872 of FIG. 30A and the figure-9 slide 926 of FIG. 30B may be incorporated into the exemplary endless neckband length adjustment system 900 shown in FIGS. 26 and 29. These slides may be passed onto the neckband or strap before the neckband or strap end regions are attached or connected to create an endless loop as described with reference to FIG. 23. The figure-Z slide 928 of FIG. 30C and the figure-M slide 930 of FIG. 30D are exemplary of open slides according to the invention. The slides 928 and 930 can be placed on the neckband 120 or, more generally, on a strap or a strip of material, before or after the end regions are attached to one another to create an endless loop as in FIG. 23, or attached to termination points such as attachment of a strap to carry a bag or a backpack. Each of the slides 872, 926, 928, and 930 includes a first rib 938, a first channel 940, a second rib 942, a second channel 944, and a third rib 946. The ribs may connect to form open spaces or closed spaces that further define the channels 940, 944. The figure-8 slide 872 of FIG. 30A includes closed channels 940 and 944. The figure-9 slide 926 of FIG. 30B includes the closed channel 944, the first rib 938 ending in a first gaff 948, and the open channel 940 which is open as a result of a gap 958 between the first gaff 948 and the second rib 942. The gap 958 is of sufficient size to pass a neckband 120 or other strip of fabric into the channel 940.

The figure-Z slide 928 of FIG. 30C also includes an open channel 940 with the rib 938 ending in a first gaff 948, and further includes another open channel 944 with rib 946 ending in a second gaff 950. The two gaffs 948 and 950 occupy opposing positions on different sides of the slide 928. The center rib 942 is (i) attached to the first rib 938 at a first slide neck 952, and (ii) attached to the third rib 946 at a second slide neck 954.

Open channel 940 of the slide 928 is open as a result of a gap 958 between the first gaff 948 and the second rib 942, and open channel 944 of the slide 928 is open as a result of a gap 960 between the second gaff 950 and the second rib 942. The gaps 958, 960 are of sufficient size to pass a neckband 120, 320 or other strap or strip of fabric into the channels 940, 944. The figure-M slide 930 of FIG. 30D includes a first open channel 940 with rib 938 ending in a first gaff 948, and a second open channel 944 with rib 946 ending in a second gaff 950. The two gaffs 948 and 950 occupy positions adjacent one another. Along one end of the slide, the center rib 942 is (i) attached to the first rib 938 at a first slide neck 952 and (ii) is adjacently attached to the third rib 946 at a third slide neck 956. Open channels 940, 944 of the slide 930 are open as a result of a gap 962, between rib 942 and gaffs 948 and 950. The gap 962 is of sufficient size to pass a neckband 120, 320 or other strap or strip of fabric into the channels 940, 944.

Although the illustrated slides may be referred to as hardware, composition of the slides is not limited to any particular metallic or nonmetallic material. The slides may, for example, be formed of metal or plastic. A slide may have resilient or spring-like qualities that facilitate bending to expand a gap adjoining a gaff.

Figure 31A:
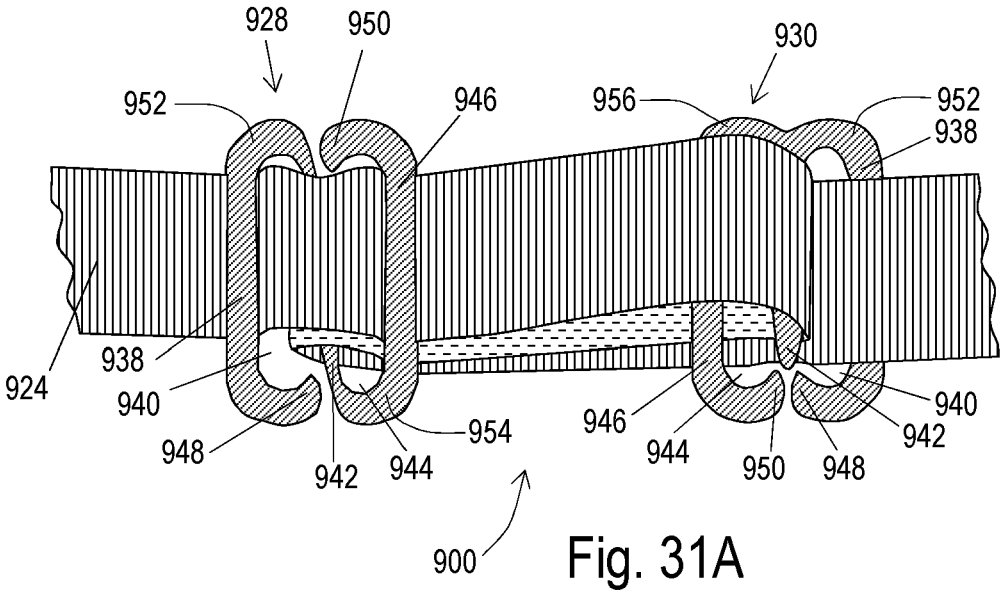
FIGS. 31A-31C illustrate an endless size adjustment system and method of providing length adjustments in a neckband of an endless neck tie or in a strap, where
Figure 31B:
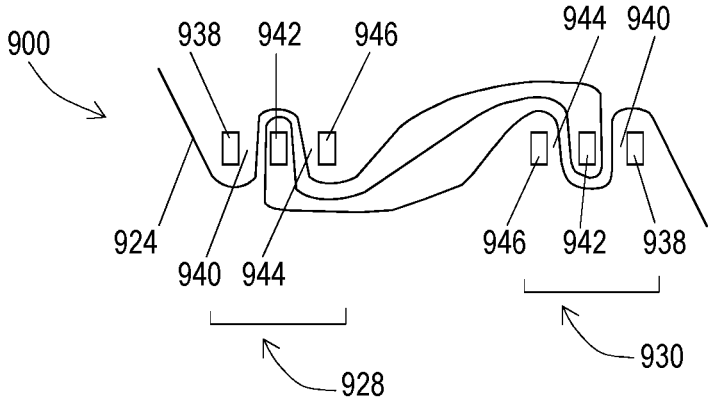

FIG. 31A is a perspective front view of another endless size adjustment system 900 according to an embodiment of the invention. While FIGS. 26 and 29 illustrate the use of prior art figure-8 slides in the endless size adjustment system 900, FIG. 31A illustrates application of a figure-Z slide 928 and a figure-M slide 930 to an endless strap 924 according to embodiments of the invention. The slides 928, 930 in FIG. 3 IB lie generally in the same plane as the strap 924. The term strap as used herein includes neckbands, belts, leashes, and other flat, relatively long, and relatively narrow strips, in addition to elements commonly referred to as straps including luggage straps, backpack straps, tie-down straps, and purse straps. An ended strap has at least one end which may be manipulated for adjustment. An endless strap does not have at least one end which may be manipulated for adjustment; an endless strap may result from attaching opposing ends of an ended strap to each other, or from attaching each opposing end of an ended strap to other components including fabric or hardware.

Figure 31C:
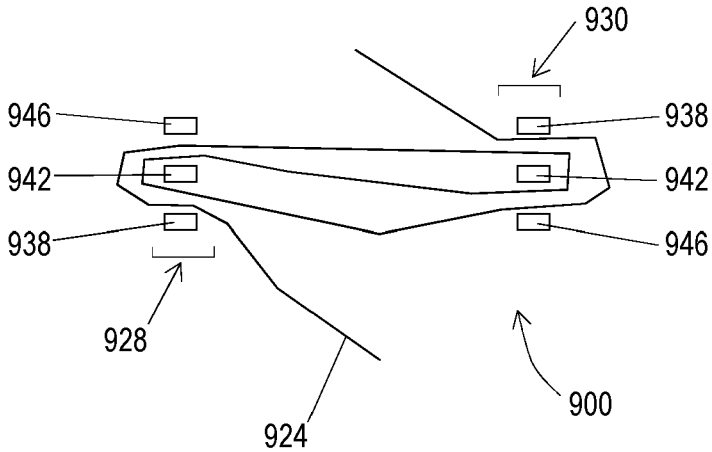

In the view of FIG. 3 IB, the slides 928, 930 are spaced apart along a horizontal plane with the slides positioned in the plane. As can be seen in FIG. 3 IB, the path of the strap 924 takes multiple turns, providing friction which effectively contributes to the stability of the length of the strap. By rotating the slides by 90° as shown in FIG. 31C, the slides are generally perpendicular to the horizontal plane along which the slides are spaced apart. This renders the path of the strap through the horizontal channels 940, 944 more open to reduce the pressure on the strap so friction is reduced and movement of the strap 924 is less constrained. This rotated position is more conducive to changing the length of the neckband or strap. When the slides are turned as in FIG. 31C, pulling the slides apart puts more of the neckband or strap between the slides. This reduces the effective length of the neckband or strap, i.e., it tightens the neckband. Pulling the neckband or strap so the slides move together puts less of the neckband or strap between the slides. This increases the effective length of the neckband or strap, e.g., it loosens the neckband about a neck.

Accordingly, features of embodiments of the endless size adjustment system 900 introduce novel topologies and novel constructions relative to providing a size adjustment mechanism for neck garb without requiring a break in the neckband, i.e., it is an endless size adjustment system.

Endless necktie embodiments of the endless size adjustment mechanism provide the advantages of eliminating complex connection hardware that must connect together or pierce fabric, thereby maintaining the integrity and elegance of the endless loop, and providing a size adjustment by the wearer based on real-time comfort. The endless size adjustment system 900 is also usable for size adjustability of other instances of straps such as clothing, webbing straps, belts, and tie-downs for transporting luggage, furniture, construction materials, and sports equipment.

Numerous embodiments of neckties have been described. According to one embodiment, an endless plumb necktie is tied in a manner similar to tying an overhand knot, resulting in the appearance of an ended neck tie with a blunt, non-pointed blade. Methods have been described for tying an endless plumb necktie in a simple manner that involves looping one projection through another, using unique features of the endless loop, this resulting in the appearance of an ended plumb neck tie with a blunt, non-pointed blade.

According to the invention, a Mobius plumb necktie, made from two pieces of fabric placed back-to-back. The necktie is tied in a simplified manner by looping one projection through another, using unique features of the endless loop, resulting in the appearance of an endless plumb neck tie having a blunt, non-pointed blade and with an outside knot showing both fabric pieces. This embodiment may be further shown to advantage by twisting the front blade to show both fabrics and securing the blade in place with a tie tack, tie bar, or other hardware.

An endless bow tie may be made from an endless loop by folding the endless loop at two places to form a left blade and a right blade, and tying the blades in an overhand knot next to the neck. This embodiment presents similar to an ended bow tie minus its bow tie tabs. An endless bow tie may also be configures from an endless loop by tying an overhand inside knot next to the neck followed by tying an outside knot thereby securing a left blade and a right blade. The inside knot and the outside knot together may be described as a single square knot. A variation on this embodiment adds a half rotation to the outside knot and, while less symmetric than the square knot, this variation mimics a way that ended bow ties are often tied. This embodiment presents similar to an ended bow tie minus its tabs.

A Mobius bow tie may also be made from a Mobius loop by folding the Mobius loop at two places to form a left blade and a right blade, and tying the blades in an overhand knot next to the neck. This embodiment presents similar to an ended bow tie minus its tabs. The characteristic Mobius twist may be shown to advantage on the outside knot or in one of the blades, or may be tucked out of sight. According to still another embodiment, a Mobius bow tie is configured from a Mobius loop by tying an overhand inside knot next to the neck followed by tying an outside knot which secures a left blade and a right blade. The inside knot and the outside knot together may be described as a single square knot. A variation on this embodiment adds a half rotation to the outside knot and, while less symmetric than the square knot, this variation mimics a way that ended bow ties are often tied. This embodiment presents similar to an ended bow tie minus its tabs; and the characteristic Mobius twist may be advantageously displayed on the outside knot or in one of the blades, or may be tucked out of sight. When a Mobius bow tie is formed from two fabrics and a twist is arranged diagonally across the outside knot, the two fabrics may be arranged to alternate from the first side of the neck band, to the first blade, to the first fabric of the outside knot, to the second fabric of the outside knot, to the second blade, and to the second side of the neck band. Variations on how the Mobius bow tie is "dressed" include constraining the Mobius twist to show on the outside knot or in one of the blades; or the Mobius twist may be tucked out of sight e.g., on the neckband below a collar. A variation on the endless bow tie embodiment involves doubling the length of the portion of the endless loop taken up by the left blade and the right blade, and dimpling this excess length and tucking it between the inside knot and the outside knot, the resulting double endless bow tie thus presenting similarly to an ended bow tie without tabs and with double blades.

According to yet embodiment, a double Mobius bow tie is made from a Mobius loop as described above, with double length included in the blade portion of the Mobius loop to allow for a double left blade and a double right blade, which double blades are dimpled and tucked between the inside and outside knots. The resulting double Mobius bow tie thus presents similar to an ended bow tie without tabs, with double blades, and with the characteristic Mobius twist. An embodiment of an asymmetric endless or Mobius bow tie is achieved by increasing or decreasing the length and/or width included in the blade portion of the endless loop or Mobius loop on one side while providing a different blade portion length and/or width on the other side.

Also according to the invention, a bow tie shaped ornament is created from an endless loop or Mobius loop. The ornamental bow tie may be adapted in size and choice of material to adorn various structures including bodies and fasteners such as pins, hairclips, bracelets, necklaces, and straps. Generally, embodiments of the invention may include enhancements in the shape of an endless or Mobius plumb necktie or bow tie by modifying the width of the endless loop or Mobius loop. For example, the region of the loop which becomes the presenting first blade may be narrower or wider than the region of the loop which becomes the second blade. Also, the shape of a double endless bow tie or double Mobius bow tie may be enhanced by modifying the width of the endless loop or Mobius loop. This may include a locally wide protrusion in the double-length loop, which protrusion may be tucked between the inside knot and outside knot to help anchor the tucked loop.

Generally, according to one series of embodiments, elongate lengths of material are formed into a tube, the ends of which are formed so as to allow for left twist, right twist, or no twist in completing steps comprising joining the ends of the tube to turn the tube into an endless or twisted or Mobius loop. Variations on this embodiment include but are not limited to finishing the endless or twisted or Mobius loop by stitching, bonding, gluing, or attaching appropriate fastener hardware.

Based on the varied embodiments described, the endless plumb neck tie 100, the Mobius plumb neck tie 194, the endless bow tie 200, the Mobius bow tie 300, the Mobius bow tie ornament 400, the double endless bow tie 600, and the double Mobius bow tie 604 may be made from woven fabric or ribbon including but not limited to silk, cotton, rayon, wool, linen, polyester, or blended fabric, or made from knitted fabric fashioned by cutting knit fabric, or by knitting, crocheting, tatting, or otherwise forming the custom loop shape, or by stamping, extruding, molding, or gluing suitable materials. However, the embodiments may consist of any other material that may be knotted without fracturing, including but not limited to leather, vinyl, nylon, paper, plastic, or plasticized materials. In one embodiment of a Mobius necktie, made from a fabric tube having contrasting fabrics back-to-back, color contrast between two such fabrics enhances the distinctive look of the Mobius twist.

The above described embodiments of the present invention are merely exemplary and descriptive of the principles. The present invention is not limited to these embodiments which may be amended or modified without departing from the scope of the present invention, which includes structural and functional equivalents. For example, the neck band may be adjustable to the size of the wearer's neck by use of other adjustable hardware arrangements than those illustrated in the figures. A rotatable hardware arrangement may be included to add or delete twists consisting of integer multiples of 180 degrees. Breakaway hardware in the neckband may be used for safety concerns as for the endless plumb neck tie where the lowest region of the blade could catch on a nearby structure. The scope of the present invention instead shall only be limited by the claims which follow.

With reference to FIG. 30D, portions of the first rib, the second rib, and third ribs forming the first channel and the second channel can lack protrusions. A first portion of the second rib can be disposed adjacent the first slide neck and a second portion of the second rib can be disposed adjacent the first gaff and the second gaff. The first portion of the second rib can have a consistent width and the second portion of the second rib can taper toward the first gaff and the second gaff.

What is claimed is:

1. A strap adjustment hardware slide, comprising:

a first rib including a first slide neck and a first gaff, the first rib extending continuously between the first slide neck and the first gaff;

a second rib; and a third rib including a second slide neck and a second gaff, the third rib extending continuously between the second slide neck and the second gaff, the first, second and third ribs connected to one another, wherein:

the first and second ribs define a first channel and the second and third ribs define a second channel;

the first gaff of the first rib is permanently spaced a fixed distance from the second rib to provide an opening into the first channel and the second gaff of the third rib is permanently spaced a fixed distance from the second rib to provide an opening into the second channel, the opening into the first channel positioned between the first and second ribs, the opening into the second channel positioned between the second and third ribs;

the second rib is connected with the first rib via the first slide neck, and the second rib is connected to the third rib via the second slide neck, portions of the first rib, the second rib, and the third rib forming the first channel and the second channel lack protrusions therefrom, wherein a first portion of the second rib disposed adjacent the first slide neck and the second slide neck has a consistent width and a second portion of the second rib disposed adjacent the first gaff and the second gaff tapers toward the first gaff and the second gaff.

2. The slide of claim 1, wherein the first gaff and the second gaff occupy opposing positions on different sides of the slide.

3. The slide of claim 1, wherein the first slide neck and the second slide neck are positioned adjacent one another along a common side of the slide.

4. The slide of claim 3, wherein the first gaff and the second gaff are positioned adjacent one another on a same side of the slide.

5. A strap length adjustment system, comprising:

a strap adjustment hardware slide including a first rib including a first slide neck and a first gaff, the first rib extending continuously between the first slide neck and the first gaff, a second rib, and a third rib including a second slide neck and a second gaff, the third rib extending continuously between the second slide neck and the second gaff, the first, second and third ribs connected to one another, wherein:

the first and second ribs define a first channel and the second and third ribs define a second channel, the first gaff of the first rib is permanently spaced a fixed distance from the second rib to provide an opening into the first channel and the second gaff of the third rib is permanently spaced a fixed distance from the second rib to provide an opening into the second channel, the opening into the first channel positioned between the first and second ribs, the opening into the second channel positioned between the second and third ribs, the second rib is connected with the first rib via the first slide neck, and the second rib is connected to the third rib via the second slide neck, portions of the first rib, the second rib, and the third rib forming the first channel and the second channel lack protrusions therefrom, wherein a first portion of the second rib disposed adjacent the first slide neck and the second slide neck has a consistent width and a second portion of the second rib disposed adjacent the first gaff and the second gaff tapers toward the first gaff and the second gaff; and a neck tie including a strip of material of varying width having first and second opposing ends connectable to one another to form an endless loop, the endless loop including:

a neckband portion including the connectable first and second opposing ends, having along part of its length a relatively narrow width suitable for placement about a neck; and a blade region having a wide width relative to the narrow width of the neckband portion with which first and second blades are configurable, the blade region including a juncture region along which the first and second blades are demarcated when the first and second blades are configured, wherein the strap adjustment hardware slide variably overlaps part of the neckband portion to adjust the length of the endless loop.

6. The strap length adjustment of claim 5, where the part of the neckband portion which overlaps with itself is a part of the neckband first end which extends beyond a point at which the first and second neckband ends are connected.

7. A strap length adjustment system, comprising:

a strap adjustment hardware slide including a first rib including a first slide neck and a first gaff, the first rib extending continuously between the first slide neck and the first gaff, a second rib, and a third rib including a second slide neck and a second gaff, the third rib extending continuously between the second slide neck and the second gaff, the first, second and third ribs connected to one another, wherein:

the first and second ribs define a first channel and the second and third ribs define a second channel, the first gaff of the first rib is permanently spaced a fixed distance from the second rib to provide an opening into the first channel and the second gaff of the third rib is permanently spaced a fixed distance from the second rib to provide an opening into the second channel, the opening into the first channel positioned between the first and second ribs, the opening into the second channel positioned between the second and third ribs, the second rib is connected with the first rib via the first slide neck, and the second rib is connected to the third rib via the second slide neck, portions of the first rib, the second rib, and the third rib forming the first channel and the second channel lack protrusions therefrom, wherein a first portion of the second rib disposed adjacent the first slide neck and the second slide neck has a consistent width and a second portion of the second rib disposed adjacent the first gaff and the second gaff tapers toward the first gaff and the second gaff; and a neck tie including a strip of material of varying width having first and second opposing ends connected to one another to form an endless loop, the endless loop including:

a neckband portion including the connected first and second opposing ends, having along part of its length a relatively narrow width suitable for placement about a neck; and a blade region having a wide width relative to the narrow width of the neckband portion with which first and second blades are configurable, the blade region including a juncture region along which the first and second blades are demarcated when the first and second blades are configured, where the strip includes a first flexible member extending toward the blade region and the strap adjustment hardware slide, parts of which can be selectively included in the endless loop to adjust the length of the endless loop.

* * * * *